US005631122A

United States Patent [19]

Mihayashi et al.

[11] Patent Number: 5,631,122

[45] Date of Patent: *May 20, 1997

[54] SILVER HALIDE COLOR PHOTOGRAPHIC MATERIAL

[75] Inventors: Keiji Mihayashi; Katsuyoshi Yamakawa, both of Kanagawa, Japan

[73] Assignee: Fuji Photo Film Co., Ltd., Kanagawa, Japan

[ * ] Notice: The term of this patent shall not extend beyod the expiration date of Pat. No. 5,401,624.

[21] Appl. No.: 43,894

[22] Filed: Apr. 7, 1993

[30] Foreign Application Priority Data

Apr. 7, 1992 [JP] Japan ..... 4-085777

[51] Int. Cl.[6] ..... G03C 1/46

[52] U.S. Cl. ..... 430/506; 430/558; 430/384; 430/385

[58] Field of Search ..... 430/558, 384, 430/385, 506

[56] References Cited

U.S. PATENT DOCUMENTS

| | | | |
|---|---|---|---|
| 4,950,585 | 8/1990 | Tachibana et al. | 430/385 |
| 4,970,142 | 11/1990 | Kaneko | 430/558 |
| 5,011,765 | 4/1991 | Tachibana et al. | 430/548 |
| 5,024,930 | 6/1991 | Kita et al. | 430/558 |
| 5,061,613 | 10/1991 | Kaneko | 430/558 |
| 5,187,057 | 2/1993 | Ikesu et al. | 430/558 |
| 5,208,141 | 5/1993 | Ikesu et al. | 430/558 |
| 5,210,011 | 5/1993 | Tsukahara et al. | 430/553 |
| 5,326,681 | 7/1994 | Sato et al. | 430/385 |
| 5,401,624 | 3/1995 | Sato et al. | 430/558 |

FOREIGN PATENT DOCUMENTS

| | | |
|---|---|---|
| 2179636 | 7/1990 | Japan . |
| 4204730 | 7/1992 | Japan . |

*Primary Examiner*—Geraldine Letscher
*Attorney, Agent, or Firm*—Sughrue, Mion, Zinn, Macpeak & Seas

[57] ABSTRACT

A silver halide color photographic material having provided on a support at least one light-sensitive silver halide emulsion layer, wherein said photographic material contains a coupler of formula (I) and at least one coupler selected from the group consisting of couplers represented by formula (II) and (III), wherein the substituents are as defined herein the specification.

(I)

(II)

(III)

The material has improved coloring capacity and color image fastness and fluctuation of the properties of the material due to variation of the processing conditions is reduced.

11 Claims, No Drawings

SILVER HALIDE COLOR PHOTOGRAPHIC MATERIAL

FIELD OF THE INVENTION

The present invention relates to a silver halide color photographic material which has a high coloring capacity, provides highly fast cyan color images, and gives consistent, reproducible results in spite of fluctuations in processing conditions.

BACKGROUND OF THE INVENTION

As cyan dye forming couplers in subtractive color photography, phenol couplers and naphthol couplers have been in conventional use for same time.

Recently, various cyan couplers having novel core structures have been proposed. As couplers similar to those used in the present invention, for example, JP-A 64-46752 (corresponding to U.S. Pat. No. 4,950,585; the term "JP-A" as used herein means an "unexamined published Japanese patent application") discloses 5-membered ring-6-membered ring condensed couplers in which a pyrazole ring is condensed with a nitrogen-containing 6-membered ring to form a hetero ring structure; JP-A-64-46753 (U.S. Pat. No. 4,950,585) discloses pyrazolopyrimidone couplers; JP-A-2-236545 discloses 5-membered ring-6-membered ring condensed couplers in which a pyrimidone or pyrimidinethione ring is condensed to form a nitrogen-containing 6-membered hetero ring structure, such as imidazopyrimidone, imidazopyrimidinethione and pyrazolopyrimidone couplers; and JP-A-2-190850, JP-A-2-232653 (U.S. Pat. No. 4,970,142) and JP-A-2-214857 (U.S. Pat. No. 4,970,142) disclose pyrazolo-unsym-triazin-7-one, pyrazolo-sym-triazin-5-one and pyrazolo-sym-triazin-7-one couplers, respectively.

The Japanese patent applications cited in the preceding paragraph state that these novel cyan couplers all form color images free from change of the color hue due to heat, moisture and light and that these couplers are all superior to conventional phenol and naphthol couplers described above with respect to heat resistance, moisture resistance and light resistance.

However, it has been found that, although these couplers have improved heat resistance, moisture resistance and light resistance, their coupling reactivity with an oxidation product of an aromatic primary amine developing agent is extremely low so that the amount of the coupler and the amount of silver halide emulsion to be coated must be significantly increased to obtain the necessary cyan color density. In order to overcome this problem, it has been considered important to improve the coloring capacity of the couplers in question.

Examples of conventional phenol couplers include 2-acylamino-5-alkylphenol, 2,5-diacylaminophenol and 2-ureido- 5-acylaminophenol couplers, and examples of conventional naphthol couplers include 2-carbamoyl-1-naphthol and 2-carbamoyl-5-amido-1-naphthol couplers. Specific examples of conventional phenol and naphthol couplers are described in, for example, U.S. Pat. Nos. 2,369,929, 2,801,171, 2,895,826, 3,772,002, 4,052,212, 4,146,396, 4,228,233, 4,296,200, 2,772,162, 3,758,308, and 4,334,011, German Patent Laid-Open No. 3,329,729 (U.S. Pat. No. 4,463,086), European Patent Laid-Open No. 121, 365 (U.S. Pat. No. 4,500,635), U.S. Pat. Nos. 4,327,173, 3,446,622, 4,333,999, 4,427,767, 4,451,559, and 4,775,616, European Patent Laid-Open Nos. 271,323, 271,324 (U.S. Pat. No. 4,775,616) and 271,325 (U.S. Pat. No. 4,753,871), U.S. Pat. Nos. 4,690,889, 4,254,212, and 4,296,199, and JP-A-61-42658 (U.S. Pat. No. 4,910,128).

However, these phenol and naphthol couplers do not satisfy all the necessary fundamental properties of couplers, including, for example, coupling reactivity of the couplers with an oxidation product of an aromatic primary amine color developing agent; properties of the color dyes to be formed from the couplers, such as the molecular extinction coefficient, the spectral absorption maximum wavelength, the green light in the short wavelength side, the absorption density in the blue light range, and the change of the color hue due to the color density; fastness of the color dyes to heat, moisture and light; resistance of the color dyes to change to leuco dyes; and stability of the color dyes with respect to change of hue with the lapse of time. The phenol and naphthol couplers in question have some drawbacks in that they do not satisfy all of the necessary properties and further improvement of them is being researched.

As mentioned above, 5-membered ring-6-membered ring condensed cyan couplers in which a pyrazole ring or imidazole ring is condensed with a nitrogen-containing 6-membered ring to form a hetero ring structure have a low coupling reactivity with an oxidation product of an aromatic primary amine color developing agent so that it is not practical to use them in silver halide color photographic materials.

SUMMARY OF THE INVENTION

Accordingly, a first object of the present invention is to provide a silver halide color photographic material which is excellent in coloring, which has a high coupling reactivity with an oxidation product of an aromatic primary amine color developing agent, and which forms a color dye having a high molecular extinction coefficient.

A second object of the present invention is to provide a silver halide color photographic material capable of forming a highly fast color image.

A third object of the present invention is to provide a silver halide color photographic material whose fluctuation of photographic properties is small and which is stable in spite of subjecting it to a running processing of color development or to a processing with a bleaching solution of which oxidation capacity is reduced.

These objects have been attained with a silver halide color photographic material having provided on a support at least one light-sensitive silver halide emulsion layer, wherein the photographic material contains a coupler of formula (I) and at least one coupler selected from the couplers represented by formula (II) or (III):

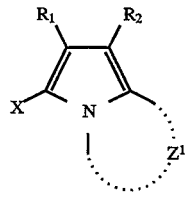

(I)

wherein $R^1$ represents a hydrogen atom or a substituent;

$R^2$ represents a substituent;

X represents a hydrogen atom or a leaving group capable of splitting off in a coupling reaction with an oxidation product of a color developing agent; and $Z^1$ represents a group of non-metallic atoms necessary for forming a nitrogen-containing 6-membered hereto ring, provided that the hetero ring has at least one dissociating group;

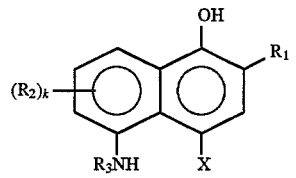

(II)

wherein $R^1$ represents —$CONR_4R_5$, —$SO_2NR_4R_5$, —$NHCOR_4$, —$NHCOOR_6$, —$NHSO_2R_6$, —$NHCONR_4R_5$ or —$NHSO_2NR_4R_5$;

$R_2$ represents a group substitutable on the naphthalene ring of the formula;

k represents an integer of from 0 to 3, and when k is 2 or 3, the plural $R_2$ group may be same as or different from each other or may be bonded to each other to form a ring;

$R_3$ represents a substituent;

X represents a hydrogen atom or a leaving group capable of splitting off in a coupling reaction with an oxidation product of a color developing agent;

$R_4$ and $R_5$ may be same as or different from each other and each independently represents a hydrogen atom, an alkyl group, an aryl group or a heterocyclic group;

$R_6$ represents an alkyl group, an aryl group or a heterocyclic group;

$R_2$ and $R_3$, or $R_3$ and X may be bonded to each other to form a ring; and the coupler may be in the form of a bis or a higher form via a bivalent or higher valent group at $R_1$, $R_2$, $R_3$ or X, or may be in the form of a polymer by bonding to a polymer chain at $R_1$, $R_2$, $R_3$ or X;

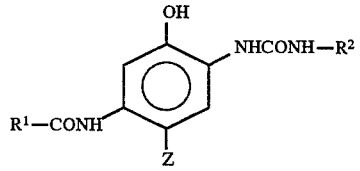

(III)

wherein $R^1$ represents an alkyl group, an aryl group or a heterocyclic group;

$R^2$ represents an aryl group; and

Z represents a hydrogen atom or a leaving group capable of splitting off in a coupling reaction with an oxidation product of a color developing agent.

DETAILED DESCRIPTION OF THE INVENTION

The couplers of formula (I) are described in detail below.

In formula (I), $R^1$ represents a hydrogen atom or a substituent, and $R^2$ represents a substituent. Examples of $R^2$ and of $R^1$ in the case where $R^1$ is a substituent group include an aryl group, an alkyl group, a cyano group, an acyl group, a carbamoyl group, an alkoxycarbonyl group, an aryloxycarbonyl group, a formylamino group, an acylamino group, an alkoxycarbonylamino group, an aryloxycarbonylamino group, a sulfonamido group, an ureido group, a sulfamoylamino group, an alkylamino group, an arylamino group, an alkoxy group, an aryloxy group, a heterocyclic ring oxy group, an alkylthio group, an arylthio group, a heterocyclic ring thio group, a heterocyclic group, a halogen atom, a hydroxyl group, a nitro group, a sulfamoyl group, a sulfonyl group, an acyloxy group, a carbamoyloxy group, an imido group, a sulfinyl group, a oxophosphorio group, —COOM and —$SO_3M$ (wherein M represents H, an alkali metal atom such as Li, Na and K, or $NH_4$), and an unsubstituted amino group. These groups may optionally be substituted by one or more substituents such as those mentioned above.

In the present invention, unless otherwise indicated an acyl group or an acyl moiety includes an aliphatic and aromatic group or moieties and a heterocyclic ring carbonyl group or moiety; the number of carbon atoms includes also those of the substituent thereof; and preferred heterocyclic ring is 5- to 7-membered heterocyclic ring having at least one of N, O, S, P, Se, and Te as hetero-atom and the heterocyclic ring may be fused with an aromatic ring, e.g., benzene ring.

More precisely, stable substituents represented by $R^1$ and $R^2$ include an aryl group (preferably having from 6 to 30 carbon atoms, such as phenyl, m-acetylaminophenyl, p-methoxyphenyl), an alkyl group (having from 1 to 30 carbon atoms, such as methyl, trifluoromethyl, ethyl, isopropyl, heptafluoropropyl, t-butyl, n-octyl, n-dodecyl), a cyano group, an acyl group (preferably having from 1 to 30 carbon atoms, such as acetyl, pivaloyl, benzoyl, furoyl, 2-pyridylcarbonyl), a carbamoyl group (preferably having from 1 to 30 carbon atoms, such as methylcarbamoyl, ethylcarbamoyl, dimethylcarbamoyl, n-octylcarbamoyl), an alkoxycarbonyl group (preferably having from 2 to 30 carbon atoms, such as methoxycarbonyl, ethoxycarbonyl, isopropoxycarbonyl), an aryloxycarbonyl group (preferably having from 7 to 30 carbon atoms, such as phenoxycarbonyl, p-methoxyphenoxycarbonyl, m-chlorophenoxycarbonyl, o-methoxyphenoxycarbonyl), a formylamino group, an acylamino group (e.g., an alkylcarbonylamino group preferably having from 2 to 30 carbon atoms, such as acetylamino, propionylamino, cyanoacetylamino; an arylcarbonylamino group preferably having from 7 to 30 carbon atoms, such as benzoylamino, p-toluylamino, pentafluorobenzoylamino, m-methoxybenzoylamino; or a heterocyclic ring carbonylamino group preferably having from 4 to 30 carbon atoms, such as 2-pyridylcarbonylamino, 3-pyridylcarbonylamino, furoylamino), an alkoxycarbonylamino group (preferably having from 2 to 30 carbon atoms, such as methoxycarbonylamino, ethoxycarbonylamino, methoxyethoxycarbonylamino), an aryloxycarbonylamino group (preferably having from 7 to 30 carbon atoms, such as phenoxycarbonylamino, p-methoxyphenoxycarbonylamino, p-methylphenoxycarbonylamino, m-chlorophenoxycarbonylamino); a sulfonamido group (e.g., an alkylsulfonamido group preferably having from 1 to 30 carbon atoms, such as methylsulfonamido, and an arylsulfonamido group having from 6 to 30 carbon atoms such as phenylsulfonamido, p-tolylsulfonamido), an ureido group (preferably having from 1 to 30 carbon atoms, such as methylureido, dimethylureido, p-cyanophenylureido), a sulfamoylamino group (preferably having from 0 to 30 carbon atoms, such as methylaminosulfonylamino, ethylaminosulfonylamino, anilinosulfonylamino), an alkylamino group (preferably having from 1 to 30 carbon atoms, such as methylamino, dimethylamino, ethylamino, diethylamino, n-butylamino), an arylamino group (preferably having from 6 to 30 carbon atoms, such as anilino), an alkoxy group (preferably having from 1 to 30 carbon atoms, such as methoxy, ethoxy, isopropoxy, n-butoxy, methoxyethoxy, n-dodecyloxy), an aryloxy group (preferably having from 6 to 30 carbon atoms, such as phenoxy, m-chlorophenoxy, p-methoxyphenoxy, o-methoxyphenoxy), a heterocyclic ring oxy group (preferably having from 3 to 30 carbon atoms, such as tetrahydropyranyloxy, 3-pyridyloxy, 2-(1,3-benzimidazolyl) oxy), an alkylthio group (preferably having from 1 to 30 carbon atoms, such as methylthio, ethylthio, n-butylthio, t-butylthio), an arylthio group (preferably having from 6 to 30 carbon atoms, such as phenylthio), a heterocyclic ring thio group (preferably having from 3 to 30 carbon atoms, such as 2-pyridylthio, 2-(1,3-benzoxazolyl)thio, 1-hexadecyl-1,2,3,4-tetrazolyl-5-thio, 1-(3-N-octadecylcarbamoyl)phenyl-1,2,3,4-tetrazolyl-5-thio), a heterocyclic group (preferably having from 3 to 30 carbon atoms, such as 2-benzoxazolyl, 2-benzothiazolyl, 1-phenyl-2-benzimidazolyl, 5-chloro-1-tetrazolyl, 1-pyrrolyl, 2-furanyl, 2-pyridyl, 3-pyridyl), a halogen atom (e.g., fluorine, chlorine, bromine), a hydroxyl group, a nitro group, a sulfamoyl group (preferably having from 0 to 30 carbon atoms, such as methylsulfamoyl, dimethylsulfamoyl), a sulfonyl group (preferably an alkylsulfonyl group having from 1 to 30 carbon atoms, such as methylsulfonyl, and an aryl sulfonyl group having from 6 to 30 carbon atoms such as phenylsulfonyl, tolylsulfonyl, a heterocyclic ring sulfonyl group having from 3 to 30 carbon atoms such as morpholinosulfonyl), an acyloxy group (preferably formyloxy, an alkylcarbonyloxy having from 2 to 30 carbon atoms, such as acetyloxy, and an arylcarbonyloxy having from 7 to 30 carbon atoms such as benzoyloxy and heterocyclic ring carbonyloxy having from 3 to 30 carbon atoms, such as 3-pyridylcarbonyloxy), a carbamoyloxy group (preferably having from 1 to 30 carbon atoms, such as methylcarbamoyloxy, diethylcarbamoyloxy), an imido group (preferably a closed ring imido group having from 4 to 30 carbon atoms, such as succinimido, phthalimido), a sulfinyl group (preferably an alkylsulfinyl group having from 1 to 30 carbon atoms, such as ethylsulfinyl, and octylsulfinyl, an arylsulfinyl having from 6 to 30 carbon atoms, such as phenylsulfinyl, and a heterocyclic ring sulfinyl having from 3 to 30 carbon atoms, such as 2-furylsulfinyl), an aminosulfinyl group (preferably having from 0 to 30 carbon atoms, such as diethylaminosulfinyl), a oxophosphorio group (preferably having from 0 to 30 carbon atoms, such as dihydroxophosphorio, dimethoxophosphorio, bis(diethylamino)oxophosphorio), a —COOM, —$SO_3M$ (wherein M represents a hydrogen atom, an alkali metal atom such as Na and K, and $NH_4$), an unsubstituted amino group, and an alkylsulfonyloxy (preferably having from 1 to 30 carbon atoms, such as methylsulfonyloxy), and an arylsulfonyloxy (preferably having from 6 to 30 carbon atoms, such as p-tolylsulfonyloxy).

In formula (I), preferably at least one of $R^1$ and $R^2$ is an electron attracting group having a Hammett's substituent constant σp value of 0.35 or more. More preferably, at least one of $R^1$ and $R^2$ is an electron attracting group having a σp value of 0.60 or more. The σp value is preferably not more than 0.95. Especially preferably, at least one of $R^1$ and $R^2$ is a cyano group.

The Hammett's substituent constant as referred to herein will be explained briefly hereunder. Hammett's Rule is an empirical rule proposed by L. P. Hammett in 1935 for the purpose of quantitatively assessing the influence of a substituent on the reactivity or equilibrium of a benzene derivative having the substituent. Hammett's Rule is widely accepted. The substituent constant to be obtained by Hammett's Rule includes a σp value and a σm value, and these are referred to in the literature. For instance, J. A. Dean, *Lange's Handbook of Chemistry,* 12th Ed. (1979, published by McGraw-Hill); and *Range of Chemistry,* special edition, No. 122, pp. 96–103 (1979, published by Nankoh Do Publishing) describe σp and σm values in detail. The substituents in the preceding general formulae will be defined or explained by way of their Hammett's σp substituent constants, which, however, does not mean that the substituents are limited only to those referred to in the publications as having such σp values. Needless to say, the substituents each indicate any and every substituent, including undescribed or unknown ones, which may have a σp value falling within the defined range as determined by Hammett's Rule.

Specific examples of an electron attracting group having a σp value of 0.35 or more include a cyano group (σp value, 0.66), a nitro group (0.78), a carboxyl group (0.45), a perfluoroalkyl group (such as trifluoromethyl (0.54), perfluorobutyl), an acyl group (such as acetyl (0.50), benzoyl (0.43)), a formyl group (0.42), a sulfonyl group (e.g., an alkylsulfonyl such as trifluoromethylsulfonyl (0.92), methylsulfonyl (0.72), and an arylsulfonyl such as phenylsulfonyl (0.70)), a sulfinyl group (e.g., an alkylsulfinyl such as methylsulfinyl (0.49)), a carbamoyl group (e.g., an alkylsulfinyl such as carbamoyl (0.36), methylcarbamoyl (0.36), phenylcarbamoyl, 2-chlorophenylcarbamoyl), an alkoxycarbonyl group (such as methoxycarbonyl (0.45), ethoxycarbonyl, diphenylmethylcarbonyl), a heterocyclic group (such as pyrazolyl (0.37), 1-tetrazolyl (0.50)), an alkylsulfonyloxy group (such as methylsulfonyloxy (0.36)), an oxophosphorio group (such as dimethoxophosphorio (0.60)), a sulfamoyl group (0.57), a pentachlorophenyl group, a pentafluorophenyl group, and a sulfonyl-substituted aromatic group (such as 2,4-dimethanesulfonylphenyl).

Specific examples of an electron attracting group having a σp value of 0.60 or more include a cyano group, a nitro group and a sulfonyl group (such as alkylsulfonyl and an arylsulfonyl).

X represents a hydrogen atom or a leaving group capable of splitting off in a coupling reaction with an oxidation product of a color developing agent such as an aromatic primary amine color developing agent (hereinafter referred to as a coupling leaving group).

Specific examples of coupling leaving groups include a halogen atom (e.g., fluorine, chlorine, bromine), an alkoxy group (such as ethoxy, dodecyloxy, methoxyethylcarbamoylmethoxy, carboxypropyloxy, methylsulfonylethoxy), an aryloxy group (such as 4-chlorophenoxy, 4-methoxyphenoxy, 4-carboxyphenoxy), an acyloxy group (such as acetoxy, tetradecanoyloxy, benzoyloxy), a sulfonyloxy group (e.g., alkylsulfonyloxy and arylsulfonyloxy, such as methylsulfonyloxy, tolylsulfonyloxy), an acylamino group (such as dichloroacetylamino, heptafluorobutyrylamino), a sulfonamido group (such as methylsulfonamido, p-tolylsulfonamido), an alkoxycarbonyloxy group (such as ethoxycarbonyloxy, benzyloxycarbonyloxy), an aryloxycarbonyloxy group (such as phenoxycarbonyloxy), an alkylthio group (such as carboxymethylthio), an arylthio group (such as 2-butoxy-5-tert-octylphenylthio), a heterocyclic thio group (such as tetrazolylthio), a carbamoylamino group (such as N-methylcarbamoylamino, N-phenylcarbamoylamino), a 5-membered or 6-membered nitrogen-containing heterocyclic group which may further contain at least one of N, O and S atoms (such as imidazolyl, pyrazolyl, triazolyl, tetrazolyl, 1,2-dihydro-2-oxo-1-pyridyl), an imido group (preferably closed ring imido, such as succinimido, hydantoinyl), an aromatic azo group (preferably monocyclic or bicyclic, such as phenylazo, naphthylazo), a sulfinyl group (preferably alkylsulfinyl, arylsulfinyl, and heterocyclic ring sulfinyl, such as 2-butoxy-5-tert-octylphenylsulfinyl), and a sulfonyl group (preferably alkylsulfonyl, arylsulfonyl, and heterocyclic ring sulfonyl, such as 2-butoxy-5-tert-octylphenylsulfonyl). These groups may further be substituted by one or more substituents such as the substituents described as suitable substituents for $R^1$.

Suitable leaving groups also include leaving groups which are bonded to the coupler moiety via a carbon atom. Specific examples of such leaving groups include bis-type couplers to be obtained by condensation of 4-equivalent couplers with aldehydes or ketones. The leaving group of the invention may contain a photographically useful group such as a development inhibitor, a development acceptor and others.

$Z^1$ represents a group of non-metallic atoms necessary for forming a nitrogen-containing 6-membered hetero ring, which contains at least one dissociating group.

Divalent linking groups which may be included in the nitrogen-containing 6-memberfed hetero ring include —N(R)—, —N═,

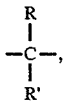

—C(R)═, —CO—, —S—, —SO— and —$SO_2$—. In these divalents linking groups, R and R' each represents a hydrogen atom or a substituent having the same meaning as $R^1$.

Specific examples of the dissociating group in $Z^1$ include dissociating groups having an acidic proton, such as —NH— and —CH(R)—. The dissociating group is preferably one having a pKa in water of from 3 to 12.

The dye forming couplers of formula (I) are preferably those of the following general formulae (IIa) to (XIXa):

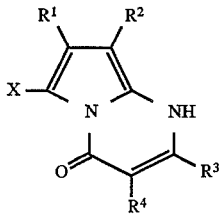

(IIa)

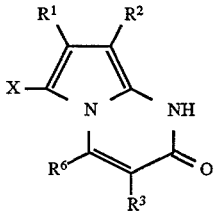

(IIIa)

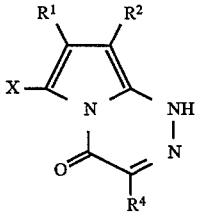

(IVa)

-continued

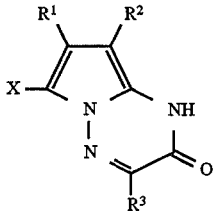

(Va)

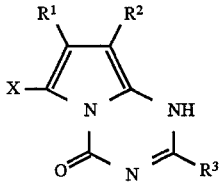

(VIa)

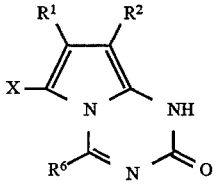

(VIIa)

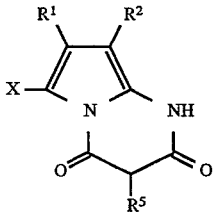

(VIIIa)

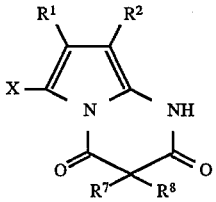

(IXa)

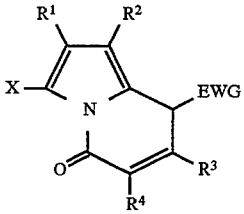

(Xa)

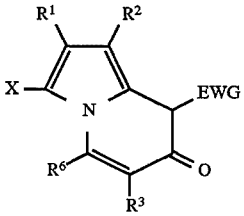

(XIa)

-continued (XIIa)

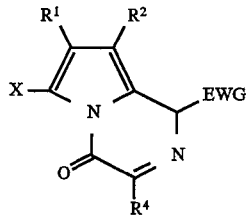

(XIIIa)

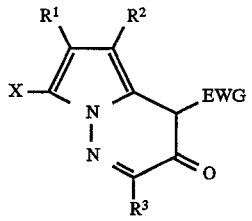

(XIVa)

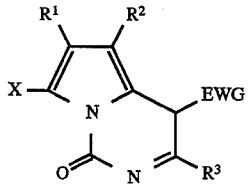

(XVa)

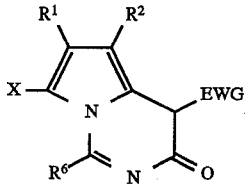

(XVIa)

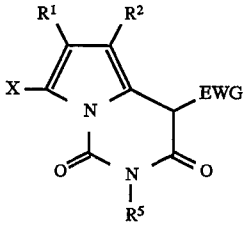

(XVIIa)

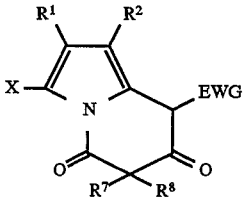

(XVIIIa)

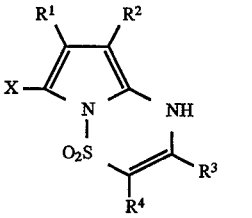

-continued (XIXa)

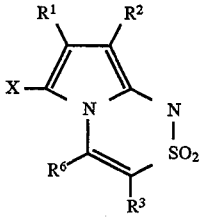

In these formulae, $R^1$, $R^2$ and X have the same meanings as in formula (I); $R^3$, $R^5$, $R^6$, $R^7$ and $R^8$ each represents a hydrogen atom or a substituent; $R^4$ represents a substituent; and EWG represents an electron attracting group having a Hammett's substituent constant σp value of 0.35 or more.

Specific examples of substituents for $R^3$, $R^4$, $R^5$, $R^6$, $R^7$ and $R^8$ include the substituents described as examples for $R^1$. $R^3$ to $R^8$ each may be further substituted, and in such cases, specific examples of suitable substituents include the substituents described as substituents for $R^1$.

The couplers of formulae (I) and (IIa) to (XIXa) may be in the form of a bis-form or a higher-form which is formed at $R^1$, (i.e., $R^3$, $R^4$, $R^5$, $R^6$, $R^7$ or $R^8$) formula in (I) or (IIa) to (XIXa) via a divalent or a higher valent group; or they may also be in the form of a homopolymer or copolymer in which one of the groups described herein above bonds to a polymer chain. In such a case the restrictions on the numbers of carbon atoms to be in the preceding substituents do not apply.

Where the coupler of formula (I) forms a polymer, it is typically a homopolymer or copolymer containing addition-polymerizing ethylenic unsaturated compound(s) each having a cyan dye forming coupler moiety (cyan coloring monomer(s)). Such addition-polymerizing ethylenic unsaturated compounds are preferably represented by the following formula (I-2):

$$-(Gi)gi-(Hj)hj- \qquad \text{(I-2)}$$

wherein Gi is a repeating unit derived from a coloring monomer and is represented by the following formula (I-3); Hj is a repeating unit derived from a non-coloring monomer; i is a positive integer; j is 0 or a positive integer; and gi and hj each are a weight percentage of Gi or Hj; and when i or j is a plural number, then Gi or Hj contains repeating units of plural different kinds.

(II-3)

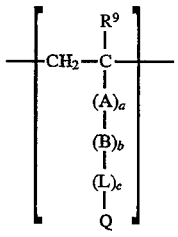

In formula (I-3), $R^9$ represents a hydrogen atom, an alkyl group having from 1 to 4 carbon atoms, or a chlorine atom; A represents —CONH—, —COO— or a substituted or unsubstituted phenylene group; B represents a divalent group having a carbon atom at both terminals thereof, such as a substituted or unsubstituted alkylene, phenylene or oxydialkylene group; L represents —CONH—, —NHCONH—, —NHCOO—, —NHCO—, —OCONH—, —NH—, —COO—, —OCO—, —CO—, —O—, $—SO_2—$, $—NHSO_2—$ or $—SO_2NH—$; a, b and c each represents an integer of 0 or 1; and Q represents a cyan coupler moiety obtained by removing one hydrogen atom from $R^1$, $R^2$, $Z_1$ or X in a coupler of formula (I). Examples of the substituents of the substituted groups include a halogen atom (e.g., F, Cl, Br), an alkyl group preferably having from 1 to 5 carbon atoms, and an aryl group (e.g., phenyl).

Non-coloring ethylenic monomers which do not couple with an oxidation product of an aromatic primary amine developing agent and which provide the repeating unit Hj include, for example, acrylic acid, α-chloroacrylic acid, α-alkylacrylic acids (e.g., methacrylic acid), and amides and esters derived from such acrylic acids (e.g., acrylamide, methacrylamide, n-butylacrylamide, t-butylacrylamide, diacetoneacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxyethyl methacrylate), vinyl esters (e.g., vinyl acetate, vinyl propionate, vinyl laurate), acrylonitrile, methacrylonitrile, aromatic vinyl compounds (e.g., styrene and its derivatives such as vinyl toluene, divinylbenzene, vinylacetophenone, sulfostyrene), itaconic acid, citraconic acid, crotonic acid, vinylidene chloride, vinyl alkyl ethers (e.g., vinyl ethyl ether), maleates, N-vinyl-2-pyrrolidone, N-vinylpyridine, and 2- and 4-vinylpyridines.

Of these, acrylates, methacrylates and maleates are especially preferred. Two or more of such non-coloring ethylenic monomers may be used in combination. Suitable combinations include a combination of methyl acrylate and butyl acrylate; a combination of butyl acrylate and styrene; a combination of butyl methacrylate and methacrylic acid; and a combination of methyl acrylate and diacetonacrylamide.

As is well known in the field of polymer couplers, ethylenic unsaturated comonomers to be copolymerized with vinyl monomers represented by the above-mentioned formula (I-3) are selected so that the comonomers favorably influence the solid, liquid or micelle forms of the copolymers to be formed therefrom, and the physical and/or chemical properties of the copolymers, such as solubility (in water or organic solvents), compatibility with binders of photographic colloidal compositions such as gelatin, flexibility, thermal stability, coupling reactivity with an oxidation product of a developing agent, and non-diffusiveness in photographic colloids. The copolymers may be either random copolymers or copolymers having a specific sequence (such as block copolymers or alternate copolymers).

The cyan polymer couplers for use in the present invention have a number average molecular weight on the order of generally from several thousands to several millions. Oligomeric polymer couplers having a molecular weight of 5000 or less may also be used in the content of the invention.

The cyan polymer couplers for use in the present invention may be either oleophilic polymers soluble in organic solvents (such as ethyl acetate, butyl acetate, ethanol, methylene chloride, cyclohexanone, dibutyl phthalate, tricresyl phosphate) or hydrophilic polymers soluble in hydrophilic colloids such as aqueous gelatin solution, or may also be polymers having a structure and properties allowing the formation of micelles in hydrophilic colloids.

For obtaining oleophilic polymer couplers soluble in organic solvents, it is preferred to essentially select oleophilic non-coloring ethylenic monomers (such as acrylates, methacrylates, maleates, vinyl benzenes) as comonomer components for them.

An emulsified-dispersion of polymer coupler can be obtained by emulsifying-dispersing an organic solvent solution of an oleophilic polymer coupler obtained by polymerization of vinyl monomers which provides a coupler unit of the preceding formula (I-3) in an aqueous gelatin solution to form a latex of the coupler; or the emulsified description of the coupler may be prepared by direct emulsion polymerization.

U.S. Pat. No. 3,451,820 mentions emulsion dispersion of an oleophilic polymer coupler in an aqueous gelatin solution as a latex thereof; and U.S. Pat. Nos. 4,080,211 and 3,370,952 mention emulsion polymerization of forming an oleophilic polymer coupler. The disclosed methods may be applied to the present invention.

For obtaining hydrophilic polymer couplers soluble in a neutral or alkaline aqueous solution, it is preferred to use hydrophilic non-coloring ethylenic monomers such as N-(1,1-dimethyl-2-sulfonatoethyl)acrylamide, 3-sulfonatopropyl acrylate, sodium styrenesulfonate, potassium styrenesulfinate, acrylamide, methacrylamide, acrylic acid, methacrylic acid, N-vinylpyrrolidone and n-vinylpyridine, as comonomer components.

Such a hydrophilic polymer coupler may be added to the coating liquid in the form of an aqueous solution thereof, or it may be dissolved in a mixed solvent comprising a water-miscible organic solvent, such as a lower alcohol, tetrahydrofuran, acetone, ethyl acetate, cyclohexanone, ethyl lactate or dimethylformamide, dimethylacetamide, and water and the resulting solution may be added to the coating liquid. Such a hydrophilic polymer coupler may also be dissolved in an aqueous alkaline solution or an aqueous alkali-containing organic solvent and the resulting solution may be added to the coating liquid. If desired, a small amount of a surfactant may be added to the coating liquid containing such a hydrophilic polymer coupler.

Specific examples of couplers of the present invention are given below, which, however, are not limitative.

Specific examples of substituents in couplers are shown below, some of which are used in examples of couplers represented by formula (I). (In the chemical formulas in the present invention an alkyl group which does not have any symbol of n-, iso- or ter- represents a n-alkyl group.)

H ①

F ②

Cl ③

Br ④

I ⑤

⑥

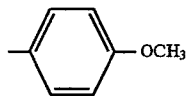

⑦

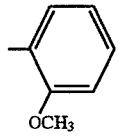

⑧

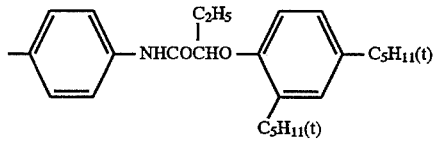

-continued
(9) 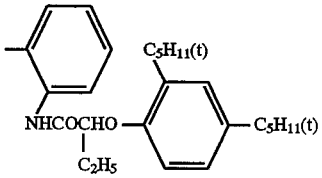
(10) 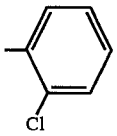
(11) 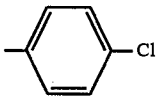
(12) 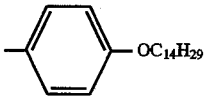
(13) 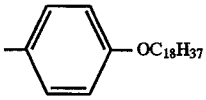
(14) 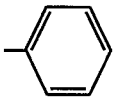
(15) 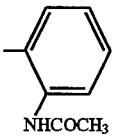
(16) 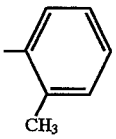
(17) 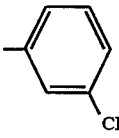
(18) 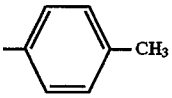
(19) 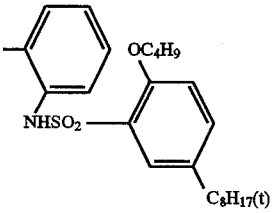
(20) 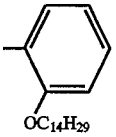
-continued
(21) $CH_3$
(22) $C_2H_5$
(23) $-C_3H_7(i)$
(24) $-C_4H_9(t)$
(25) $-CF_3$
(26) $-C_3F_7$
(27) $-(CH_2)_3OC_{12}H_{25}$
(28) 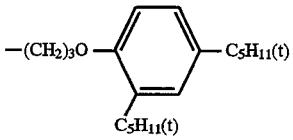
(29) $-C_{16}H_{33}$
(30) 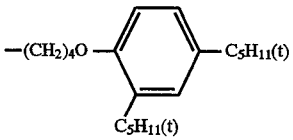
(31) $-CN$
(32) $-COCH_3$
(33) $-COC_{15}H_{31}$
(34) $-COC_4H_9(t)$
(35) 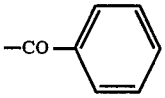
(36) $-CONH_2$
(37) $-CONHC_{16}H_{33}$
(38) 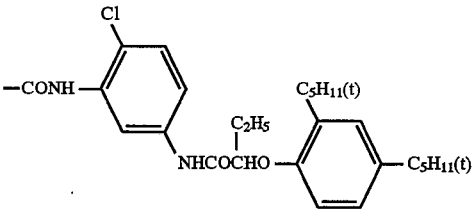
(39) 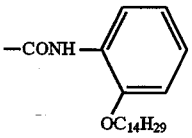
(40) 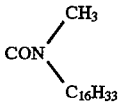
(41) $-CO_2CH_3$
(42) $-CO_2C_{16}H_{33}$
(43) $-CO_2C_2H_5$
(44) 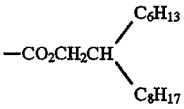

-continued
$-CO_2CH_2(CF_2)_6F$ (45)
$-NHCOCH_3$ (46)
$-NHCOCH_2CN$ (47)
$-NHCOC_4H_9(t)$ (48)
(49)
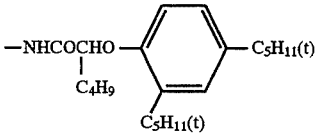
(50)
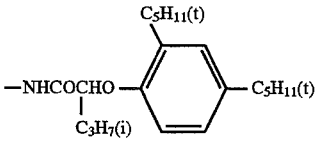
(51)
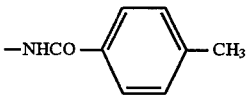
(52)
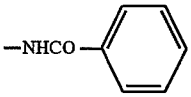
(53)
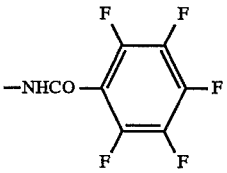
(54)
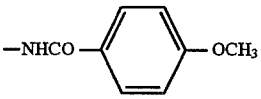
(55)
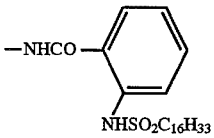
$-NHCO_2C_2H_5$ (56)
$-NHCO_2C_4H_9(i)$ (57)
(58)
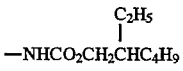
$-NHSO_2CH_3$ (59)
$-NHSO_2C_{16}H_{33}$ (60)
(61)
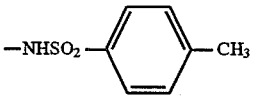
(62)
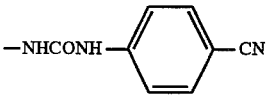
-continued
(63)
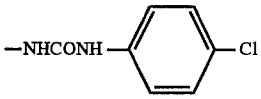
(64)
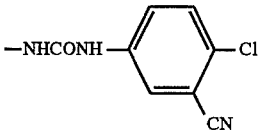
(65)
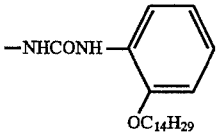
(66)
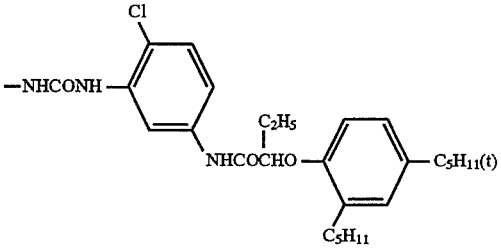
(67)
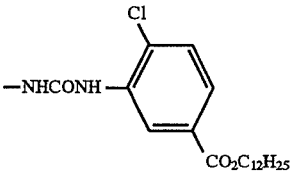
(68)
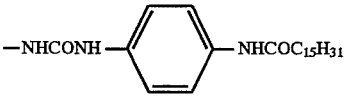
$-N(CH_3)_2$ (69)
(70)
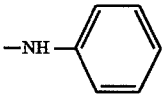
$-OCH_3$ (71)
$-OC_2H_5$ (72)
$-OCH_2CH_2OCH_3$ (73)
$-OCH_2CH_2OH$ (74)
$-OCH_2CH_2SCH_2CH_2OH$ (75)
(76)
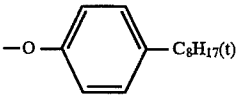
(77)
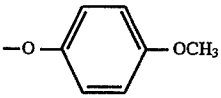
(78)
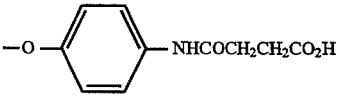
$-SCH_2CH_2OH$ (79)

-continued
(80) $-SCH_2CO_2H$
(81) $-SCH_2CH_2CO_2H$
(82)
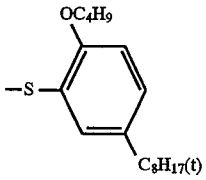
(83)
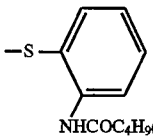
(84)
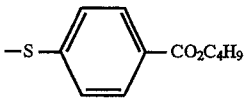
(85)
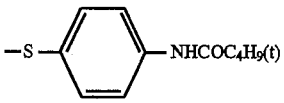
(86)
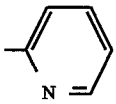
(87)
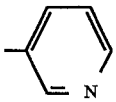
(88)
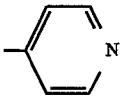
(89)
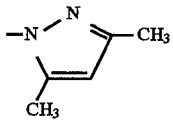
(90)
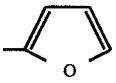
(91)
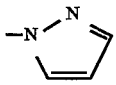
(92) $-OH$
(93) $-NO_2$
(94)
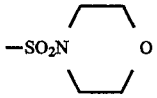
(95) $-SO_2NH(CH_2)_3OC_{12}H_{25}$
(96)
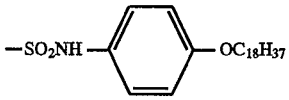
-continued
(97)
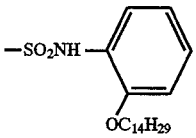
(98)
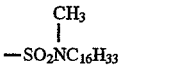
(99)
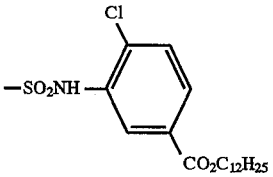
(100) $-SO_2CH_3$
(101)
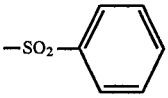
(102)
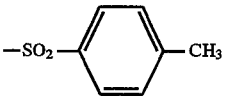
(103) $-SO_2C_4H_9$
Examples of couplers of the present invention are listed below, which, however, are not limitative.
| Coupler No. | $R^1$ | $R^2$ | $R^3$ | $R^4$ | $R^5$ | $R^6$ | $R^7$ | $R^8$ | X |
|---|---|---|---|---|---|---|---|---|---|
| (IIa)-1 | (14) | (31) | (13) | (21) | — | — | — | — | (1) |
| (IIa)-2 | (14) | (31) | (13) | (21) | — | — | — | — | (3) |
| (IIa)-3 | (88) | (31) | (28) | (21) | — | — | — | — | (3) |
| (IIa)-4 | (42) | (31) | (12) | (21) | — | — | — | — | (3) |
| (IIa)-5 | (12) | (31) | (15) | (21) | — | — | — | — | (3) |
| (IIa)-6 | (31) | (31) | (19) | (21) | — | — | — | — | (3) |
| (IIa)-7 | (31) | (31) | (20) | (21) | — | — | — | — | (3) |
| (IIa)-8 | (16) | (40) | (13) | (21) | — | — | — | — | (1) |
| (IIa)-9 | (9) | (31) | (14) | (21) | — | — | — | — | (3) |
| (IIa)-10 | (8) | (31) | (14) | (21) | — | — | — | — | (3) |
| (IIa)-11 | (43) | (43) | (13) | (21) | — | — | — | — | (3) |
| (IIa)-12 | (14) | (31) | (19) | (23) | — | — | — | — | (74) |
| (IIa)-13 | (25) | (31) | (19) | (23) | — | — | — | — | (77) |
| (IIa)-14 | (14) | (45) | (67) | (23) | — | — | — | — | (79) |
| (IIa)-15 | (25) | (31) | (66) | (23) | — | — | — | — | (83) |
| (IIa)-16 | (14) | (31) | (68) | (23) | — | — | — | — | (91) |
| (IIIa)-1 | (14) | (31) | (44) | — | — | (21) | — | — | (1) |
| (IIIa)-2 | (14) | (31) | (44) | — | — | (21) | — | — | (3) |

-continued

| | | | | | | | | | |
|---|---|---|---|---|---|---|---|---|---|
| (IIIa)-3 | 14 | 31 | 44 | — | — | 1 | — | — | 1 |
| (IIIa)-4 | 18 | 31 | 45 | — | — | 1 | — | — | 3 |
| (IIIa)-5 | 31 | 31 | 45 | — | — | 1 | — | — | 3 |
| (IIIa)-6 | 31 | 31 | 42 | — | — | 1 | — | — | 1 |
| (IIIa)-7 | 14 | 31 | 37 | — | — | 1 | — | — | 3 |
| (IIIa)-8 | 15 | 31 | 38 | — | — | 1 | — | — | 3 |
| (IIIa)-9 | 16 | 31 | 39 | — | — | 1 | — | — | 3 |
| (IIIa)-10 | 43 | 43 | 39 | — | — | 1 | — | — | 3 |
| (IIIa)-11 | 31 | 43 | 44 | — | — | 1 | — | — | 3 |
| (IIIa)-12 | 45 | 31 | 44 | — | — | 1 | — | — | 3 |
| (IIIa)-13 | 7 | 31 | 44 | — | — | 72 | — | — | 3 |
| (IIIa)-14 | 14 | 31 | 38 | — | — | 72 | — | — | 3 |
| (IIIa)-15 | 10 | 44 | 1 | — | — | 69 | — | — | 3 |
| (IIIa)-16 | 87 | 31 | 44 | — | — | 1 | — | — | 82 |
| (IIIa)-17 | 14 | 31 | 44 | — | — | 1 | — | — | 83 |
| (IIIa)-18 | 88 | 31 | 38 | — | — | 1 | — | — | 76 |
| (IIIa)-19 | 14 | 31 | 37 | — | — | 1 | — | — | 80 |
| (IIIa)-20 | 14 | 31 | 40 | — | — | 1 | — | — | 91 |
| (IVa)-1 | 14 | 31 | — | 13 | — | — | — | — | 1 |
| (IVa)-2 | 25 | 31 | — | 19 | — | — | — | — | 3 |
| (IVa)-3 | 43 | 31 | — | 28 | — | — | — | — | 80 |
| (IVa)-4 | 31 | 14 | — | 27 | — | — | — | — | 83 |
| (Va)-1 | 14 | 31 | 13 | — | — | — | — | — | 1 |
| (Va)-2 | 25 | 31 | 20 | — | — | — | — | — | 3 |
| (Va)-3 | 43 | 31 | 30 | — | — | — | — | — | 79 |
| (Va)-4 | 31 | 14 | 29 | — | — | — | — | — | 84 |
| (VIa)-1 | 14 | 31 | 28 | — | — | — | — | — | 1 |
| (VIa)-2 | 25 | 31 | 27 | — | — | — | — | — | 3 |
| (VIa)-3 | 43 | 31 | 19 | — | — | — | — | — | 81 |
| (VIa)-4 | 31 | 14 | 12 | — | — | — | — | — | 82 |
| (VIIa)-1 | 14 | 31 | — | — | — | 9 | — | — | 1 |
| (VIIa)-2 | 25 | 31 | — | — | — | 13 | — | — | 3 |
| (VIIa)-3 | 43 | 31 | — | — | — | 27 | — | — | 80 |
| (VIIa)-4 | 31 | 14 | — | — | — | 28 | — | — | 85 |
| (IXa)-1 | 14 | 31 | — | — | — | — | 27 | 27 | 1 |
| (IXa)-2 | 25 | 31 | — | — | — | — | 27 | 27 | 3 |
| (IXa)-3 | 43 | 31 | — | — | — | — | 28 | 28 | 81 |
| (IXa)-4 | 31 | 14 | — | — | — | — | 28 | 28 | 84 |
| (VIIIa)-1 | 14 | 31 | — | — | 29 | — | — | — | 1 |
| (VIIIa)-2 | 8 | 31 | — | — | 14 | — | — | — | 1 |

-continued

| | | | | | | | | | |
|---|---|---|---|---|---|---|---|---|---|
| (VIIIa)-3 | 37 | 31 | — | — | 21 | — | — | — | 1 |
| (VIIIa)-4 | 49 | 31 | — | — | 21 | — | — | — | 3 |
| (VIIIa)-5 | 25 | 37 | — | — | 21 | — | — | — | 1 |
| (VIIIa)-6 | 31 | 31 | — | — | 8 | — | — | — | 1 |
| (VIIIa)-7 | 14 | 38 | — | — | 21 | — | — | — | 1 |
| (VIIIa)-8 | 42 | 42 | — | — | 14 | — | — | — | 1 |
| (VIIIa)-9 | 13 | 31 | — | — | 14 | — | — | — | 1 |
| (VIIIa)-10 | 14 | 31 | — | — | 13 | — | — | — | 74 |
| (VIIIa)-11 | 14 | 31 | — | — | 9 | — | — | — | 75 |
| (VIIIa)-12 | 14 | 31 | — | — | 8 | — | — | — | 76 |
| (VIIIa)-13 | 31 | 14 | — | — | 13 | — | — | — | 78 |
| (VIIIa)-14 | 31 | 31 | — | — | 12 | — | — | — | 79 |
| (VIIIa)-15 | 42 | 14 | — | — | 19 | — | — | — | 80 |
| (VIIIa)-16 | 42 | 31 | — | — | 20 | — | — | — | 81 |
| (VIIIa)-17 | 14 | 31 | — | — | 8 | — | — | — | 82 |
| (VIIIa)-18 | 31 | 31 | — | — | 8 | — | — | — | 83 |
| (VIIIa)-19 | 14 | 31 | — | — | 19 | — | — | — | 84 |
| (VIIIa)-20 | 31 | 14 | — | — | 9 | — | — | — | 91 |

| Coupler No. | $R^1$ | $R^2$ | $R^3$ | $R^4$ | $R^5$ | $R^6$ | $R^7$ | $R^8$ | EWG | X |
|---|---|---|---|---|---|---|---|---|---|---|
| (Xa)-1 | 14 | 31 | 13 | 21 | — | — | — | — | 31 | 1 |
| (Xa)-2 | 25 | 31 | 19 | 23 | — | — | — | — | 31 | 3 |
| (Xa)-3 | 43 | 31 | 67 | 23 | — | — | — | — | 43 | 79 |
| (Xa)-4 | 31 | 14 | 68 | 23 | — | — | — | — | 31 | 82 |
| (XIa)-1 | 14 | 31 | 44 | — | — | 21 | — | — | 31 | 1 |
| (XIa)-2 | 25 | 31 | 45 | — | — | 1 | — | — | 43 | 3 |
| (XIa)-3 | 43 | 31 | 44 | — | — | 72 | — | — | 31 | 80 |
| (XIa)-4 | 31 | 14 | 1 | — | — | 69 | — | — | 31 | 83 |
| (XIIa)-1 | 14 | 31 | — | 19 | — | — | — | — | 43 | 1 |
| (XIIa)-2 | 25 | 31 | — | 13 | — | — | — | — | 31 | 3 |
| (XIIa)-3 | 43 | 31 | — | 27 | — | — | — | — | 31 | 81 |
| (XIIa)-4 | 31 | 14 | — | 28 | — | — | — | — | 43 | 84 |
| (XIIIa)-1 | 14 | 31 | 20 | — | — | — | — | — | 31 | 1 |
| (XIIIa)-2 | 25 | 31 | 13 | — | — | — | — | — | 31 | 3 |
| (XIIIa)-3 | 43 | 31 | 29 | — | — | — | — | — | 43 | 79 |
| (XIIIa)-4 | 31 | 14 | 30 | — | — | — | — | — | 31 | 85 |
| (XIVa)-1 | 14 | 31 | 19 | — | — | — | — | — | 31 | 1 |
| (XIVa)-2 | 25 | 31 | 12 | — | — | — | — | — | 43 | 3 |
| (XIVa)-3 | 43 | 31 | 27 | — | — | — | — | — | 31 | 80 |
| (XIVa)-4 | 31 | 14 | 28 | — | — | — | — | — | 31 | 82 |
| (XVa)-1 | 14 | 31 | — | — | — | 13 | — | — | 43 | 1 |

-continued

| | | | | | | | | | | |
|---|---|---|---|---|---|---|---|---|---|---|
| (XVa)-2 | 25 | 31 | — | — | — | 9 | — | — | 31 | 3 |
| (XVa)-3 | 43 | 31 | — | — | — | 28 | — | — | 31 | 81 |
| (XVa)-4 | 31 | 14 | — | — | — | 27 | — | — | 43 | 83 |
| (XVIa)-1 | 14 | 31 | — | — | 8 | — | — | — | 31 | 1 |
| (XVIa)-2 | 25 | 31 | — | — | 9 | — | — | — | 31 | 3 |
| (XVIa)-3 | 43 | 31 | — | — | 13 | — | — | — | 43 | 79 |
| (XVIa)-4 | 31 | 14 | — | — | 19 | — | — | — | 31 | 84 |
| (XVIIa)-1 | 14 | 31 | — | — | — | — | 27 | 27 | 31 | 1 |
| (XVIIa)-2 | 25 | 31 | — | — | — | — | 27 | 27 | 43 | 3 |
| (XVIIa)-3 | 43 | 31 | — | — | — | — | 28 | 28 | 31 | 80 |
| (XVIIa)-4 | 31 | 14 | — | — | — | — | 28 | 28 | 31 | 85 |
| (XVIIIa)-1 | 14 | 31 | 13 | 21 | — | — | — | — | — | 1 |
| (XVIIIa)-2 | 25 | 31 | 28 | 21 | — | — | — | — | — | 3 |
| (XVIIIa)-3 | 43 | 31 | 19 | 23 | — | — | — | — | — | 81 |
| (XVIIIa)-4 | 31 | 14 | 67 | 23 | — | — | — | — | — | 83 |
| (XIXa)-1 | 14 | 31 | 44 | — | — | 21 | — | — | — | 1 |
| (XIXa)-2 | 25 | 31 | 45 | — | — | 1 | — | — | — | 3 |
| (XIXa)-3 | 43 | 31 | 38 | — | — | 72 | — | — | — | 79 |
| (XIXa)-4 | 31 | 14 | 40 | — | — | 1 | — | — | — | 84 |

Examples of synthesizing some typical couplers of the present invention are given below.

SYNTHESIS EXAMPLE 1

Synthesis of Coupler (IIIa)-1:

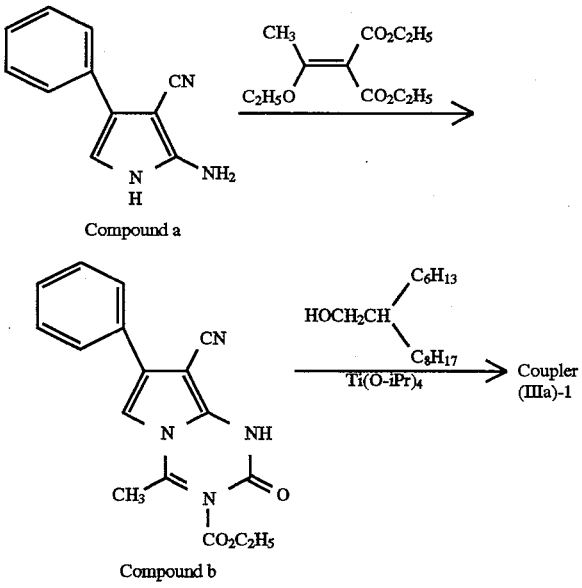

18.3 g of 2-amino-3-cyano-4-phenylpyrrole (Compound a) (which is easily obtained by condensation of 2-aminoacetophenone hydrochloride and malononitrile in the presence of an alkali) and 25.3 g of diethyl ethoxyethylidenemalonate were dispersed in 300 ml of ethanol, and 22.0 ml of a 28% methanol solution of sodium methylate was added thereto and heated under reflux for 5 hours. After being cooled, ethyl acetate was added to this solution, which was washed with water. Then, the organic solvent was concentrated, and the crystals thus precipitated out were taken out by filtration. 11.6 g of Compound b was obtained. Next, 50 ml of Fineoxocol 1600 (trade name of 2-hexyldecylalcohol produed by Nissan Kagaku Kogyo Co.) and 2.0 g of titanium isopropoxide ($Ti(O\text{-}i\text{-}Pr)_4$) were added to the 11.6 g of Compound b and heated in an oil bath at 130° to 140° C. for 6 hours. After being cooled, the product was purified by silica gel chromatography (hexane/ethyl acetate=1/1 by volume) to obtain 14.7 g of Coupler (IIIa)-1 as a pale yellow oil.

SYNTHESIS EXAMPLE 2

Synthesis of Coupler (IIIa)-3:

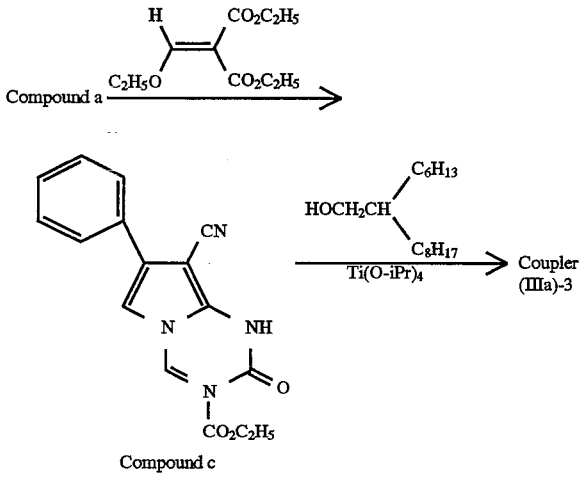

18.3 g of 2-amino-3-cyano-4-phenylpyrrole (Compound a) and 24.0 g of diethyl ethoxymethylenemalonate were dispersed in 400 ml of ethanol, and 22.0 ml of a 28% methanol solution of sodium methylate was added thereto and heated under reflux for one hour. After being cooled, the crystals as precipitated out were taken out by filtration to obtain 28.0 g of Compound c. Next, 150 ml of Fine Oxocoal 1600 and 4.0 g of $Ti(O\text{-}i\text{-}Pr)_4$ were added to the 28.0 g of Compound c and heated in an oil bath at 130° to 140° C for 2 hours. After being cooled, the product was purified by silica gel chromatography to obtain 36.2 g of Coupler (IIIa)-3.

SYNTHESIS EXAMPLE 3

Synthesis of Coupler (IIa)-1:

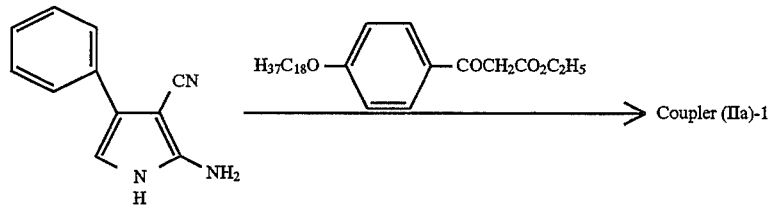

Compound a 18.3 g of 2-amino-3-cyano-4-phenylpyrrole (Compound a) and 46.0 g of ethyl p-octadecyloxybenzoylacetate were dispersed in 300 ml of acetic acid and heated under reflux for 8 hours. After being cooled, one liter of ethyl acetate and one liter of water were added thereto, and the crystals as precipitated out were taken out by filtration to obtain 29.0 g of Coupler (IIa)-1.

Other couplers of the invention may be produced in the same manner as above.

The cyan coupler of formula (I) of the present invention may be incorporated in one or more layers, and, as described below, it is used in combination with a cyan coupler of formula (II) and/or (III) in the photographic material. The cyan coupler of formula (I) may also be combined with any other known cyan coupler(s) in addition to a coupler of formula (II) and/or (III).

The cyan coupler of formula (I) can be incorporated into a photographic material by any known dispersion method. Preferably, an oil-in-water dispersion method is used to incorporate the coupler of formula (I) into the photographic material.

The cyan couplers of formula (I) have a high coupling reactivity with an oxidation product of an aromatic primary amine color developing agent, and the dye obtained by the coupling reaction has a high molecular extinction coefficient. Thus, the couplers of formula (I) are so-called high coloring couplers. Accordingly, the cyan couplers of formula (I) have a high sensitivity and give a dye having a high color density. Using the couplers of formula (I), therefore, the amount of coupler to be incorporated into a photographic material may be reduced. In addition, the color images to be formed from the couplers of formula (I) have high color fastness.

Next, compounds of formula (II) for use in the present invention are described below in detail.

In formula (II), $R_1$ represents $—CONR_4R_5$, $—SO_2NR_4R_5$, $—NHCOR_4$, $—NHCOOR_6$, $—NHSO_2R_6$, $—NHCONR_4R_5$ or $—NHSO_2NR_4R_5$, and $R_4$, $R_5$ and $R_6$ each independently represents an alkyl or alkenyl group having a total carbon number of from 1 to 30, an aryl group having a total carbon number of from 6 to 30, or a heterocyclic group having a total carbon number of from 2 to 30. $R_4$ and $R_5$ each may be a hydrogen atom.

$R_2$ represents a substituent (including an atom—the same shall apply hereunder) which can be substituted on the naphthalene ring in the coupler. Typical examples of $R_2$ include a halogen atom (e.g., F, Cl, Br, I), a hydroxyl group, —COOM and $—SO_3M$ (wherein M represents H, an alkali metal atom such as Li, Na and K, or $NH_4$), an amino group, a cyano group, an alkyl or alkenyl group, an aryl group, a heterocyclic group, a carbonamido group (e.g., RCONH— wherein R represents an alkyl group or an aryl group), a sulfonamido group (e.g., $RSO_2NH$— wherein R represents an alkyl group or an aryl group), a carbamoyl group, a sulfamoyl group, a ureido group, an acyl group, an acyloxy group, an alkoxy group, an aryloxy group, an alkylthio group, an arylthio group, an alkylsulfonyl group, an arylsulfonyl group, a sulfamoylamino group, a alkoxycarbonylamino group, a nitro group, and an imido group. When k is 2 in formula (II), two $R_2$'s may form a methylenedioxy group and a trimethylene group. The total carbon number of $(R_2)_k$ is from 0 to 30.

$R_3$ in formula (II) represents a substituent, which is preferably represented by the following general formula (II-1):

$$R_7(Y)_m— \qquad \text{(II-1)}$$

wherein Y represents —NH—, —CO— or $—SO_2—$; m represents an integer of 0 or 1; $R_7$ represents a hydrogen atom, an alkyl or alkenyl group having a total carbon number of from 1 to 30, an aryl group having a total carbon number of from 6 to 30, a heterocyclic group having a total carbon number of from 2 to 30,

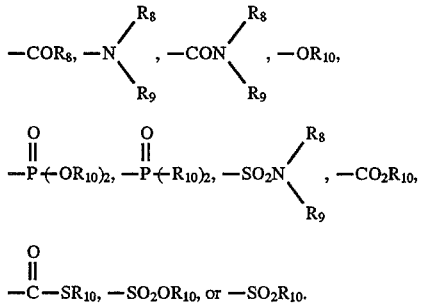

$R_8$, $R_9$ and $R_{10}$ have the same meanings as $R_4$, $R_5$ and $R_6$, respectively.

In $R_1$ or $R_7$, $R_4$ and $R_5$ of $—NR_4R_5$, $R_8$ and $R_9$ of $—NR_8R_9$, and two $R_{10}$ groups each may be bonded to each other to form a nitrogen- or phosphorus-containing hetero ring (e.g., pyrrolidine ring, piperidine ring, morpholine ring).

X represents a hydrogen atom or a leaving group capable of splitting off from the coupler in a coupling reaction with an oxidation product of a developer such as an aromatic primary amine developing agent. Specific examples of the leaving group are a halogen atom,

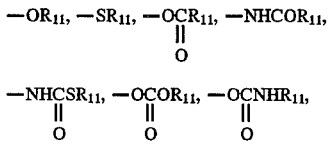

a thiocyanato group, and a heterocyclic group having a total carbon number of from 1 to 30 and which bonds to the active coupling position of the coupler via the nitrogen atom of the group (e.g., succinimido group, phthalimido group, pyrazolyl group, hydantoinyl group, 2-benzotriazolyl group). $R_{11}$ has the same meaning as $R_6$.

An alkyl and alkenyl groups as referred to herein may be linear, branched and may have substituent(s), for example, a halogen atom, a hydroxyl group, an aryl group, a heterocyclic group, an alkoxy group, an aryloxy group, an alkylsulfonyl group, an arylsulfonyl group, an alkoxycarbonyl group, an acyloxy group and an acyl group. Specific examples of the alkyl group include methyl, isopropyl, isobutyl, t-butyl, 2-ethylhexyl, cyclohexyl, n-dodecyl, n-hexadecyl, 2-methoxyethyl, benzyl, trifluoromethyl, 3-dodecyloxypropyl and 3-(2,4-di-t-pentylphenoxy)propyl groups.

An aryl group as referred in formula (II) may be in the form of a condensed ring (e.g., naphthyl group) or may have substituent(s), for example, a halogen atom, an alkyl group, an aryl group, an alkoxy group, an aryloxy group, a cyano group, an acyl group, an alkoxycarbonyl group, a carbonamido group and a sulfonamido group (e.g., RCONH— and $RSO_2NH$— wherein R represents alkyl or aryl), a carbamoyl group, a sulfamoyl group, an alkylsulfonyl group and an arylsulfonyl group. Specific examples of aryl groups include phenyl, tolyl, pentafluorophenyl, 2-chlorophenyl, 4-hydroxyphenyl, 4-cyanophenyl, 2-tetradecyloxyphenyl, 2-chloro-5-dodecyloxyphenyl and 4-t-butylphenyl groups.

A heterocyclic group as referred in formula (II) means a mono-cyclic or condensed heterocyclic group containing at least one hetero atom selected from O, N, S, P, Se and Te in the ring. The heterocyclic group may have substituent(s), for example, a halogen atom, a carboxyl group, a hydroxyl group, a nitro group, an alkyl group preferably having from 1 to 30 carbon atoms, an aryl group preferably having from 6 to 30 carbon atoms, an alkoxy group preferably having from 1 to 30 carbon atoms, an aryloxy group preferably having from 6 to 30 carbon atoms, an alkoxycarbonyl group preferably having from 2 to 30 carbon atoms, an aryloxycarbonyl group preferably 7 to 30 carbon atoms, an amino group, a carbamoyl group preferably having from 1 to 30 carbon atoms, a sulfamoyl group preferably having from 0 to 30 carbon atoms, an alkylsulfonyl group preferably having from 1 to 30 carbon atoms and an arylsulfonyl group preferably having from 6 to 30 carbon atoms. Specific examples of heterocyclic groups include 2-pyridyl, 4-pyridyl, 2-furyl, 4-thienyl, benzotriazol-1-yl, 5-phenyltetrazol-1-yl, 5-methylthio-1,3,4-thiadiazol-2-yl and 5-methyl-1,3,4-oxadiazol-2-yl groups.

Preferred examples of $R_1$, $R_2$, $R_3$ and X in formula (II) are given below.

$R_1$ is preferably —$CONR_4R_5$ or —$SO_2NR_4R_5$. Specific preferred examples of $R_1$ include carbamoyl, N-n-butylcarbamoyl, N-n-dodecylcarbamoyl, N-(3-n-dodecyloxypropyl)carbamoyl, N-cyclohexylcarbamoyl, N-[3-(2,4-di-t-pentylphenoxy)propyl]carbamoyl, N-hexadecylcarbamoyl, N-[4-(2,4-di-t-pentylphenoxy)butyl]carbamoyl, N-(3-dodecyloxy-2-methylpropyl)carbamoyl, N-[3-(4-t-octylphenoxy)propyl]carbamoyl, N-hexadecyl-N-methylcarbamoyl, N-(3-dodecyloxypropyl)sulfamoyl and N-[4-(2,4-di-t-pentylphenoxy)butyl]sulfamoyl groups. $R_1$ is especially preferably —$CONR_4R_5$.

$R_2$ preferably is not present, that is, k is preferably 0. k is also preferably 1. When k is 1, $R_2$ is preferably a halogen atom, an alkyl group (e.g., methyl, isopropyl, t-butyl, cyclopentyl), a carbonamido group (e.g., acetamido, pivalinamido, trifluoroacetamido, benzamido), a sulfonamido group (e.g., methylsulfonamido, tolylsulfonamido), or a cyano group.

$R_3$ is preferably represented by formula (II-1) and m in formula (II-1) is preferably 0. More preferably, $R_7$ in formula (II-1) is —$COR_8$ (e.g., formyl, acetyl, trifluoroacetyl, 2-ethylhexanoyl, pivaloyl, benzoyl, pentafluorobenzoyl, 4-(2,4-di-t-pentylphenoxy)butanoyl), —$COOR_{10}$ (e.g., methoxycarbonyl, ethoxycarbonyl, isobutoxycarbonyl, 2-ethylhexyloxycarbonyl, n-dodecyloxycarbonyl, 2-methoxyethoxycarbonyl), or —$SO_2R_{10}$ (e.g., methylsulfonyl, n-butylsulfonyl, n-hexadecylsulfonyl, phenylsulfonyl, p-tolylsulfonyl, p-chlorophenylsulfonyl, trifluoromethylsulfonyl). Especially preferably, $R_7$ is —$COOR_{10}$.

X is preferably a hydrogen atom, a halogen atom, —$OR_{11}$ (e.g., an alkoxy group such as ethoxy, 2-hydroxyethoxy, 2-methoxyethoxy, 2-(2-hydroxyethoxy)ethoxy, 2-methylsulfonylethoxy, ethoxycarbonylmethoxy, carboxymethoxy, 3-carboxypropoxy, N-(2-methoxyethyl)carbamoylmethoxy, 1-carboxytridecyloxy, 2-methanesulfonamidoethoxy, 2-(carboxymethylthio)ethoxy, 2-(1-carboxytridecylthio)ethoxy; or an aryloxy group such as 4-cyanophenoxy, 4-carboxyphenoxy, 4-methoxyphenoxy, 4-t-octylphenoxy, 4-nitrophenoxy, 4-(3-carboxypropanamido)phenoxy, 4-acetamidophenoxy), or —$SR_{11}$ (e.g., an alkylthio group such as carboxymethylthio, 2-carboxymethylthio, 2-methoxyethylthio, ethoxycarbonylmethylthio, 2,3-dihydroxypropylthio, 2-(N,N-dimethylamino)ethylthio; or an arylthio group such as 4-carboxyphenylthio, 4-methoxyphenylthio, 4-(3-carboxypropanamido)phenylthio). Especially preferably, X is a hydrogen atom, a chlorine atom, an alkoxy group or an alkylthio group.

The coupler of formula (II) may form a bis-form or a higher-form or a polymer as those described for the coupler represented by formula (I).

Specific examples of $R_1$, $R_2$, $R_3NH$—, and X in formula (II) and specific examples of cyan couplers of formula (II) are mentioned below, which, however, are not limitative.

Examples of $R_1$:

$-CONH(CH_2)_3O-A$ $-CONH(CH_2)_4O-A$ $-CONH(CH_2)_3OC_{12}H_{25}$-n $-CONH(CH_2)_3OC_{10}H_{21}$-n $-CONH(CH_2)_3OCH_2CH(C_2H_5)C_4H_9$-n $-CONHC_{16}H_{22}$-n $-CONHCH_2CH(CH_3)CH_2C_{12}H_{25}$-n $-CONH(CH_2CH_2O)_2C_{12}H_{25}$-n $-CONHCH_2CH_2OC_{12}H_{25}$-n

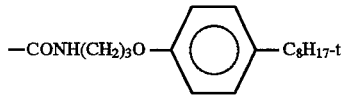

$-CONH(CH_2)_3O-C_8H_{17}$-t $-CONHCH_2CH(C_6H_{13})C_8H_{17}$-n

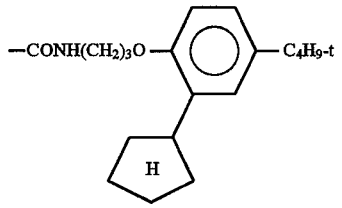

$-CONH(CH_2)_3O-C_4H_9$-t

-continued

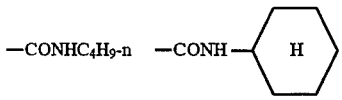

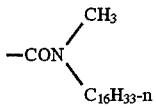

$-CONH(CH_2)_3OC_{14}H_{29}$-n $-CONH(CH_2)_3OC_{11}H_{23}$-n $-SO_2NH(CH_2)_3OC_{12}H_{25}$-n

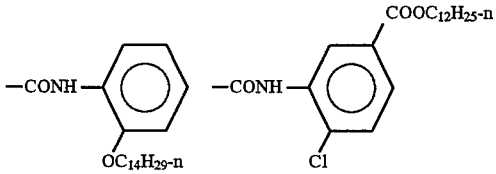

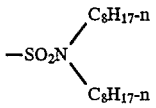

$-NHCO(CH_2)_3O-A$

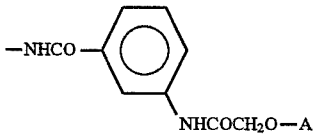

$-NHSO_2C_{16}H_{33}$-n

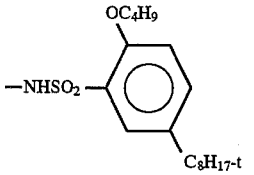

$-NHCOOC_{12}H_{25}$-n

Examples of $R_2$:

$-F$ $-Cl$ $-CN$ $-CH_3$ $-CF_3$ $-C_4H_9$-t $-C_8H_{17}$-t $-NHCOCH_3$ $-NHSO_2CH_3$

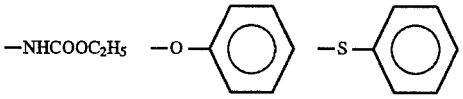

$-OC_8H_{17}$-n

Examples of $R_3NH$—:

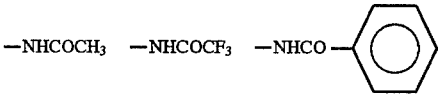

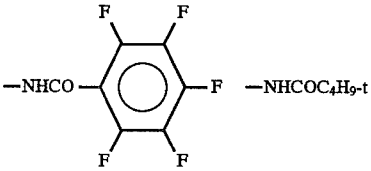

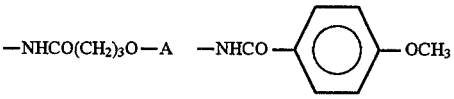

-continued

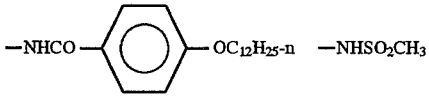

$-NHSO_2CF_3$ $-NHSO_2C_4H_9$-n

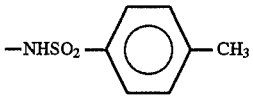

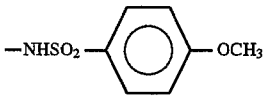

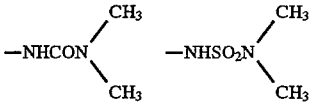

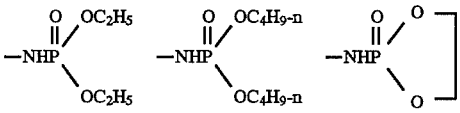

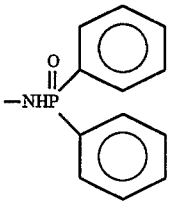

$-NHCOOCH_3$

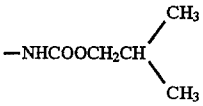

$-NHCOOC_4H_9$-n $-NHCOOCH_2CH_2OCH_3$

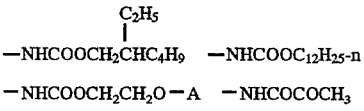

$-NHCOOC_{12}H_{25}$-n $-NHCOOCH_2CH_2O-A$ $-NHCOCOCH_3$

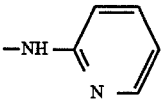

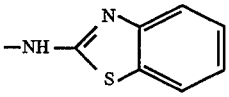

Examples of X:

$-OC_2H_5$ $-OCH_2CH_2OH$ $-OCH_2CH_2SO_2CH_3$ $-O(CH_2CH_2O)_2H$ $-OCH_2COOH$ $-O(CH_2)_3COOH$ $-OCH_2COOC_2H_5$ $-OCH_2CONHCH_2CH_2OCH_3$ $-OCH_2CH_2SCH_2COOH$ $-OCH_2CH_2SCH(C_{12}H_{25}\text{-n})COOH$ $-OCH_2CH_2OCH_3$ $-OCH_2CH_2NHSO_2CH_3$

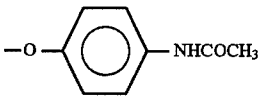

-continued

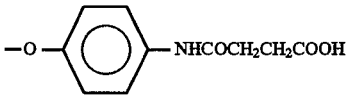

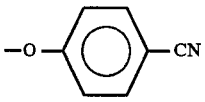

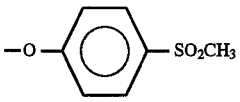

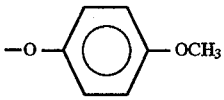

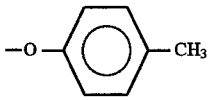

$-SCH_2COOH$ $-SCH_2CH_2COOH$ $-SCH(CH_3)COOH$ $-SCH_2COOC_2H_5$ $-SCH_2CH_2OH$ $-SCH_2CH(OH)CH_2OH$

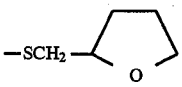

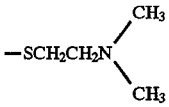

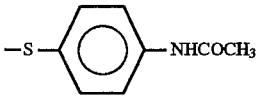

-continued

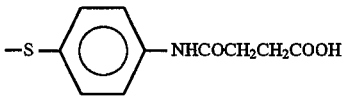

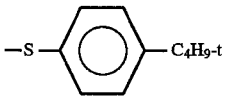

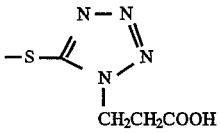

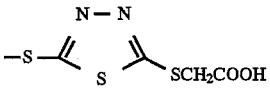

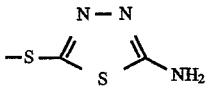

Examples of Cyan Couplers of Formula (II):

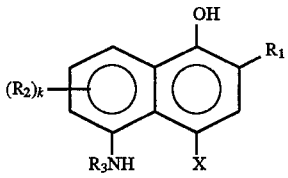

k = 0

| No. | $R_1$ | $R_3$ | X |
|---|---|---|---|
| IIC-1 | $-CONH(CH_2)_3O-A$ | $CH_3CO-$ | H |
| IIC-2 | $-CONH(CH_2)_3O-A$ | $CF_3CO-$ | H |
| IIC-3 | $-CONH(CH_2)_3O-A$ | $CH_3SO_2-$ | H |
| IIC-4 | $-CONH(CH_2)_3O-A$ | $C_2H_5OCO-$ | H |
| IIC-5 | $-CONH(CH_2)_4O-A$ | $t\text{-}C_4H_9CO-$ | H |
| IIC-6 | $-CONH(CH_2)_3O-C_{12}H_{25}\text{-}n$ | $C_2H_5OCO-$ | H |
| IIC-7 | $-CONH(CH_2)_3O-C_{12}H_{25}\text{-}n$ | $i\text{-}C_4H_9OCO-$ | H |
| IIC-8 | $-CONH(CH_2)_3OC_{10}H_{21}\text{-}n$ | $i\text{-}C_4H_9OCO-$ | H |
| IIC-9 | $-CONH(CH_2)_3OC_{10}H_{21}\text{-}n$ | $n\text{-}C_4H_9CH(C_2H_5)CH_2OCO-$ | H |
| IIC-10 | $-CONH(CH_2)_3O-A$ | $i\text{-}C_4H_9OCO-$ | H |
| IIC-11 | 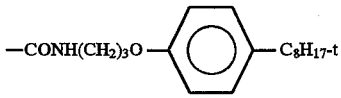 | $i\text{-}C_4H_9OCO-$ | H |
| IIC-12 | $-CONHCH_2CH(CH_3)CH_2OC_{12}H_{25}\text{-}n$ | $i\text{-}C_4H_9OCO-$ | H |
| IIC-13 | $-CONH(CH_2)_3OCH_2CH(C_2H_5)C_4H_9$ | $n\text{-}C_8H_{17}OCO-$ | H |

-continued

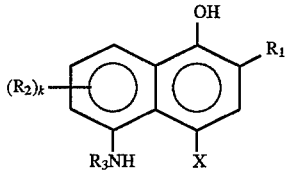

k = 0

| No. | $R_1$ | $R_3$ | X |
|---|---|---|---|
| IIC-14 | 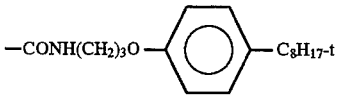 | $n\text{-}C_4H_9SO_2-$ | H |
| IIC-15 | $-CONH(CH_2)_3OC_{12}H_{25}\text{-}n$ | $(C_2H_5O)_2\overset{O}{\overset{\|\|}{P}}-$ | H |
| IIC-16 | $-CONH(CH_2)_3O-A$ | 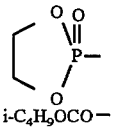 | H |
| IIC-17 | $-CONHCH_2CH_2OC_{12}H_{25}\text{-}n$ | $i\text{-}C_4H_9OCO-$ | H |
| IIC-18 | $-CON(CH_3)(C_{16}H_{33}\text{-}n)$ | $C_2H_5OCO-$ | H |
| IIC-19 | $-CONHCH_2CH_2OCOC_{11}H_{23}\text{-}n$ | $i\text{-}C_4H_9OCO-$ | H |
| IIC-20 | $-CONHC_{12}H_{25}\text{-}n$ | $n\text{-}C_4H_9CH(CH_3)CH_2OCO-$ | H |
| IIC-21 | $-SO_2NH(CH_2)_3OC_{12}H_{25}\text{-}n$ | $i\text{-}C_4H_9OCO-$ | H |
| IIC-22 | $-CON(CH_3)(C_{16}H_{33}\text{-}n)$ | $C_2H_5OCO-$ | H |
| IIC-23 | $-CONHCH_2CH(C_6H_{13}\text{-}n)C_8H_{17}\text{-}n$ | $i\text{-}C_4H_9OCO-$ | H |
| IIC-24 | $-CONH(CH_3)_3OC_{12}H_{25}\text{-}n$ | 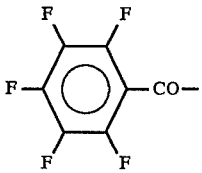 | H |
| IIC-25 | 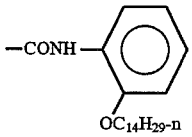 | $CH_3SO_2-$ | H |
| IIC-26 | 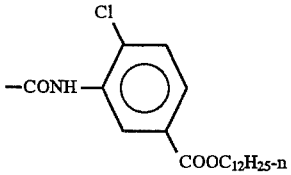 | 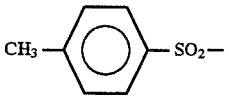 | H |
| IIC-27 | $-CONH(CH_2)_3OC_{12}H_{25}\text{-}n$ | $i\text{-}C_4H_9OCO-$ | Cl |
| IIC-28 | $-CONH(CH_2)_3OC_{12}H_{25}\text{-}n$ | $n\text{-}C_4H_9OCO-$ | Cl |
| IIC-29 | $-CONH(CH_2)_3OC_{14}H_{29}\text{-}n$ | $t\text{-}C_4H_9CO-$ | Cl |
| IIC-30 | $-CONH(CH_2)_3OC_{12}H_{25}\text{-}n$ | $i\text{-}C_4H_9OCO-$ | $-OCH_2CH_2OH$ |
| IIC-32 | $-CONH(CH_2)_3OC_{12}H_{25}\text{-}n$ | $i\text{-}C_4H_9OCO-$ | $-O(CH_2CH_2O)_2H$ |

-continued

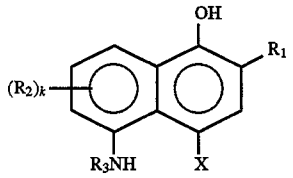

k = 0

| No. | $R_1$ | $R_3$ | X |
|---|---|---|---|
| IIC-33 | $-CONH(CH_2)_3OC_{12}H_{25}$-n | i-$C_4H_9OCO-$ | $-OCH_2CH_2OCH_3$ |
| IIC-34 | $-CONH(CH_2)_3OC_{12}H_{25}$-n | i-$C_4H_9OCO-$ | $-OCH_2CH_2SCH_2COOH$ |
| IIC-35 | $-CONHC_4H_9$-n | i-$C_4H_9OCO-$ | $-OCH_2CH_2SCH(COOH)C_{12}H_{25}$-n |
| IIC-36 | $-CONHCH_2CH(CH_3)CH_2OC_{12}H_{25}$-n | i-$C_4H_9OCO-$ | $-O(CH_2)_3COOH$ |
| IIC-37 | $-CONH(CH_2)_4O-A$ | i-$C_4H_9OCO-$ | 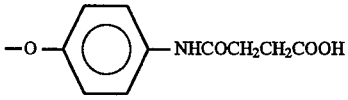 |
| IIC-38 | $-CONH(CH_2)_3O-A$ | i-$C_4H_9OCO-$ | 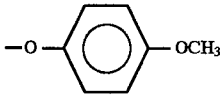 |
| IIC-39 | 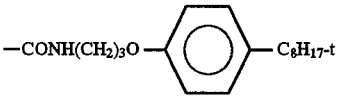 | i-$C_4H_9OCO-$ | $-SCH_2COOH$ |
| IIC-40 | $-CONH(CH_2)_3OC_{12}H_{25}$-n | i-$C_4H_9OCO-$ | $-SCH_2CH_2COOH$ |
| IIC-41 | $-CONH(CH_2)_3OC_{12}H_{25}$-n | i-$C_4H_9OCO-$ | $-SCH_2CH_2OH$ |
| IIC-42 | $-CONH(CH_2)_4O-A$ | $CH_3SO_2-$ | 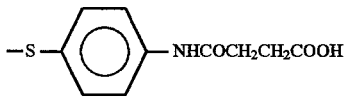 |
| IIC-43 | $-SO_2NH(CH_2)_3O-A$ | n-$C_4H_9SO_2-$ | $-OCH_2CH_2OH$ |
| IIC-44 | $-CONHCH_2CH(CH_3)CH_2OC_{12}H_{25}$-n | i-$C_4H_9OCO-$ | $-OCH_2CH_2OH$ |
| IIC-45 | $-CONH(CH_2CH_2O)C_{12}H_{25}$-n | $(C_2H_5O)_2P(=O)-$ | $-OCH_2CH_2OCH_3$ |
| IIC-46 | $-CONH(CH_2)_4O-A$ | t-$C_4H_9CO-$ | $-OCH_2COOC_2H_5$ |
| IIC-47 | 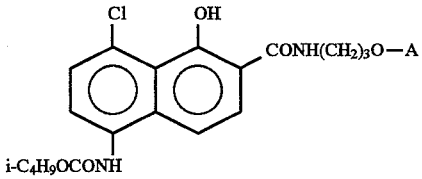 | | |
| IIC-48 | 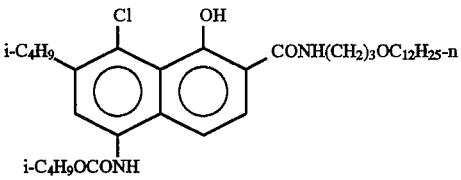 | | |

-continued
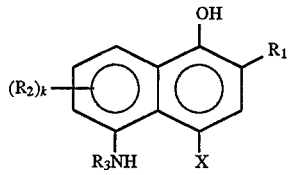
k = 0
| No. | $R_1$ | $R_3$ | X |
|---|---|---|---|
| IIC-49 | 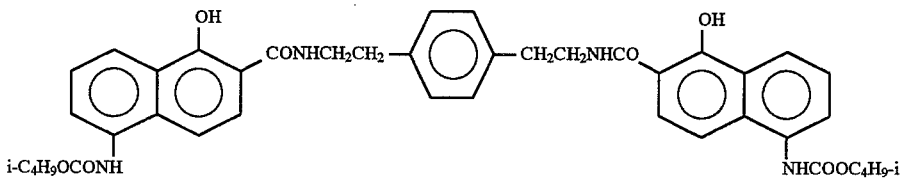 | | |
| IIC-50 | 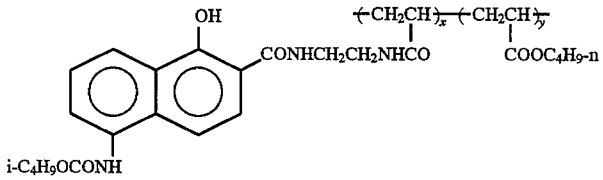 | | |
| IIC-51 | 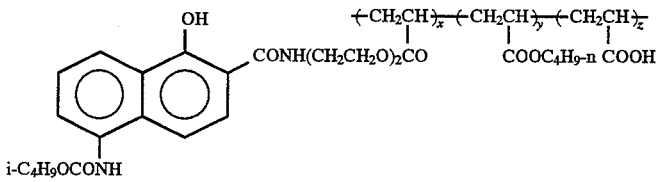 | | |
| IIC-52 | 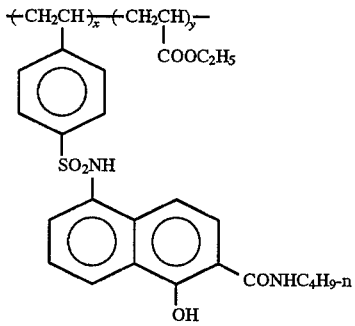 | | |
| IIC-53 | 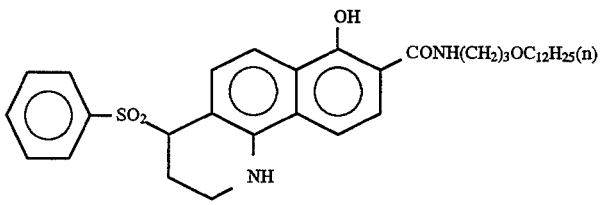 | | |
x:y = 60:40 (by weight)
number average molecular weight: about 60,000
x:y:z = 50:40:10
number average molecular weight: about 50,000
x:y = 70:30
number average molecular weight: about 50,000

-continued

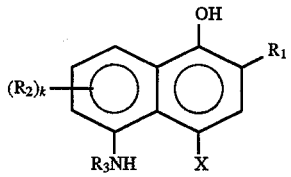

k = 0

| No. | $R_1$ | $R_3$ | X |
|---|---|---|---|
| IIC-54 | 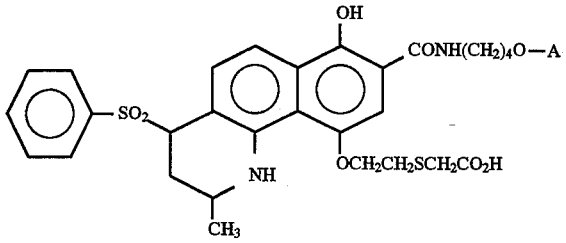 | | |
| IIC-55 | 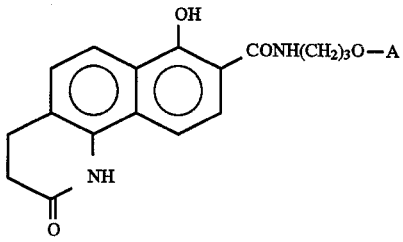 | | |

In $R_1$, $R_2$, $R_3NH$—, and cyan couplers (IIC-1) to (IIC-55) mentioned above;

A is

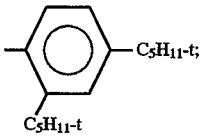

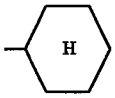

is cyclohexyl;

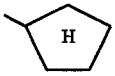

is cyclopentyl; and

—$C_8H_{17}$-t is

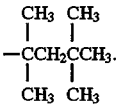

Other examples of cyan couplers of formula (II) and/or methods of producing them are described in U.S. Pat. No. 4,690,889, JP-A-60-237448, JP-A-61-153640, JP-A-61-145557, JP-A-63-208042 and JP-A-64-31159, and German Patent 3823049A.

It is preferred to use a small amount of a high boiling point organic solvent for dispersion of cyan couplers of formula (II), as described in JP-A-62-269958, for improving the sharpness and the desilverability of photographic materials of containing them.

Specifically, the ratio of a high boiling point organic solvent used to the cyan coupler of formula (II) is preferably 0.3 or less, more preferably 0.1 or less, by weight.

Combinations of two or more kinds of cyan couplers of formula (II) are preferred for use in the present invention. Where the photographic material to which cyan couplers of formula (II) are added has two or more layers each having the same color sensitivity but having a different sensitivity degree, it is preferred that a 2-equivalent cyan coupler be added to the highermost sensitivity layer while a 4-equivalent cyan coupler be added to the lowermost sensitivity layer. It is preferred that one or both of them be added to any other layers of the same color sensitivity.

Phenol cyan couplers of formula (III) for use in the present invention are described in detail hereunder.

In formula (III), $R^1$ is an optionally substituted linear, branched or cyclic alkyl group having a total carbon number of from 1 to 36, preferably from 4 to 30, or an optionally substituted aryl group having a total carbon number of from 6 to 36, preferably from 12 to 30, or a heterocyclic group having a total carbon number of from 2 to 36, preferably from 12 to 30. The heterocyclic group means an optionally condensed, 5-membered to 7-membered heterocyclic group having at least one hetero atom selected from N, O, S, P, Se and Te in the hetero ring. Examples of $R^1$ include 2-furyl, 2-thienyl, 2-pyridyl, 4-pyridyl, 4-pyrimidyl, 2-imidazolyl and 4-quinolyl groups. Examples of substituents for $R^1$ include are a halogen atom, a cyano group, a nitro group, —COOM, —$SO_3M$ (wherein M represents H, an alkali metal atom such as Li, Na and K, or $NH_4$), a sulfo group, an alkyl group, an aryl group, a heterocyclic group, an alkoxy group, an aryloxy group, an alkylthio group, an arylthio group, an alkylsulfonyl group, an arylsulfonyl group, an alkoxycarbonyl group, an acyl group, a carbonamido group and a sulfonamido group (preferably RCONH— and $RSO_2NH$— wherein R represents an alkyl group having from 1 to 30 carbon atoms or an aryl group having from 6 to 30 carbon atoms), a carbamoyl group, a sulfamoyl group, an imido group (preferably a closed ring imido), an amino group, a ureido group, an alkoxycarbonylamino group, a sulfamoylamino group, an alkylsulfonyloxy group, an arylsulfonyloxy group, a phosphono group, an acyloxy group, an alkylsulfinyl group, an arylsulfinyl group, an alkoxycarbonyloxy group, a carbamoyloxy group, and a heterocyclic ring thio group. These substituent groups are hereinafter collectively referred to as "Substituent group A". Of the substituent groups in Substituent group A, an aryl group, a heterocyclic group, an aryloxy group, an alkylsulfonyl group, an arylsulfonyl group and an imido group are preferred substituents for $R^1$. These substituents may be further substituted with at least one of the substituents for $R^1$.

In formula (III), $R^2$ is an aryl group having a total carbon number of from 6 to 36, preferably from 6 to 15. $R^2$ may be substituted by substituent(s) selected from the preceding Substituent group A or $R^2$ may also be in the form of a condensed ring. Preferred substituents for $R^2$ include a halogen atom (e.g., F, Cl, Br, I), a cyano group, a nitro group, an acyl group (e.g., acetyl, benzoyl), an alkyl group (e.g., methyl, t-butyl, trifluoromethyl, trichloromethyl), an alkoxy group (e.g., methoxy, ethoxy, butoxy, trifluoromethoxy), an alkylsulfonyl group (e.g., methylsulfonyl, propylsulfonyl, butylsulfonyl, benzylsulfonyl), an arylsulfonyl group (e.g., phenylsulfonyl, p-tolylsulfonyl, p-chlorophenylsulfonyl), an alkoxycarbonyl group (e.g., methoxycarbonyl, butoxycarbonyl), a sulfonamido group (e.g., methylsulfonamido, trifluoromethylsulfonamido, tolylsulfonamido), a carbamoyl group (e.g., N,N-dimethylcarbamoyl, N-phenylcarbamoyl), and a sulfamoyl group (e.g., N,N-diethylsulfamoyl, N-phenylsulfamoyl). $R^2$ is preferably a phenyl group having at least one substituent selected from a halogen atom, a cyano group, a sulfonamido group, an alkylsulfonyl group, an arylsulfonyl group and a trifluromethyl group. More preferably, $R^2$ is a 4-cyanophenyl group, a 4-cyano-3-halogenophenyl group, a 3-cyano-4-halogenophenyl group, a 4-alkylsulfonylphenyl group, a 4-alkylsulfonyl-3-halogenophenyl group, a 4-alkylsulfonyl-3-alkoxyphenyl group, a 3-alkoxy-4-alkylsulfonylphenyl group, a 3,4-dihalogenophenyl group, a 4-halogenophenyl group, a 3,4,5-trihalogenophenyl group, a 3,4-dicyanophenyl group, a 3-cyano-4,5-dihalogenophenyl group, a 4-trifluoromethylphenyl group or a 3-sulfonamidophenyl group. Especially preferably, $R^2$ is a 4-cyanophenyl group, a 3-cyano-4-halogenophenyl group, a 4-cyano-3-halogenophenyl group, a 3,4-dicyanophenyl group or a 4-alkylsulfonylphenyl group.

In formula (III), Z is a hydrogen atom or a leaving group which may split off in a coupling reaction with an oxidation product of a developing agent such as an aromatic primary amine developing agent. Examples of the leaving group of Z include a halogen atom, —$SO_3M$(wherein M represents H, an alkali metal atom such as Li, Na and K, or $NH_4$), an alkoxy group having a total carbon number of from 1 to 36, preferably from 1 to 24, an aryloxy group having a total carbon number of from 6 to 36, preferably from 6 to 24, an acyloxy group having a total carbon number of from 2 to 36, preferably from 2 to 24, an alkylsulfonyl group having a total carbon number of from 1 to 36, preferably from 1 to 24, an arylsulfonyl group having a total carbon number of from 6 to 36, preferably from 6 to 24, an alkylthio group having a total carbon number of from 1 to 36, preferably from 2 to 24, an arylthio group having a total carbon number of from 6 to 36, preferably from 6 to 24, an imido group having a total carbon number of from 4 to 36, preferably 4 to 24, a carbamoyloxy group having a total carbon number of from 1 to 36, preferably from 1 to 24, and a heterocyclic group (having a total carbon number of from 1 to 36, preferably from 2 to 24) capable of bonding to the active coupling position of the coupler via the nitrogen atom of the group (e.g., pyrazolyl, imidazolyl, 1,2,4-triazol-1-yl, tetrazolyl). The alkoxy group and the groups cited after it may optionally be substituted by one or more substituents selected from the preceding Substituent group A. Z is preferably a hydrogen atom, a halogen atom, an alkoxy group, an aryloxy group, an alkylthio group, an arylthio group or a heterocyclic ring thio group. Especially preferably, Z is a hydrogen atom, a chlorine atom, an alkoxy group or an aryloxy group.

Specific examples of $R^1$, $R^2$ and Z in formula (III) are mentioned below, which, however, are not limitative.

Examples of $R^1$:

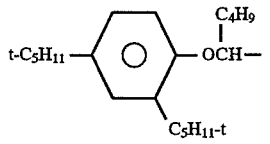

A

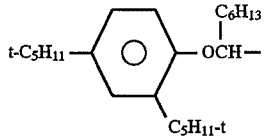

B

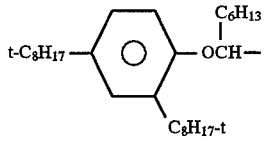

C

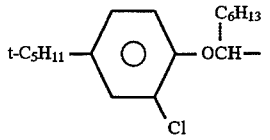

D

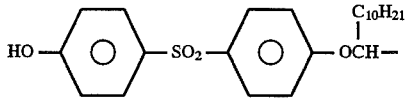

E

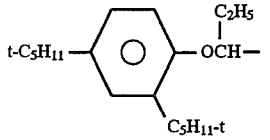

F

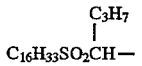

G

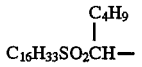

H

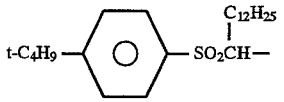

I

-continued
J
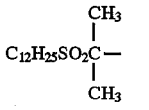
K
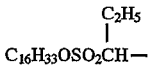
L
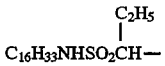
M
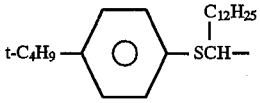
N
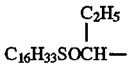
O
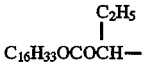
P
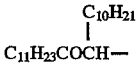
Q
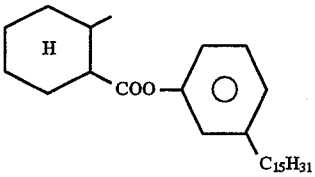
R
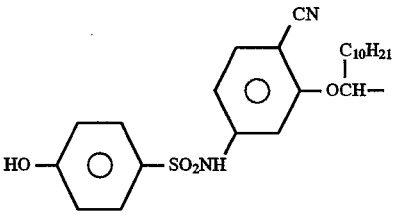
S
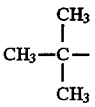
T
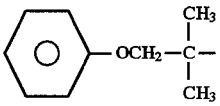
U
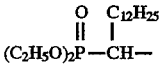
V
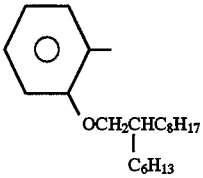
-continued
W
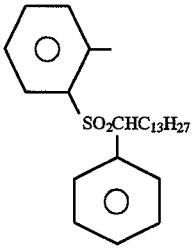
X
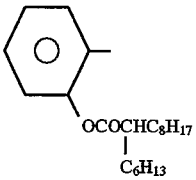
Y
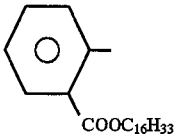
Z
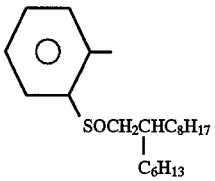
a
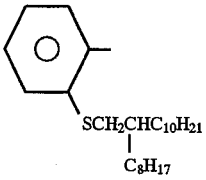
b
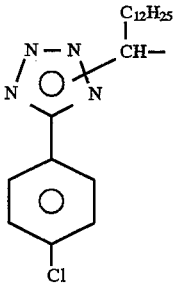
c
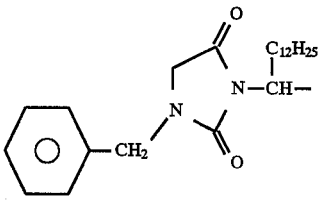
d
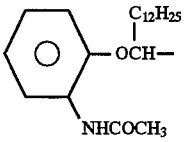

-continued
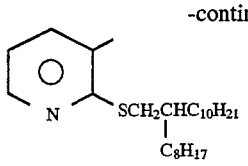
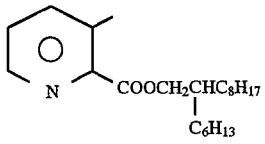
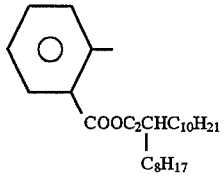
Examples of $R^2$:
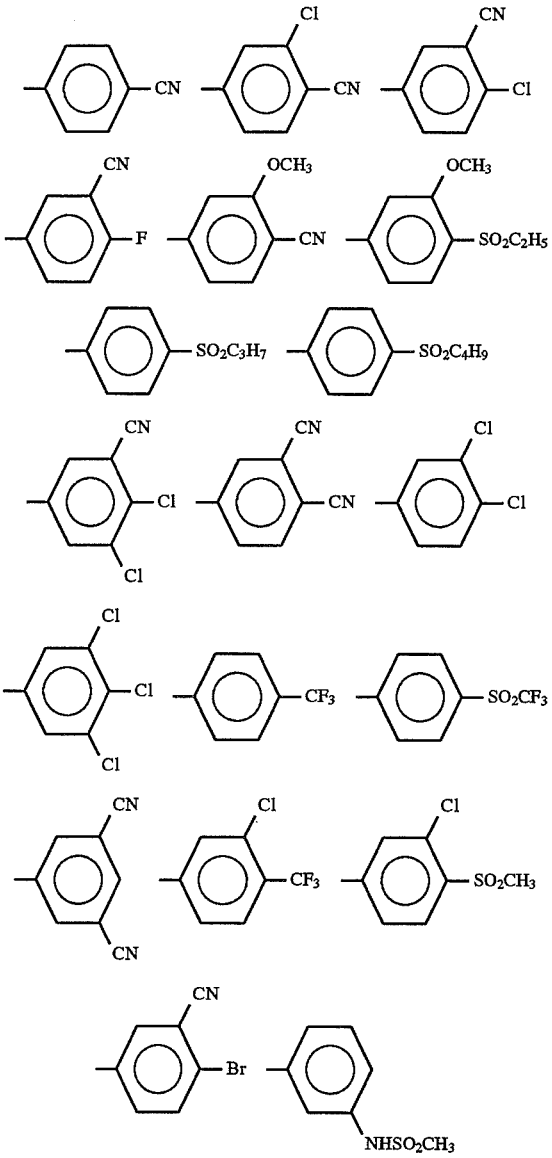
-continued
e
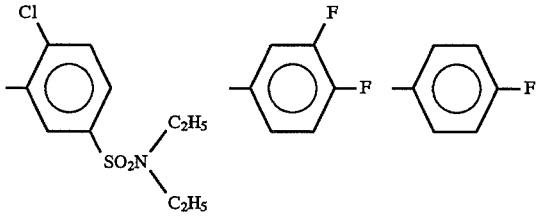
f
g
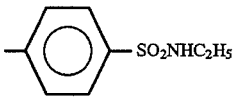
Examples of Z:
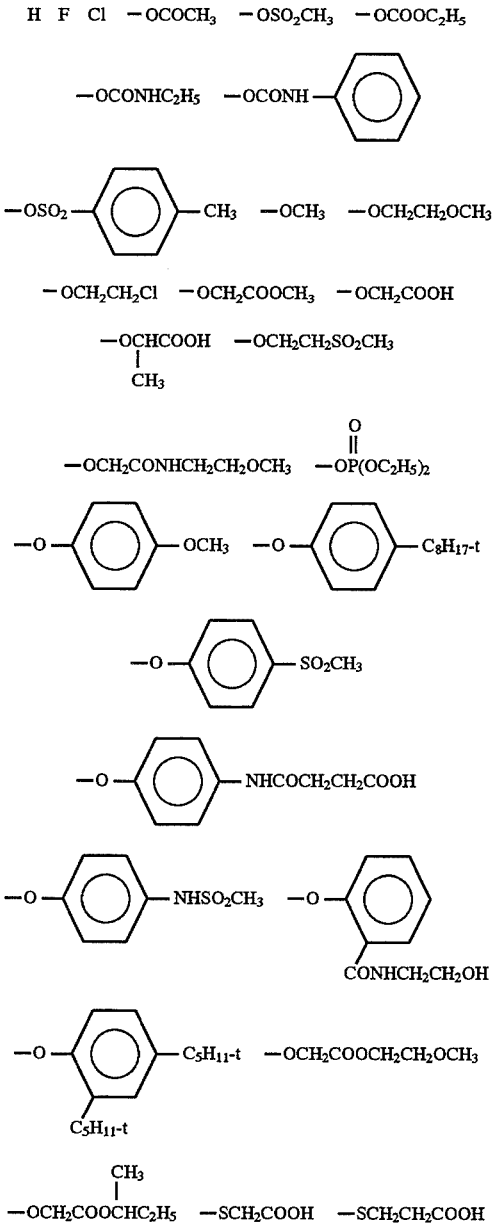

-continued
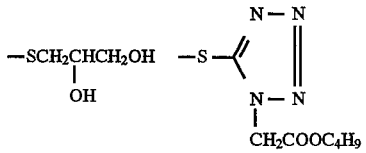
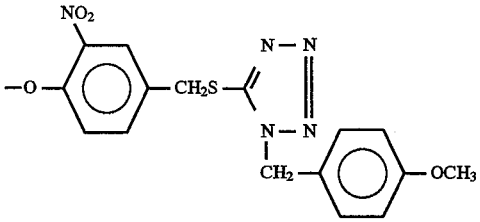
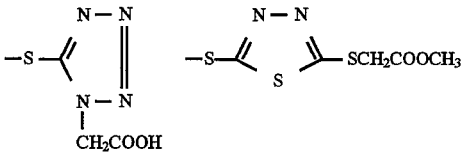
-continued
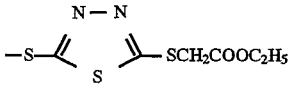
Specific examples of cyan couplers of formula (III) are mentioned below, in which A through Z and a through g are those mentioned above.
| No. | $R^1$ | $R^2$ | Z |
|---|---|---|---|
| IIIC-1 | A | 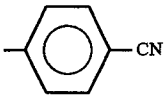 | H |
| IIIC-2 | B | 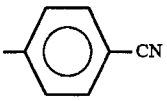 | H |
| IIIC-3 | F | 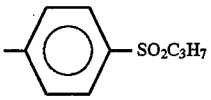 | H |
| IIIC-4 | F | 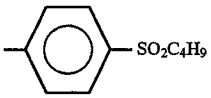 | H |
| IIIC-5 | C | 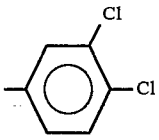 | H |
| IIIC-6 | A | 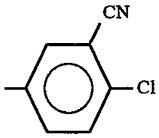 | H |
| IIIC-7 | A | 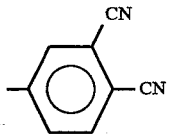 | H |

-continued
| No. | $R^1$ | $R^2$ | Z |
|---|---|---|---|
| IIIC-8 | A | 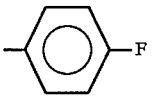 | H |
| IIIC-9 | A | 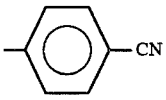 | 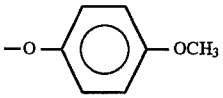 |
| IIIC-10 | B | 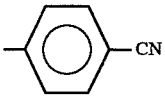 | 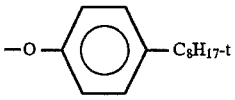 |
| IIIC-11 | A | 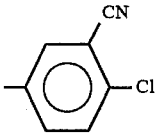 | $-OCH_2COOCH_3$ |
| IIIC-12 | A | 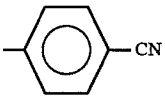 | Cl |
| IIIC-13 | A | 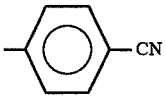 | $-SCH_2COOH$ |
| IIIC-14 | G | 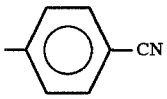 | H |
| IIIC-15 | H | 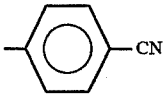 | Cl |
| IIIC-16 | K | 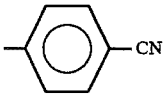 | 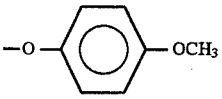 |
| IIIC-17 | L | 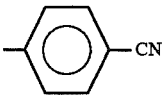 | 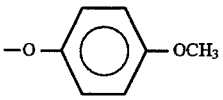 |
| IIIC-18 | O | 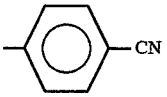 | 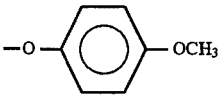 |
| IIIC-19 | P | 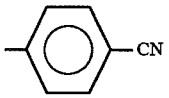 | 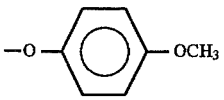 |
| IIIC-20 | S | 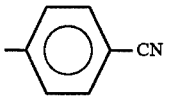 | 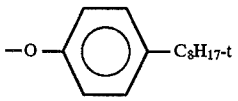 |
| IIIC-21 | E | 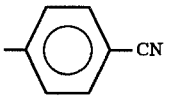 | 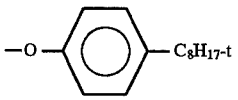 |

-continued
| No. | $R^1$ | $R^2$ | Z |
|---|---|---|---|
| IIIC-22 | V | 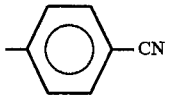 | H |
| IIIC-23 | W | 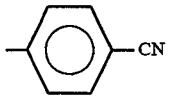 | H |
| IIIC-24 | X | 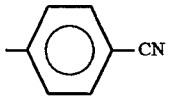 | H |
| IIIC-25 | e | 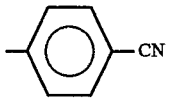 | H |
| IIIC-26 | Y | 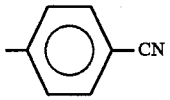 | 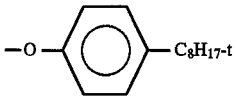 |
| IIIC-27 | g | 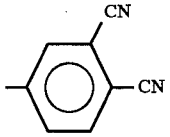 | Cl |
| IIIC-28 | b | 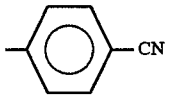 | 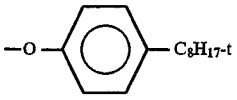 |
| IIIC-29 | G | 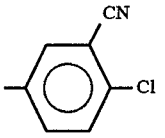 | H |
| IIIC-30 | J | 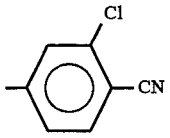 | H |
| IIIC-31 | V | 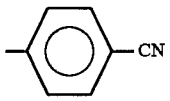 | Cl |
| IIIC-32 | X | 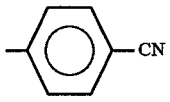 | Cl |
| IIIC-33 | b | 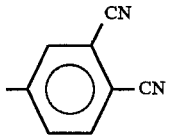 | 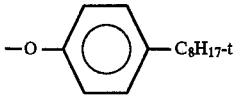 |
| IIIC-34 | g | 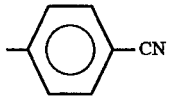 | Cl |

-continued

| No. | $R^1$ | $R^2$ | Z |
|---|---|---|---|
| IIIC-35 | c | 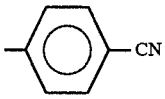 | H |
| IIIC-36 | f | 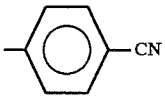 | Cl |
| IIIC-37 | e | 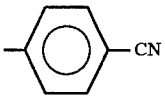 | Cl |
| IIIC-38 | d | 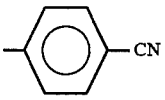 | Cl |
| IIIC-39 | T | 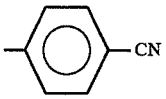 | 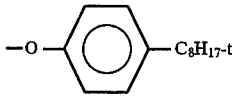 |
| IIIC-40 | U | 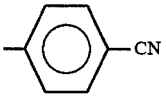 | Cl |
| IIIC-41 | W | 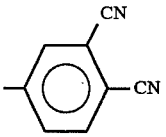 | H |
| IIIC-42 | e | 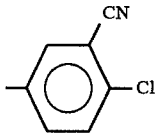 | H |

Cyan couplers of formula (III) may be produced in accordance with known methods, for example, those described in JP-A-56-65134, JP-A-61-2757, JP-A-63-159848, JP-A-63-161450, JP-A-63-161451, JP-A-1-254956 and U.S. Pat. No. 4,923,791.

In the present invention the coupler of formula (I) and the coupler(s) of formula (II) and/or (III) may be incorporated into either light-sensitive layer or non-light-sensitive layer and may be incorporated into the same layer or separately into different layers. It is preferred that these couplers are incorporated into two or more of light-sensitive layers having sansitivity to the same color. It is also preferred that all of these couplers are incorporated into the same light sensitive layer. Generally, the couplers are incorporated into a red sensitive layer(s).

In the present invention, a cyan coupler of formula (I) is used in combination with a cyan coupler of formula (II) and/or (III). The preferred proportion of the amount of the cyan coupler of formula (I) to the total amount of the cyan couplers of formulas (II) and (III) in the photographic material is 99.9/0.1 to 0.1/99.9 by mol. Preferably, the proportion of the amount of the cyan coupler of formula (I) in the photographic material is 30 mol % or more, more preferably 50 mol % or more, and the uppermost limit of the proportion is preferably 99.9 mol % based on the total amount of the couplers represented by formulae (I), (II) and (III).

The total amount of the couplers of formula (I), (II) and (III) to be incorporated in the photographic material of the present invention is, when the couplers are incorporated in a light-sensitive layer of the material, generally from $1\times10^{-3}$ to 2 mols, preferably from $1\times10^{-2}$ to 1 mol, more preferably from $2\times10^{-2}$ to 0.5 mol, per mol of silver halide in the layer. Where the couplers are incorporated into at least one of non-light-sensitive layers (e.g., antihalation layer, interlayer, yellow filter layer, protective layer), the total amount of the couplers in the photographic material is generally from $2.0\times10^{-4}$ to 1.0 g/m$^2$, preferably from $5.0\times10^{-4}$ to $5.0\times10^{-1}$ g/m$^2$, most preferably from $1.0\times10^{-3}$ to $2\times10^{-1}$ g/m$^2$.

The total amount of the couplers of formula (I) and formula (II) and (III) to be incorporated in the photographic material of the present invention is generally within the range of from $1\times10^{-3}$ to 3 g/m$^2$, preferably from $5\times10^{-3}$ to 1 g/m$^2$, more preferably from $1\times10^{-2}$ to $5\times10^{-1}$ g/m$^2$.

If desired for example, if it is desired to improve image quality, cyan couplers, for example, a cyan coupler described hereinafter, a development inhibitor-releasing cyan coupler, a colored cyan coupler, a bleach accelerator-releasing cyan coupler may be further used in the photographic material of the present invention. The total moles of such couplers preferably does not exceed the total moles of the coupler represented by formulas (I), (II) and (III) when the latter couplers are present in the same layer.

The couplers of formulas (I), (II) and (III) may be incorporated into the photographic material of the present invention using any known dispersion method. Preferably, a dispersion of the couplers formed by an oil-in-water dispersion method which will be mentioned hereinafter is added to the material.

By using a combination of a cyan coupler of formula (I) and a coupler of formula (II) and/or (III), the high coloring properties of the cyan coupler of formula (I) and the capacity thereof of forming a fast color image may be retained. Further, the use of such a combination of couplers improves the high coloring and color-fast image forming properties of the formula (I) coupler, so that the fluctuation of the photographic properties of the photographic material to variations in color development conditions is effectively reduced.

The structure of the photographic material of the present invention is not specifically limited, provided that the material has at least one blue-sensitive silver halide emulsion layer, at least one green-sensitive silver halide emulsion layer and at least one red-sensitive silver halide emulsion layer on a support. In the material, the number of silver halide emulsion layers and non-light-sensitive layers as well as the order of the layers on the support is not specifically limited. As one typical example, there is mentioned a silver halide color photographic material having at least one light-sensitive layer unit composed of plural silver halide emulsion layers each having substantially the same color-sensitivity but having a different sensitivity degree. The light-sensitive layer units each having a color-sensitivity to any one of blue light, green light and red light. In such a multi-layer silver halide color photographic material, in general, the order of the light-sensitive layer units to be on the support comprises a red-sensitive layer unit, a green-sensitive layer unit and a blue-sensitive layer unit as formed on the support in this order. As the case may be, however, the order may be opposite to the above-mentioned one, in accordance with the object of the photographic material. As still another embodiment, a different color-sensitive layer may be sandwiched between the same two color-sensitive layers.

Various non-light-sensitive layers such as interlayer may be provided between the above-mentioned silver halide light-sensitive layers, or on or below the uppermost layer or lowermost layers.

Such an interlayer may contain various couplers and DIR compounds as described in JP-A-61-43748, JP-A-59-113438, JP-A-59-113440, JP-A-61-20037 and JP-A-61-20038, and it may also contain conventional color mixing preventing agents.

With respect to the constitution of the plural silver halide emulsion layers constituting the respective light-sensitive layer units, a two-layered constitution composed of a high-sensitivity emulsion layer and a low-sensitivity emulsion layer as described in German Patent 1,121,470 and British Patent 923,045 is preferred. In general, it is preferred that the plural light-sensitive layers be arranged on the support in such a way that the sensitivity degree of the layers gradually decreases in the direction of the support. In one such embodiment, a non-light-sensitive layer may be provided between the plural silver halide emulsion layers. As another embodiment, a low-sensitivity emulsion layer is formed far from the support and a high-sensitivity emulsion layer is formed near to the support, as described in JP-A-57-112751, JP-A-62-200350, JP-A-62-206541, and JP-A-62-206543.

As specific examples of the layer constitution on the support, there are mentioned an order of low-sensitivity blue-sensitive layer (BL)/high-sensitivity blue-sensitive layer (BH)/high-sensitivity green-sensitive layer (GH)/low-sensitivity green-sensitive layer (GL)/ high-sensitivity red-sensitive layer (RH)/low-sensitivity red-sensitive layer (RL) beginning with the layer farthest from the support; and an order of BH/BL/GL/GH/RH/RL; and an order of BH/BL/GH/GL/RL/RH.

As other examples, there are mentioned an order of blue-sensitive layer/GH/RH/GL/RL, beginning with the layer farthest from the support, as described in JP-B-55-34932; and an order of blue-sensitive layer/GL/RL/GH/RH, beginning with the layer farthest from the support, as described in JP-A-56-25738 and JP-A-62-63936.

As a further example, there is mentioned a three-layer unit constitution as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a lower sensitivity than the intermediate layer. That is, in the layer constitution of this type, the sensitivity degree of each emulsion layer is gradually lowered in the direction of the support. Even in a three-layer constitution of this type, each of the same color-sensitivity layers may be composed of three layers of middle-sensitivity emulsion layer/high-sensitivity emulsion layer/low-sensitivity emulsion layer as formed in this order, beginning with layer farthest from the support, as described in JP-A-59-202464.

As still other examples of the layer constitution of the photographic material of the present invention, there are mentioned an order of high-sensitivity emulsion layer/low-sensitivity emulsion layer/middle-sensitivity emulsion layer, and an order of low-sensitivity emulsion layer/middle-sensitivity emulsion layer/high-sensitivity emulsion layer. Where the photographic material of the invention has four or more layers, the layer constitution thereof may be varied in accordance with the manner mentioned above.

In order to improve the color reproducibility, it is desired to provide a donor layer (CL) which has an interlayer effect and which has a different color sensitivity distribution from that of the essential light-sensitive layers of BL, GL and RL, adjacent to or near to the essential light-sensitive layers, in the manner as described in U.S. Pat. Nos. 4,663,271, 4,705,744 and 4,707,436 and JP-A 62-160448 and 63-89850.

As mentioned above, various layer constitutions and arrangements may be selected in accordance with the objects of the photographic material of the invention.

The preferred silver halides to be incorporated in the photographic emulsion layers constituting the photographic material of the present invention are silver iodobromide, silver iodochloride or silver iodochlorobromide having a silver iodide content of about 30 mol % or less Especially preferred is a silver iodobromide or silver iodochlorobromide having a silver iodide content of from about 2 mol % to about 10 mol %.

The silver halide grains to be used in the photographic emulsion constituting the photographic material of the present invention may be regular crystalline grains such as cubic, octahedral or tetradecahedral grains, or irregular crystalline grains such as spherical or tabular grains, or irregular crystalline grains having a crystal defect such as a twin plane, or composite crystalline grains composed of the above-mentioned regular and irregular crystalline forms.

Regarding the grain size of the silver halide grains, the grains may be fine grains having a small grain size of about 0.2 microns or less or they may be large grains having a large grain size of up to about 10 microns, measured as the diameter of the projected area. The emulsion of the grains may be either a polydispersed emulsion or a monodispersed emulsion.

The silver halide photographic emulsions to be used in the present invention may be prepared by various methods, for example, those described in Research Disclosure (RD) No. 17643 (December, 1978), pages 22 to 23 (I. Emulsion Preparation and Types); RD No. 18716 (November, 1979), pages 648; RD No. 307105 (November 1989), pages 863 to 865; P. Glafkides, *Chimie et Physique Photographique* (published by Paul Montel, 1967); G. F. Duffin, *Photographic Emulsion Chemistry* (published by Focal Press, 1966); and V. L. Zelikman et al, *Making and Coating Photographic Emulsion* (published by Focal Press, 1964).

Monodispersed emulsions as described in U.S. Pat. Nos. 3,574,628 and 3,655,394 and British Patent 1,413,748 are also preferably used in the present invention.

Additionally, tabular grains having an aspect ratio of about 3 or more may also be used in the present invention. Such tabular grains may easily be prepared in accordance with various methods, for example, as described in Gutoff, *Photographic Science and Engineering*, Vol. 14, pages 248 to 257 (1970); and U.S. Pat. Nos. 4,434,226, 4,414,310, 4,430,048, 4,439,520 and British Patent 2,112,157.

Regarding the crystal structure of the silver halide grains constituting the emulsions of the invention, the crystal structure may have the same halogen composition throughout the whole grain, or they may have different halogen compositions between the inside part and the outside part of one grain, or they may have a layered structure. Further, the grains may have different halogen compositions as conjugated by an epitaxial bond, or they may have components other than silver halides, such as silver rhodanide or lead oxide, as conjugated with the silver halide. Additionally, a mixture of various grains of different crystalline forms may be employed in the present invention.

The above-mentioned emulsions for use in the present invention may be either surface latent image type emulsions which form latent images essentially on the surfaces of the grains or internal latent image type. emulsions which form latent images essentially in the insides of the grains, or they may also be surface/inside latent image type emulsions which form a latent image both on the surfaces of the grains and in the insides of the grains. The emulsions are necessarily negative emulsions. In the case of internal latent image type emulsions, the emulsions may be internal latent image type core/shell emulsions as described in JP-A-63-264740. A method of preparing such internal latent image type core/shell emulsions is described in JP-A-59-133542. The thickness of the shell of the emulsion grains of the core/shell type varies, depending upon the way of developing them, and is preferably from 3 to 40 nm, especially preferably from 5 to 20 nm.

The emulsions for use in the invention are generally physically ripened, chemically ripened and/or spectrally sensitized. Additives to be used in such a ripening or sensitizing step are described in Research Disclosure Nos. 17643, 18716 and 307105, and the related descriptions in these references are shown in the table mentioned below.

In the photographic material of the present invention, two or more emulsions which differ from one another in at least one characteristic of the light-sensitive silver halide grains constituting the emulsions, such as the grain size, the grain size distribution, the halogen composition, the shape and the sensitivity of the grains, can be incorporated into one and the same layer.

Surface-fogged silver halide grains as described in U.S. Pat. No. 4,082,498; inside-fogged silver halide grains as described in U.S. Pat. No. 4,626,498 and JP-A-59-214852; as well as colloidal silver may preferably be incorporated into light-sensitive silver halide emulsion layers and/or substantially non-light-sensitive hydrophilic colloid layers constituting the photographic material of the present invention. Inside-fogged or surface-fogged silver halide grains are grains that can be non-imagewise uniformly developed irrespective of the non-exposed area and the exposed area of the photographic material. A method of preparing such inside-fogged or surface-fogged silver halide grains is described in U.S. Pat. No. 4,626,498 and JP-A 59-214852.

The silver halide which forms the inside nucleus of an inside-fogged core/shell type silver halide grain may be either one having the same halogen composition or one having a different halogen composition of the core. The inside-fogged or surface-fogged silver halide may be any of silver chloride, silver chlorobromide, silver iodobromide or silver chloroiodobromide. The grain size of such a fogged silver halide grain is not specifically limited, and it is preferably from 0.01 to 0.75 μm, especially preferably from 0.05 to 0.6 μm, as a mean grain size. The shape of the grain is also not specifically limited, and it may be either a regular grain or an irregular grain. The emulsion containing such fogged grains may be either a monodispersed emulsion or a polydispersed emulsion. Preferred is a monodispersed emulsion, in which at least 95% by weight or by number of all the silver halide grains therein have a grain size falling within ±40% of the mean grain size.

The photographic material of the present invention preferably contains non-light-sensitive fine silver halide grains. Non-light-sensitive fine silver halide grains are meant to be fine silver halide grains which are not sensitive to the light as imparted to the photographic material for imagewise exposure thereof and are substantially not developed in the step of development of the exposed material. These fine grains are preferably not previously fogged.

The fine silver halide grains have a silver bromide content of from 0 to 100 mol % and, if desired, they may additionally contain silver chloride and/or silver iodide. Preferably, they contain silver iodide in an amount of from 0.5 to 10 mol %.

The fine silver halide grains preferably have a mean grain size (as a mean value of the circle-corresponding diameter of the projected area) of from 0.01 to 0.5 μm, more preferably from 0.02 to 0.2 μm.

The fine silver halide grains may be prepared by the same method as that of preparing ordinary light-sensitive silver halide grains. In preparing such grains, the surfaces of the fine silver halide grains do not need to be chemically sensitized and spectral sensitization of the grains is unnecessary. However, prior to addition of the fine grains to the coating composition, it is desirable to add a known stabilizer, such as a triazole compound, an azaindene compound, a benzothiazolium compound, a mercapto compound or a zinc compound, to the coating composition. The fine silver halide grain-containing layer may preferably contain colloidal silver.

The amount of silver as coated in the photographic material of the present invention is preferably 6.0 g/m$^2$ or less, most preferably 4.5 g/m$^2$ or less.

Various known photographic additives which may be used in preparing the photographic materials of the present invention are mentioned in the above-mentioned three Research Disclosures, and the related descriptions therein are shown in the following table.

| Kinds of Additives | RD 17643 | RD 18716 | RD 307105 |
|---|---|---|---|
| 1 Chemical Sensitizer | page 23 | page 648, right column | page 866 |
| 2 Sensitivity Enhancer | | page 648, right column | |
| 3 Spectral Sensitizer, Super Spectral Sensitizer | pages 23 to 24 | page 648, right column, to page 649, right column | pages 866 to 868 |
| 4 Brightening Agent | page 24 | page 647 | page 868 |
| 5 Anti-foggant, Stabilizer | pages 24 to 25 | page 649, right column | pages 868 to 870 |
| 6 Light Absorbent, Filter Dye, Ultraviolet Absorbent | pages 25 to 26 | page 649, right column to page 650, left column | page 873 |
| 7 Stain Inhibitor | page 25, right column | page 650, left column to right column | page 872 |
| 8 Color Image Stabilizer | page 25 | page 650, left column | page 872 |
| 9 Hardening Agent | page 26 | page 651, left column | pages 874 to 875 |
| 10 Binder | page 26 | page 651, left column | page 873 to 874 |
| 11 Plasticizer, Lubricant | page 27 | page 650, right column | page 876 |
| 12 Coating Aid, Surfactant | pages 26 to 27 | page 650, right column | pages 875 to 876 |
| 13 Antistatic Agent | page 27 | page 650, right column | pages 876 to 877 |
| 14 Mat Agent | | | pages 878 to 879 |

In order to prevent deterioration of the photographic properties of the photographic material of the invention by formaldehyde gas as imparted thereto, compounds capable of reacting with formaldehyde so as to solidify it, for example, those described in U.S. Pat. Nos. 4,411,987 and 4,435,503, are preferably incorporated into the material.

It is preferred to incorporate mercapto compounds described in U.S. Pat. Nos. 4,740,454 and 4,788,132 and JP-A-62-18539 and JP-A-1-283551 into the photographic materials of the present invention.

It is also preferred to incorporate, into the photographic materials of the present invention, compounds capable of releasing a fogging agent, a development accelerator, a silver halide solvent or a precursor thereof, irrespective of the amount of the developed silver as formed by development, which are described in JP-A-1-106052.

It is also preferred to incorporate, into the photographic materials of the present invention, dyes as dispersed by the method described in International Patent Laid-Open No. WO88/04794 and Japanese Patent Kohyo Koho Hei-1-5029, or dyes as described in European Patent 317,308A, U.S. Pat. No. 4,420,555 and JP-A-1-259358.

Various color couplers can be incorporated into the photographic material of the present invention, and examples of usable color couplers are described in patent publications as referred to in the above-mentioned RD No. 17643, VII-C to G, and RD No. 307105, VII-C to G.

As yellow couplers, for example, those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patents 249,473A and 447,969 are preferred.

As magenta couplers, 5-pyrazolone compounds and pyrazoloazole compounds are preferred. For instance, those described in U.S. Pat. Nos. 4,310,619, 4,351,897, European Patent 73,636, U.S. Pat. Nos. 3,061,432, 3,725,067, RD No. 24220 (June, 1984), JP-A-60-33552, RD No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, and WO(PCT)88/04795 are especially preferably used in the present invention.

As cyan couplers, known phenol couplers and naphthol couplers other than the couplers of formulae (I), (II) and (III) of the present invention may optionally be incorporated into the photographic material of the present invention. In addition, pyrazoloazole couplers as described in JP-A-64-553, JP-A-64-554, JP-A-64-555 and JP-A- 64-556 and imidazole couplers as described in U.S. Pat. No. 4,818,672 are also usable.

Polymerized dye-forming couplers may also be used, and typical examples of such couplers are described in U.S. Pat. Nos. 3,451,820, 4,080,211, 4,367,282, 4,409,320, 4,576,910, British Patent 2,102,137 and European Patent 341,188A.

Couplers capable of forming a colored dye having a suitable diffusibility may also be used, and those described in U.S. Pat. No. 4,366,237, British Patent 2,125,570, European Patent 96,570, and German Patent OLS No. 3,234,533 are preferred.

As colored couplers for correcting the unnecessary absorption of colored dyes, those described in RD No. 17643, VII-G, RD No. 307105, VII-G, U.S. Pat. No. 4,163,670, JP-B 57-39413, U.S. Pat. Nos. 4,004,929, 4,138,258, British Patent 1,146,368, JP-A-1-319744, JP-A-3-177836, JP-A-3-177837 and European Patent 423,727A are preferred. Additionally, couplers which correct the unnecessary absorption of a colored dyed by using a fluorescence dye to be released during coupling, as described in U.S. Pat. No. 4,774,181, as well as couplers having a dye precursor group capable of reacting with a developing agent to form a dye, as a leaving group, as described in U.S. Pat. No. 4,777,120, are also preferably used.

Couplers capable of releasing a photographically useful groups in a coupling reaction may also be used in the present invention. For instance, as DIR couplers capable of releasing a development inhibitor, those described in the patent publications as referred to in the above-mentioned RD No. 17643, Item VII-F, RD No. 307105, Item VII-F, as well as those described in JP-A-57-151944, JP-A-57-154234, JP-A-60-184248, JP-A-63-37346 and JP-A-63-37350 and U.S. Pat. Nos. 4,248,962 4,782,012 and European Patent 447,920A are preferred.

Couplers capable of releasing a bleaching accelerator, as described in RD Nos. 11449 and 24241 and JP-A-61-201247, are effective for shortening the time for the processing step with a processing solution having a bleaching capacity, and the effect is especially noticeable when they are added to a photographic material of the present invention which contains the above-mentioned tabular silver halide grains.

As couplers capable of imagewise releasing a nucleating agent or development accelerator during development, those described in British Patents 2,097,140 and 2,131,188, and JP-A-59-157638 and JP-A-59-170840 are preferred. In addition, compounds capable of releasing a fogging agent, a development accelerator or a silver halide solvent by a redox reaction with an oxidation product of a developing agent, as described in JP-A-60-107029, JP-A-60-252340, JP-A-1-44940 and JP-A-1-45687, are also preferably used.

Additionally, as examples of compounds which may be incorporated into the photographic materials of the present invention, there are further mentioned competing couplers as described in U.S. Pat. No. 4,130,427; polyvalent couplers as described in U.S. Pat. Nos. 4,283,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers capable of releasing a dye which recolors after being released from the coupler, as described in European Patents 173,302A and 313,308A; ligand-releasing couplers as described in U.S. Pat. No. 4,555,477; leuco dye-releasing couplers as described in JP-A-63-75747; and couplers capable of releasing a fluorescence dye as described in U.S. Pat. No. 4,774,181.

The above-mentioned couplers can be incorporated into the photographic materials of the present invention by various known dispersion methods.

For instance, an oil-in-water dispersion method may be employed for this purpose. Examples of high boiling point solvents usable in this method are described in U.S. Pat. No. 2,322,027. As examples of high boiling point organic solvents having a boiling point of 175° C. or higher at normal pressure, which may be used in an oil-in-water dispersion, there are mentioned phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2-ethylhexyl) sebacate, dioctyl azelate, glycerol tributylate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene). As an auxiliary solvent, organic solvents having a boiling point of approximately 30° C. or higher, preferably from 50° to 160° C. can be used. As examples of such auxiliary organic solvents, there are mentioned ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps of carrying out the dispersion method, the effect of the method and examples of latexes usable in the method for impregnation are described in U.S. Pat. No. 4,199,363 and German Patent (OLS) Nos. 2,541,274 and 2,541,230.

Also usable in the present invention is a solid dispersion method described in WO88/4794.

The color photographic material of the present invention preferably contains an antiseptic or fungicide. There are various kinds of antiseptics and fungicides, and suitable antiseptics and fungicides may be selected, for example, from phenethyl alcohol and the antiseptics and fungicides described in JP-A-63-257747, JP-A-62-272248 and JP-A-1-80941, such as 1,2-benzisothiazolin-3-one, n-butyl p-hydroxybenzoate, phenol, 4-chloro-3,5-dimethylphenol, 2-phenoxyethanol and 2-(4-thiazolyl)benzimidazole.

The present invention may be applied to various color photographic materials. For instance, there are mentioned, as typical examples, color negative films for general use or for movie use, color reversal films for slide use or for television use, as well as color papers, color positive films and color reversal papers.

Suitable supports which are usable in the present invention are described in, for example, the above-mentioned RD No. 17643, page 28, RD No. 18716, from page 647, right column to page 648, left column, and RD No. 307105, page 897.

It is desired that the total film thickness of all the hydrophilic colloid layers as provided on the side of the support having emulsion layers coated thereon is 28 microns or less, preferably 23 microns or less, more preferably 18 microns or less, especially preferably 16 microns or less, in the photographic material of the present invention. It is also desired that the photographic material of the invention have a film swelling rate (T ½) of 30 seconds or less, preferably 20 seconds or less. The film thickness as referred to herein is the film thickness as measured under the controlled conditions of a temperature of 25° C. and a relative humidity of 55% (for 2 days); and the film swelling rate as referred to herein may be measured by any-means known in this technical field. For instance, it may be measured by the use of a swellometer of the model as described in A. Green et al., *Photographic Science Engineering*, Vol. 19, No. 2, pages 124 to 129. The film swelling rate (T ½) is defined as follows: 90% of the maximum swollen thickness of the photographic material as processed in a color developer under the conditions of 30° C. and 3 minutes and 15 seconds is called the saturated swollen thickness. The time necessary for attaining half (½) of the saturated swollen thickness is defined to be the film swelling rate (T ½).

The film swelling rate (T ½) can be adjusted by adding a hardening agent to the gelatin used as a binder or by varying the conditions of storing the coated photographic material. Additionally, the photographic material of the present invention preferably has a swelling degree of from 150 to 400%. The swelling degree as referred to herein is calculated from the maximum swollen film thickness as obtained under the above-mentioned condition, on the basis of the formula:

(maximum swollen film thickness – original film thickness)/(original film thickness).

It is preferred that the photographic material of the present invention have a hydrophilic colloid layer (backing layer) having a total dry thickness of from 2 μm to 20 μm on the side opposite to the side having the emulsion layers. The layer is referred to as a backing layer. It is preferred that the backing layer contains various additives of the above-mentioned light absorbent, filter dye, ultraviolet absorbent, antistatic agent, hardening agent, binder, plasticizer, lubricant, coating aid and surfactant. The backing layer preferably has a swelling degree of from 150 to 500%.

The color photographic material of the present invention can be developed by any ordinary method, for example, in accordance with the process described in the above-mentioned RD No. 17643, pages 28 and 29, RD No. 18716, page 615, from left column to right column, and RD No. 307105, pages 880 to 881.

The color developer to be used for development of the photographic material of the present invention is preferably an aqueous alkaline solution consisting essentially of an aromatic primary amine color-developing agent. As the color-developing agent, p-phenylenediamine compounds are preferably used, though aminophenol compounds are also useful. Specific examples of p-phenylenediamine compounds usable as the color-developing agent include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-( 2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-ethyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis-(4-hydroxybutyl)aniline, 4-amino-3-mehtyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, as well as sulfates, hydrochlorides and p-toluenesulfonates of these compounds. Above all, especially preferred are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and their hydrochlorides, p-toluenesulfonates and sulfates. These compounds can be used in combinations of two or more of them, in accordance with the object.

The color developer generally contains a pH buffer such as an alkali metal carbonate, borate or phosphate, and a development inhibitor or anti-foggant such as a chloride, bromide, iodide, benzimidazole, benzothiazole or mercapto compound. If desired, it may also contain various preservatives such as hydroxylamine, diethylhydroxylamine, sulfites, hydrazines such as N,N-biscarboxymethylhydrazine, phenylsemicarbazides, triethanolamine, catechol-sulfonic acids; an organic solvent such as ethylene glycol and diethylene glycol; a development accelerator such as benzyl alcohol, polyethylene glycol, quaternary ammonium salts, and amines; a dye-forming coupler; a competing coupler; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. As specific examples of chelating agents which may be incorporated into the color developer, there are mentioned ethylenediamine-tetraacetic acid, nitrilo-triacetic acid, diethylenetriamine-pentaacetic acid, cyclohexanediamine-tetraacetic acid, hydroxylethylimino-diacetic acid, 1-hydroxyethylidene-1,1-diphosphonic acid, nitrilo-N,N,N-trimethylenephosphonic acid, ethylenediamine-N,N,N,N-tetramethylene-phosphonic acid, ethylenediamine-di(o-hydroxyphenylacetic acid) and their salts.

Where the photographic material is processed for reversal finish, in general, it is first subjected to black-and-white development and then subjected to color development. For the first black-and-white development is a black-and-white developer is used, which contains a conventional black-and-white developing agent, for example, a dihydroxybenzene such as hydroquinone, a 3-pyrazolidone such as 1-phenyl-3-pyraozlidone, or an aminophenol such as N-methyl-p-aminophenol, singly or in combinations of them. The color developer and the black-and-white developer generally have a pH value of from 9 to 12. The amount of the developer replenisher is, though it depends upon the color photographic material to be processed, generally 3 liters or less per $m^2$ of the material to be processed. It may be reduced to 500 ml or less per $m^2$ of the material to be processed, by lowering the bromide ion concentration in the replenisher. Where the amount of the replenisher is reduced, it is preferred to reduce the contact area of the surface of the processing solution in the processing tank with air so as to prevent vaporization and aerial oxidation of the solution.

The contact surface area of the processing solution with air in the processing tank is represented by the opening ratio which is defined by the following formula:

$$\text{Opening Ratio}=(\text{Contact Surface Area } (cm^2) \text{ of Process Solution with Air})/(\text{Volume } (cm^3) \text{ of Processing Solution})$$

The opening ratio is preferably 0.1 or less, more preferably from 0.001 to 0.05. Various means can be employed for the purpose of reducing the opening ratio, which include, for example, provision of a masking substance such as a floating lid on the surface of the processing solution in the processing tank, employment of the mobile lid described in JP-A-1-82033 and employment of the slit-developing -method described in JP-A-63-216050. Reduction of the opening ratio is preferably applied to not only the steps of color development and black-and-white development but also to all the subsequent steps such as bleaching, bleach-fixation, fixation, rinsing and stabilization. In addition, the amount of the replenisher to be added may also be reduced by means of suppressing accumulation of bromide ions in the developer.

The time for color development is generally within from 2 minutes to 5 minutes, but the processing time may be shortened by elevating the processing temperature, elevating the pH of the processing solution and elevating the concentration of the processing solution.

After being color developed, the photographic emulsion layer is generally bleached. Bleaching may be effected simultaneously with fixation (bleach-fixation) or separately therefrom. In order to accelerate the processing speed, a system of bleaching followed by bleach-fixation may also be employed. If desired, a system of using a bleach-fixing bath of two continuous tanks, a system of fixation followed by bleach-fixation, or a system of bleach-fixation followed by bleaching may also be employed, in accordance with the object. As the bleaching agent can be used, for example, compounds of polyvalent metals such as iron(III), as well as peracids, quinones and nitro compounds. Specific examples of the bleaching agent usable in the present invention include organic complexes of iron(III), such as complexes thereof with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid or glycol etherdiaminetetraacetic acid or with organic acids such as citric acid, tartaric acid or malic acid. Among them, aminopolycarboxylato/iron(III) complexes such as ethylenediaminetetraacetato/iron(III) complex and 1,3-diaminopropane-tetraacetato/iron(III) complex are preferred in view of the rapid processability thereof and prevention of environmental pollution. The aminopolycarboxylato/iron (III) complexes are especially useful both in a bleaching solution and in a bleach-fixing solution. The bleaching solution or bleach-fixing solution containing such aminopolycarboxylato/iron(III) complexes generally has a pH of from 4.0 to 8.0, but the solution may have a lower pH for rapid processing.

The bleaching solution, the bleach-fixing solution and the prebath thereof may contain a bleaching accelerating agent, if desired. Various bleaching accelerating agents are known, and examples of agents which are advantageously used in the present invention include mercapto group- or disulfide group-containing compounds as described in U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426, RD No. 17129 (July, 1978); thiazolidine derivatives as described in JP-A-50-140129; thiourea derivatives as described in JP-B-45-8506, JP-A-52-20832 and JP-A-53-32735 and U.S. Pat. No. 3,706,561; iodide salts as described in German Patent 1,127,715 and JP-A-58-16235; polyoxyethylene compounds as described in German Patents 966,410 and 2,748,430; polyamine compounds as described in JP-B-45-8836; other compounds as described in JP-A-49-40943, JP-A-49-59644, JP-A-53-94927, JP-A-54-35727, JP-A-55-26506 and JP-A-58-163940; and bromide ions. Above all, mercapto group- or disulfide group-containing compounds, in particular, those described in U.S. Pat. No. 3,893,858, German Patent 1,290,812 and JP-A-53-95630 are preferred, as having a large accelerating effect. In addition, the compounds described in U.S. Pat. No. 4,552,834 are also preferred. These bleaching accelerators may be incorporated into the photographic material of the invention. Where the material of the invention is a picture-taking color photographic material and it is bleach-fixed, these bleaching accelerators are especially effective.

The bleaching solution and bleach-fixing solution may further contain, in addition to the above-mentioned components, various organic acids for the purpose of preventing bleaching stains. Especially preferred organic acids for the purpose are those having an acid dissociating constant (pKa) of from 2 to 5. For instance, acetic acid, propionic acid and hydroxyacetic acid are preferably used.

As the fixing agent in the fixing solution or bleach-fixing solution to be applied to the photographic material of the invention, usable are thiosulfates, thiocyanates, thioether compounds, thioureas, and a large amount of iodide salts. Use of thiosulfates is conventional for this purpose. Above all, ammonium thiosulfate is most widely used. Additionally, combinations of thiosulfates and thiocyanates, thioether compounds or thioureas are also preferred. As the preservative to be used in the fixing solution or bleach-fixing solution, preferred are sulfites, bisulfites and carbonyl-bisulfite adducts, as well as sulfinic acid compounds as described in European Patent 294769A. Further, the fixing solution or bleach-fixing solution may preferably contain various aminopolycarboxylic acids or organic phosphonic acids for the purpose of stabilizing the solution.

It is preferred that the fixing solution or bleach-fixing solution to be used for processing the photographic material of the present invention contains compounds having a pKa of from 6.0 to 9.0, for the purpose of adjusting the pH of the solution. As such compounds, preferably added are imidazoles such as imidazole, 1-methylimidazole, 1-ethylimidaozle or 2-mehtylimidazole, in an amount of from 0.1 to 10 mol/liter.

The total time for the desilvering process is preferably shorter so long as it does not cause desilvering failure. For instance, the time is preferably from 1 minute to 3 minutes, more preferably from 1 minute to 2 minutes. The processing temperature may be from 25° C. to 50° C., preferably from 35° C. to 45° C. In such a preferred temperature range, the desilvering speed is accelerated and generation of stains in the processed material may effectively be prevented.

In the desilvering process, it is desired that stirring of the processing solution during the process be promoted as much as possible. As examples of reinforced stirring means for forcedly stirring the processing solution during the desilvering step, there are mentioned a method of running a jet stream of the processing solution against the emulsion-coated surface of the material, as described in JP-A-62-183460; a method of promoting the stirring effect by the use of a rotating means, as described in JP-A-62-183461; a method of moving the photographic material being processed in the processing bath while the emulsion-coated surface of the material is brought into contact with a wiper blade as provided in the processing bath, whereby the processing solution as applied to the emulsion-coated surface of the material is made turbulent and the stirring effect is promoted; and a method of increasing the total circulating amount of the processing solution. Such reinforced stirring means are effective for any of the bleaching solution, bleach-fixing solution and fixing solution. It is considered that reinforcement of stirring of the processing solution would promote penetration of the bleaching agent and fixing agent into the emulsion layer of the photographic material being processed and, as a result, the desilvering rate in processing the material would be elevated. The above-mentioned reinforced stirring means are more effective when a bleaching accelerator is incorporated into the processing solution. The use of reinforced stirring means accelerates bleaching remarkably, and avoids the fixation preventing effect encountered when bleaching accelerators are used.

The photographic material of the present invention can be processed with an automatic developing machine. It is desired that the automatic developing machine to be used for processing the material of the present invention be equipped with a photographic material-conveying means as described in JP-A-60-191257, JP-A-60-191258 and JP-A-60-191259. As is noted from the related disclosure of JP-A-60-191257, the conveying means may noticeably reduce the carry-over amount from the previous bath to the subsequent bath and therefore it is extremely effective for preventing deterioration of the processing solution being used. Because of these reasons, the conveying means is especially effective for shortening the processing time in each processing step and for reducing the amount of the replenisher to each processing bath.

The silver halide color photographic material of the present invention is generally rinsed in water and/or stabilized, after being desilvered. The amount of water to be used in the rinsing step can be set in a broad range, in accordance with the characteristics of the photographic material being processed (for example, depending upon the raw material components, such as the coupler and so on) or the use of the material, as well as the temperature of the rinsing water, the number of the rinsing tanks (the number of the rinsing stages), the replenishment system (normal current or countercurrent), and various other conditions. Among these conditions, the relation between the number of the rinsing tanks and the amount of the rinsing water in a multi-stage countercurrent rinsing system can be obtained by the method described in *Journal of the Society of Motion Picture and Television Engineers,* Vol. 64, pages 248 to 253 (May, 1955).

According to the multi-stage countercurrent system described in the above-mentioned reference, the amount of the rinsing water to be used can be reduced noticeably, but because of the prolongation of the residence time of the water in the rinsing tank, bacteria would propagate in the tank so that the floating substances generated by the propagation of bacteria would adhere to the surface of the material as it is processed. Accordingly, the above system would often have a problem. In the practice of processing the photographic material of the present invention, the method of reducing calcium and magnesium ions, which is described in JP-A-62-288838, can be used extremely effectively for overcoming this problem. In addition, isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), *Bactericidal and Fungicidal Techniques to Microorganisms,* edited by Association of Sanitary Technique, Japan (1982, by Kogyo Gijutsu-kai, Japan), and *Encyclopedia of Bactericidal and Fungicidal Agents,* edited by Nippon Bactericide and Fungicide Association, Japan (1986), can also be used.

The pH of the rinsing water to be used for processing the photographic material of the present invention is from 4 to 9, preferably from 5 to 8. The temperature of the rinsing water and the rinsing time can also be set variously in accordance with the characteristics of the photographic material being processed as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic material of the present invention may also be processed directly with a stabilizing solution in place of being rinsed with water. For the stabilization, any known methods, for example, as described in JP-A 57-8543, 58-14834 and 60-220345, can be employed.

In addition, the material can also be stabilized, following the rinsing step. As one example of such a case, there may be mentioned a stabilizing bath containing a dye stabilizer and a surfactant, which is used as a final bath for picture-taking color photographic materials. As examples of dye stabilizers usable for the purpose, there are mentioned aldehydes such as formalin and glutaraldehyde, N-methylol compounds, hexamethylene-tetramine and aldehyde-sulfite adducts. The stabilizing bath may also contain various chelating agents and fungicides.

The overflow from the rinsing and/or stabilizing solutions because of addition of replenishers thereto may be re-used in the other steps such as the desilvering step.

Where the photographic material of the present invention is processed with an automatic developing machine system and the processing solutions being used in the step are evaporated and thickened, it is preferred to add water to the solutions so as to correct the concentration of the solutions.

The silver halide color photographic material of the present invention can contain a color developing agent for the purpose of simplifying and accelerating the processing of the material. For incorporation of a color developing agent into the photographic material, various precursors of the color developing agent are preferably used. For example, there are mentioned indoaniline compounds as described in U.S. Pat. No. 3,342,597, Schiff base compounds as described in U.S. Pat. No. 3,342,599 and RD Nos. 14850 and 15159, aldole compounds as described in RD No. 13924, metal complexes as described in U.S. Pat. No. 3,719,492 and urethane compounds as described in JP-A-53-135628, as the precursors.

The silver halide color photographic material of the present invention can contain various kinds of 1-phenyl-3-pyrazolidones, if desired, for the purpose of accelerating the color developability thereof. Specific examples of these compounds are described in JP-A-56-64339, JP-A-57-144547 and JP-A-58-115438.

The processing solutions for the photographic material of the invention are used at 10° C. to 50° C. In general, a processing temperature of from 33° C. to 38° C. is standard, but the temperature may be made higher so as to accelerate the processing or to shorten the processing time, or on the contrary, the temperature may be made lower so as to improve the quality of images formed and to improve the stability of the processing solution used.

The silver halide color photographic material of the present invention is especially effectively applied to lens-combined film units such as those described in JP-B-2-32615 and Japanese Utility Model Publication 3-39784.

Next, the present invention will be explained in more detail by way of the following examples, which, however, are not intended to restrict the scope of the invention.

EXAMPLE 1

Plural layers each having the composition mentioned below were coated on a subbing layer-coated cellulose triacetate support, to prepare a multi-layer color photographic material Sample 101.

Compositions of Photographic Layers

Essential components constituting the photographic layers are grouped as follows:

ExC: Cyan Coupler

UV: Ultraviolet Absorbent

ExM: Magenta Coupler

HBS: High Boiling Point Organic Solvent

ExY Yellow Coupler

H: Gelatin Hardening Agent

ExS: Sensitizing Dye

Cpd-1: mainly used as a color mixing inhibitor

Cpd-2: used to stabilize an emulsion, to improve preservability, to prevent fluctuation of a latent image Cpd-3: mainly used to elevate the gradation at a lower color density The number to the right of each component indicates the amount coated in units of g/m$^2$. The amount of silver halide in Emulsions A to G coated is given on a silver basis. (The silver halide composition, the size and form of silver halide grains are shown in Table 2.) The amount of sensitizing dye coated is given in terms of mols of sensitizing dye per mol of silver halide in the same layer.

Sample 101

First Layer: Anti-halation Layer

Black Colloidal Silver 0.18 as Ag

Gelatin 1.40

ExM-1 0.18

ExF-1 $2.0\times10^{-3}$
HBS-1 0.20

Second Layer: Interlayer
Emulsion G 0.065 as Ag
2,5-Di-t-pentadecylhydroquinone 0.18
ExC-1 0.020
UV-1 0.060
UV-2 0.080
UV-3 0.10
HBS-1 0.10
HBS-2 0.020
Gelatin 1.04

Third Layer: Low-sensitivity Red-sensitive Emulsion Layer
Emulsion A 0.25 as Ag
Emulsion B 0.25 as Ag
ExS-1 $6.9\times10^{-5}$
ExS-2 $1.8\times10^{-5}$
ExS-3 $3.1\times10^{-4}$
Comparative Coupler (1) 0.25
ExC-2 0.020
ExC-3 0.0050
ExC-4 0.010
Cpd-2 0.025
HBS-1 0.050
HBS-2 0.050
Gelatin 0.87

Fourth Layer: Middle-sensitivity Red-sensitive Emulsion Layer
Emulsion D 0.70 as Ag
ExS-1 $3.5\times10^{-4}$
ExS-2 $1.6\times10^{-5}$
ExS-3 $5.1\times10^{-4}$
Comparative Coupler (1) 0.19
ExC-1 0.060
ExC-2 0.025
ExC-3 0.0010
ExC-4 0.0070
Cpd-2 0.023
HBS-1 0.050
HBS-5 0.050
Gelatin 0.75

Fifth Layer: High-sensitivity Red-sensitive Emulsion Layer
Emulsion E 1.40 as Ag
ExS-1 $2.4\times10^{-4}$
ExS-2 $1.0\times10^{-4}$
ExS-3 $3.4\times10^{-4}$
Comparative Coupler (1) 0.16
ExC-4 0.025
Cpd-2 0.050
HBS-1 0.11
HBS-2 0.10
HBS-4 0.11
Gelatin 1.20

Sixth Layer: Interlayer
Cpd-1 0.10
HBS-1 0.50
Gelatin 1.10

Seventh Layer: Low-sensitivity Green-sensitive Emulsion Layer
Emulsion C 0.35 as Ag
ExS-4 $3.0\times10^{-5}$
ExS-5 $2.1\times10^{-4}$
ExS-6 $8.0\times10^{-4}$
ExM-1 0.010
ExM-2 0.33
ExM-3 0.086
ExY-1 0.015
HBS-1 0.30
HBS-3 0.010
Gelatin 0.73

Eighth Layer: Middle-sensitivity Green-sensitive Emulsion Layer
Emulsion D 0.80 as Ag
ExS-4 $3.2\times10^{-5}$
ExS-5 $2.2\times10^{-4}$
ExS-6 $8.4\times10^{-4}$
ExM-2 0.13
ExM-3 0.030
ExY-1 0.018
HBS-1 0.10
HBS-5 0.060
HBS-3 $8.0\times10^{-3}$
Gelatin 0.90

Ninth Layer: High-sensitivity Green-sensitive Emulsion Layer
Emulsion E 1.25 as Ag
ExS-4 $3.7\times10^{-5}$
ExS-5 $8.1\times10^{-5}$
ExS-6 $3.2\times10^{-4}$
ExM-1 0.030
ExM-4 0.040
ExM-5 0.019
Cpd-3 0.040
HBS-1 0.15
HBS-2 0.10
HBS-4 0.10
Gelatin 1.44

Tenth Layer: Yellow Filter Layer
Yellow Colloidal Silver 0.030 as Ag
Cpd-1 0.16
HBS-1 0.60
Gelatin 0.60

Eleventh Layer: Low-sensitivity Blue-sensitive Emulsion Layer
Emulsion C 0.18 as Ag
ExS-7 $8.6\times10^{-4}$
ExY-1 0.020
ExY-2 0.22
ExY-3 0.50
ExY-4 0.020
HBS-1 0.14
HBS-4 0.14
Gelatin 1.10

Twelfth Layer: Middle-sensitivity Blue-sensitive Emulsion Layer

Emulsion D 0.40 as Ag
ExS-7 $7.4\times10^{-4}$
ExC-3 $7.0\times10^{-3}$
ExY-2 0.050
ExY-3 0.10
HBS-1 0.030
HBS-5 0.020
Gelatin 0.78

Thirteenth Layer: High-sensitivity Blue-sensitive Emulsion Layer

Emulsion F 1.00 as Ag
ExS-7 $4.0\times10^{-4}$
ExY-2 0.10
ExY-3 0.10
HBS-1 0.070
Gelatin 0.86

Fourteenth Layer: First Protective Layer

Emulsion G 0.20 as Ag
UV-4 0.11
UV-5 0.17
HBS-1 $5.0\times10^{-2}$
Gelatin 1.00

Fifteenth Layer: Second Protective Layer

H-1 0.40
B-1 (diameter 1.7 μm) $5.0\times10^{-2}$
B-2 (diameter 1.7 μm) 0.10
B-3 0.10
S-1 0.20
Gelatin 1.20

In addition, the respective layers contained one or more of W-1 through W-3, B-4 through B-6, F-1 through F-17, and iron salt, lead salt, gold salt, platinum salt, iridium salt and rhodium salt, so as to have improved storability, processability, pressure resistance, fungicidal and bactericidal properties, antistatic properties and coatability.

The emulsions used are shown below in Table 1.

TABLE 1

| | Mean AgI Content (%) | Mean Grain Size (μm) | Fluctuation Coefficient to Grain Size (%) | Ratio of Diameter/ Thickness | Ratio of Silver Contents [core/interlayer/shell] (as AgI content %) | Structure and Shape of Grains |
|---|---|---|---|---|---|---|
| Emulsion A | 4.0 | 0.45 | 15 | 1 | [1/3] (13/1) | two-layer structural octahedral grains |
| Emulsion B | 8.9 | 0.70 | 17 | 1 | [3/7] (25/2) | two-layer structural octahedral grains |
| Emulsion C | 2.0 | 0.55 | 18 | 7 | — | uniform structural tabular grains |
| Emulsion D | 9.0 | 0.65 | 18 | 6 | [12/59/29] (0/11/8) | three-layer structural tabular grains |
| Emulsion E | 9.0 | 0.85 | 20 | 5 | [8/59/33] (0/11/8) | three-layer structural tabular grains |
| Emulsion F | 14.5 | 1.25 | 25 | 3 | [37/63] (34/3) | two-layer structural tabular grains |
| Emulsion G | 1.0 | 0.07 | 15 | 1 | — | uniform structural fine grains |

In Table 1 above:

(1) Emulsions A to F had been subjected to reduction sensitization with thiourea dioxide and thiophosphonic acid during formation of the grains, in accordance with the example of JP-A 2-191938 (U.S. Pat. No. 5,061,614);

(2) Emulsions A to F had been subjected to gold sensitization, sulfur sensitization and selenium sensitization in the presence of the spectral sensitizing dyes to be used in the respective light-sensitive layers and sodium thiocyanate, in accordance with the example of JP-A-3-237450 (EP 443,453A);

(3) for preparation of tabular grains, a low molecular gelatin was used in accordance with the example of JP-A-1-158426;

(4) tabular grains and normal crystalline grains having a granular structure were observed to have dislocation lines as described in JP-A-3-237450 (EP 443,453), with a high-pressure electronic microscope; and (5) Emulsions A to G were silver iodobromide emulsions.

Structural formulae of the compounds used in Sample 101 are shown below.

ExC-1
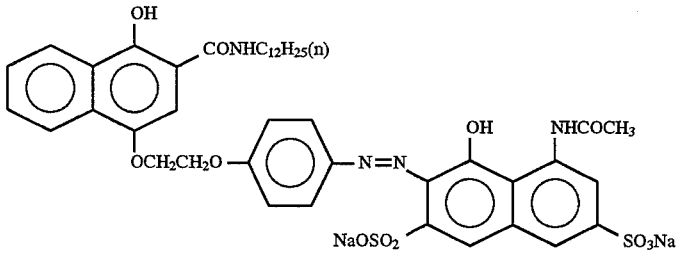
ExC-2
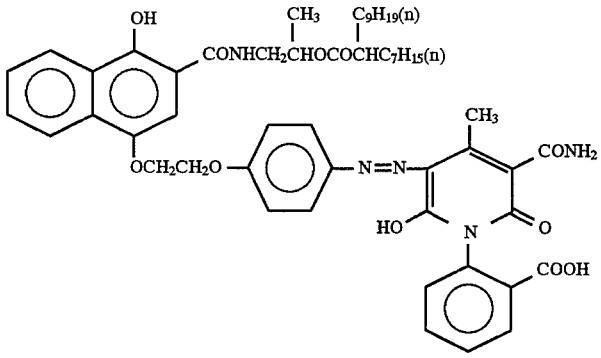
ExC-3
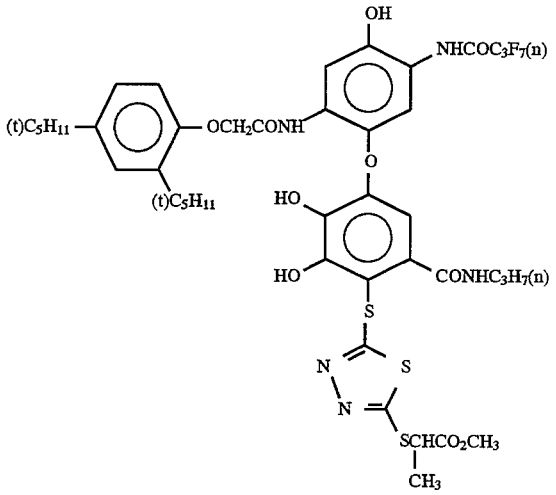
ExC-4
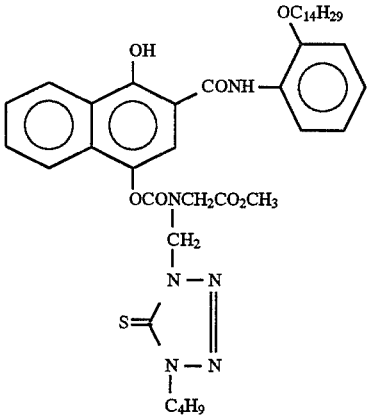

-continued
ExM-1
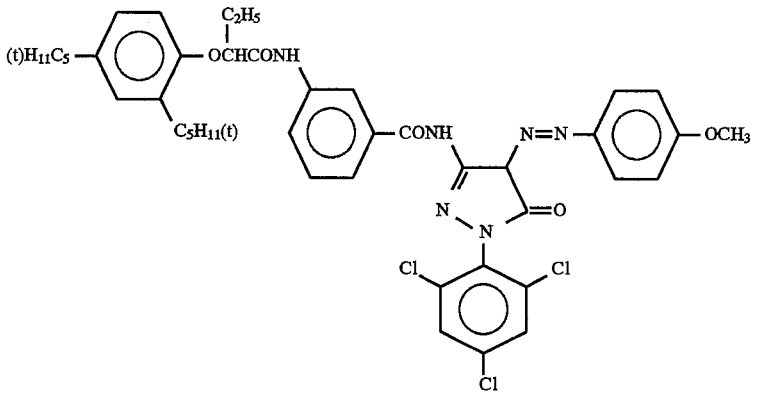
ExM-2
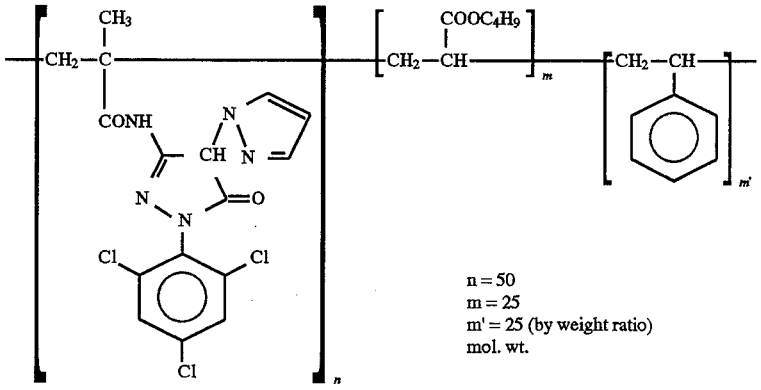
n = 50
m = 25
m' = 25 (by weight ratio)
mol. wt.
ExM-3
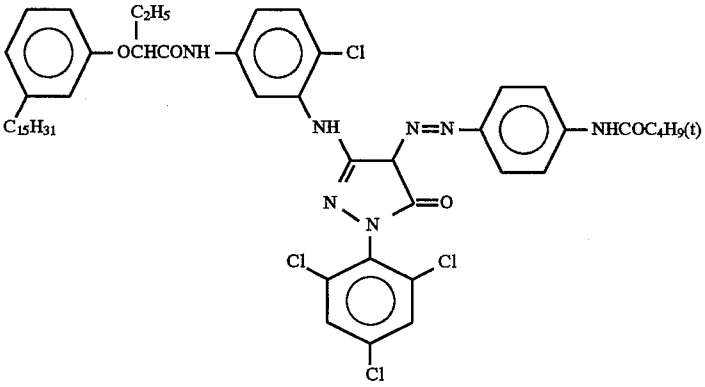
ExM-4
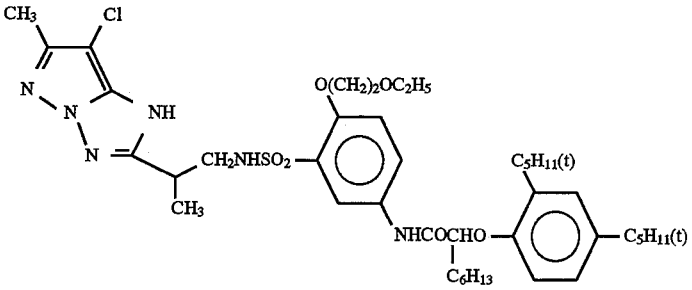

-continued
ExM-5
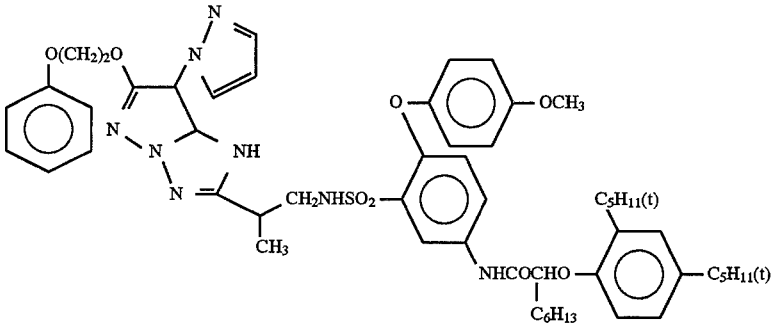
ExY-1
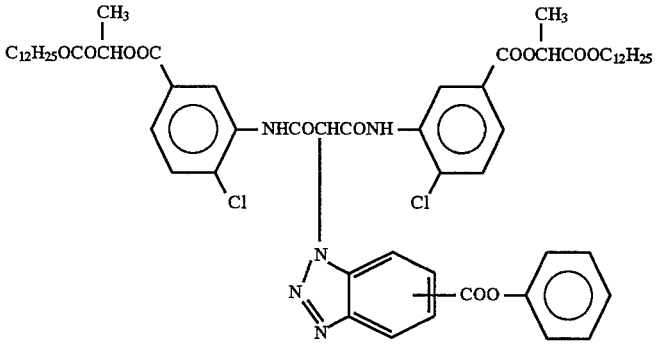
ExY-2
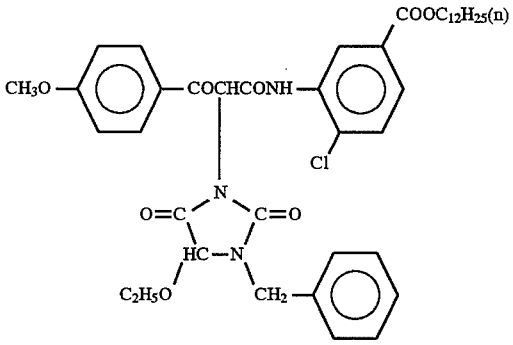
ExY-3
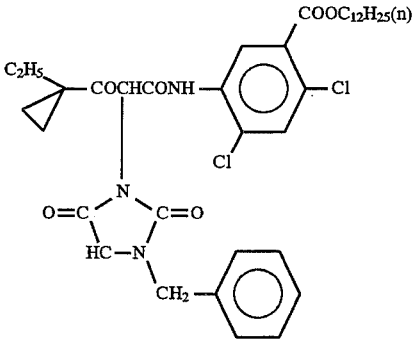

-continued
ExY-4
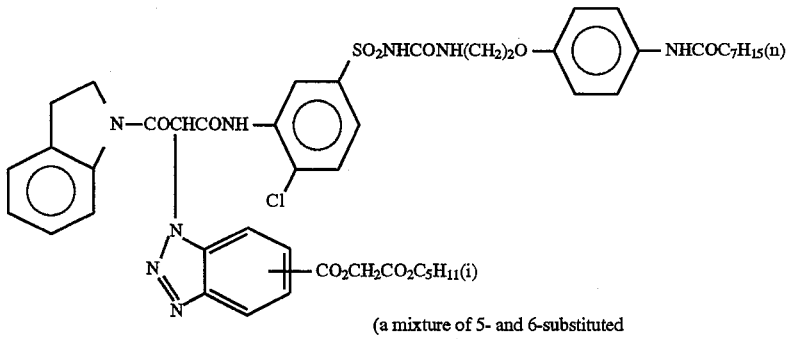
(a mixture of 5- and 6-substituted compounds)
ExF-1
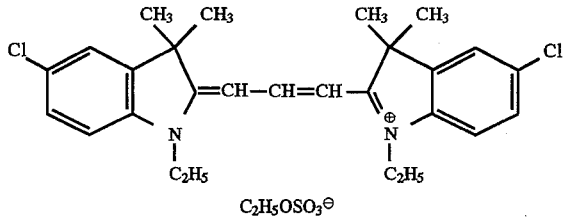
Cpd-1
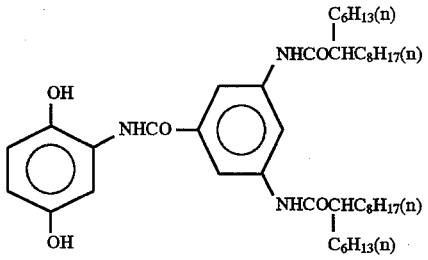
Cpd-2
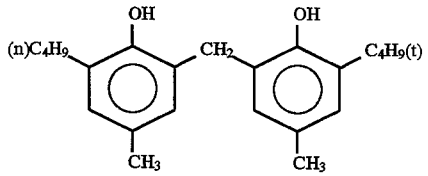
Cpd-3
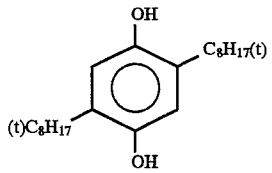
UV-1
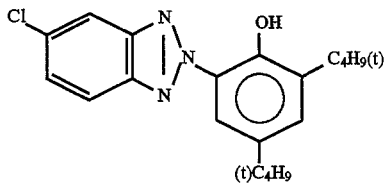
UV-2
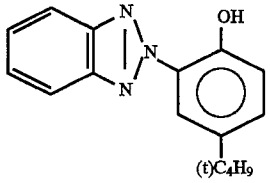

-continued
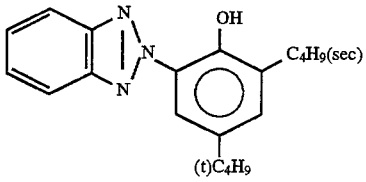
UV-3
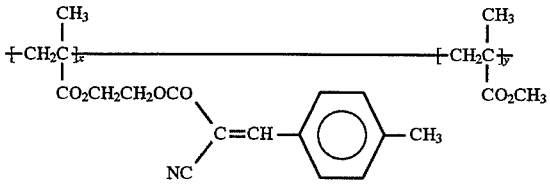
UV-4
x:y = 70:30(wt %)
average molecular
weight: about 40,000
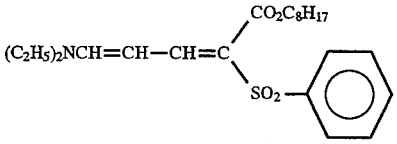
UV-5
Tricresyl Phosphate HBS-1
Di-n-butyl Phthalate HBS-2
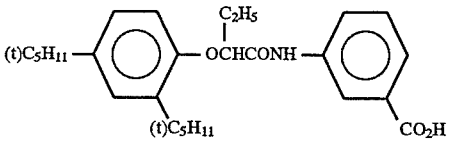
HBS-3
Triisononyl Phosphate HBS-4
Dioctyl Phthalate HBS-5
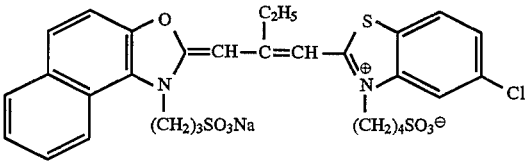
ExS-1
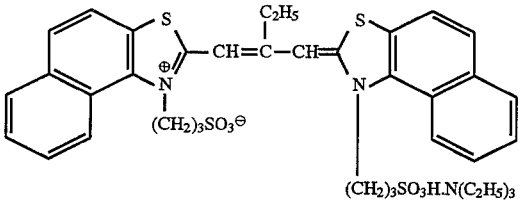
ExS-2
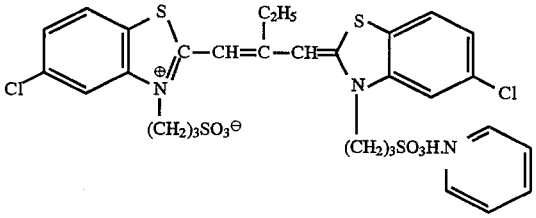
ExS-3

-continued
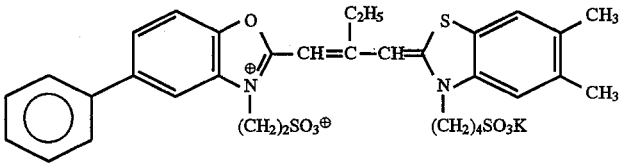
ExS-4
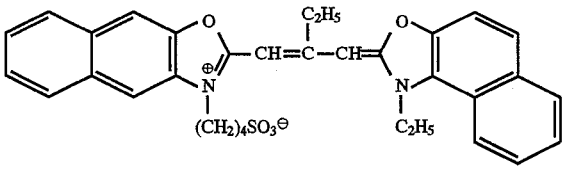
ExS-5
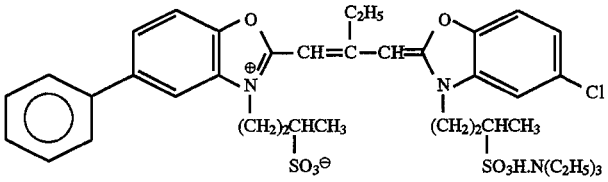
ExS-6
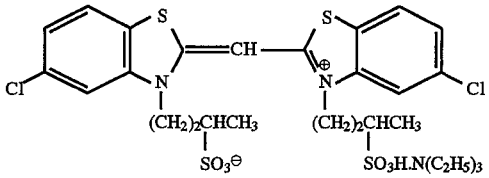
ExS-7
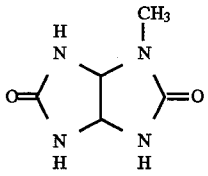
S-1
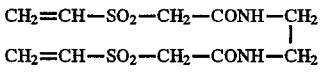
H-1
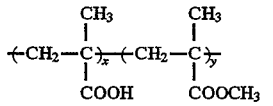
x/y = 10/90
(molar ratio)
average molecular weight:
about 42,000
B-1
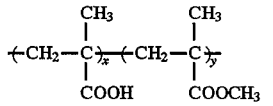
x/y = 40/60
(molar ratio)
average molecular weight:
about 55,000
B-2
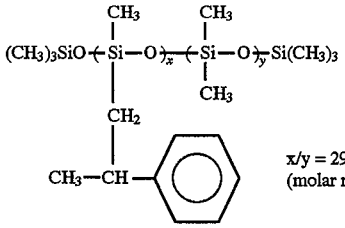
x/y = 29/46
(molar ratio)
average molecular weight:
about 1,000,000
B-3

-continued
B-4
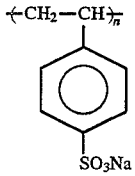
average molecular weight:
about 750,000
B-5
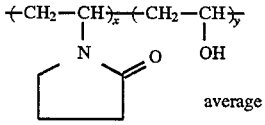
x/y = 70/30
(molar ratio)
average molecular weight:
about 14,000
B-6
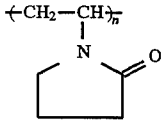
average molecular weight:
about 10,000
W-1
$C_8F_{17}SO_2NHCH_2CH_2CH_2OCH_2CH_2\overset{\oplus}{N}(CH_3)_3$
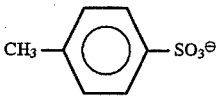
W-2
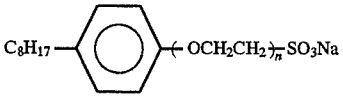
(a mixture of n = 2~4)
W-3
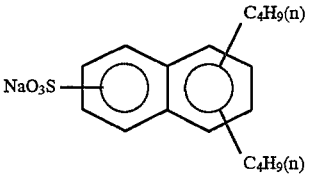
(a mixture)
F-1
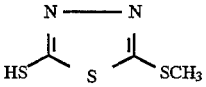
F-2
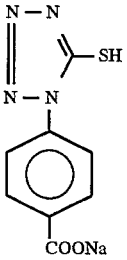
F-3
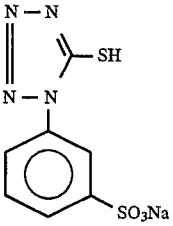

-continued
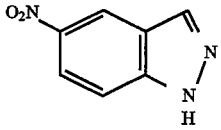
F-4
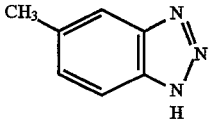
F-5
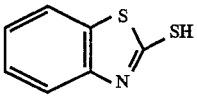
F-6
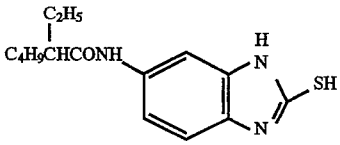
F-7
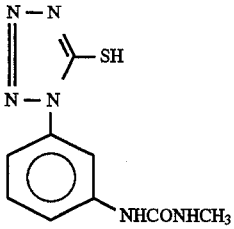
F-8
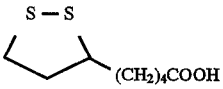
F-9
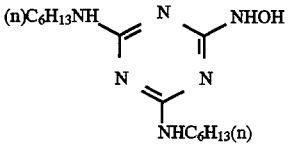
F-10
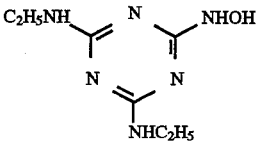
F-11
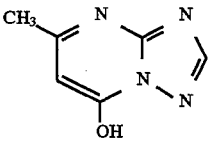
F-12
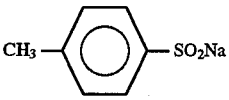
F-13
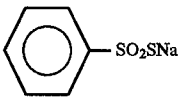
F-14
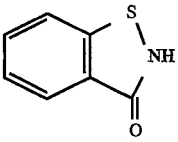
F-15

-continued

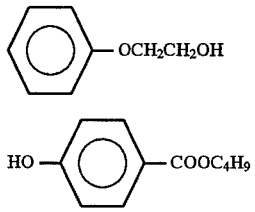

F-16

F-17

Samples Nos. 102 to 127 were prepared in the same manner as Sample No. 101, except that the Comparative Coupler (1) in the third to fifth red-sensitive layers was replaced by the same molar amount of another comparative coupler or a coupler of the present invention or a combination of couplers as indicated in Table 2 below. The comparative couplers used herein are shown below.

Comparative Coupler (1):

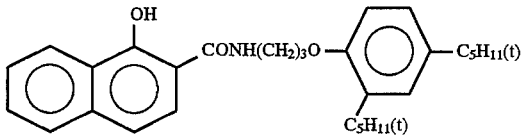

Comparative Coupler (2):

Coupler (25) described in JP-A-64-46752

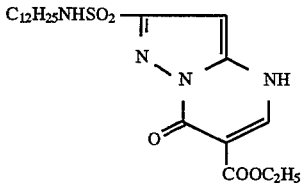

Comparative Coupler (3):

Coupler (7) described in JP-A-64-46753

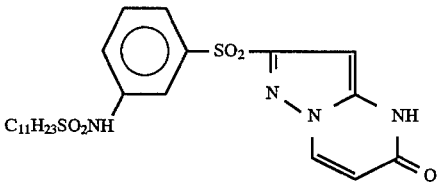

Comparative Coupler (4):

Coupler (28) described in JP-A-2-214857

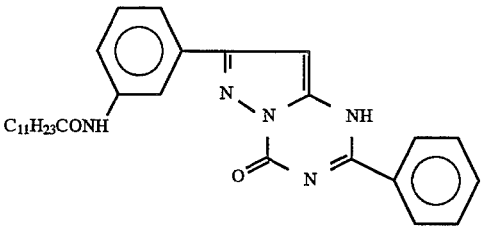

The thus prepared Samples No. 101 to 127 were subjected to color development in accordance with the process mentioned below, and the processed samples were examined with respect to the properties mentioned below.

Color Development Process:

| Step | Time | Temperature |
|---|---|---|
| Color Development | 3 min 15 sec | 38° C. |
| Bleaching | 3 min 00 sec | 38° C. |
| Rinsing | 30 sec | 24° C. |
| Fixation | 3 min 00 sec | 38° C. |
| Rinsing (1) | 30 sec | 24° C. |
| Rinsing (2) | 30 sec | 24° C. |
| Stabilization | 30 sec | 38° C. |
| Drying | 4 min 20 sec | 55° C. |

Compositions of the processing solutions used above are mentioned below.

Color Developer

Diethylenetriaminepentaacetic Acid 1.0 g
1-Hydroxyethylidene-1,1-diphosphonic Acid 3.0 g
Sodium Sulfite 4.0 g
Potassium Carbonate 30.0 g
Potassium Bromide 1.4 g
Potassium Iodide 1.5 mg
Hydroxylamine Sulfate 2.4 g
4-[N-Ethyl-N-β-hydroxyethyl- 4.5 g amino]-2-methylaniline Sulfate
Water to make 1.0 liter
pH 10.05

Bleaching Solution

Sodium Ethylenediaminetetraacetato/Ferric Complex Trihydrate 100.0 g
Disodium Ethylenediaminetetraacetate 10.0 g
3-Mercapto-1,2,4-triazole 0.08
Ammonium Bromide 140.0 g
Ammonium Nitrate 30.0 g
Aqueous Ammonia (27%) 6.5 ml
Water to make 1.0 liter
pH 6.0

Fixing Solution

Disodium Ethylenediaminetetraacetate 0.5g
Ammonium Sulfite 20.0 g
Ammonium Thiosulfate Aqueous Solution (700 g/liter) 290.0 ml
Water to make 1.0 liter
pH 6.7

Stabilizing Solution

Sodium P-toluenesulfinate 0.03 g

Polyoxyethylene P-mononononylphenyl Ether (mean polymerization degree 10) 0.2g

Disodium Ethylenediaminetetraacetate 0.05 g 1,2,4-Triazole 1.3 g 1,4-Bis(1,2,4-triazol-1-ylmethyl)piperazine 0.75 g Water to make 1.0 liter pH 8.5

The properties of the processed samples were examined in the manner mentioned below.

(1) Photographic Properties

Gradient exposure with a white light (4800° K.) was imparted to each sample, and the exposed sample was processed in accordance with the process mentioned above. The color density of the processed sample was measured to give a characteristic curve. From the curve, a logarithmic number of the reciprocal of the exposure amount of giving a red (R) density of (minimum R density+0.2) was obtained, and this was taken as the sensitivity of the sample. On the basis of the standard sensitivity value of Sample No. 101, the difference ($\Delta S_R$) from the standard sensitivity value of Sample No. 101 was obtained for each sample.

A density at the point of the exposure amount of logE=1.5 in the higher exposure amount side from the point of the exposure amount giving a R density of (minimum R density+0.2) was read out from the curve, and the percentage ($D_R$ %) based on the standard density of Sample No. 101 was obtained for each sample.

(2) Color Image Fastness

The density of each sample as exposed by gradient exposure with a white light and processed by the process mentioned above was measured. One group of the processed samples was stored for 30 days under the conditions of 60° C. and 70% RH and the density of each of the stored samples was again measured. Another group of samples was applied to a xenon fading tester (80,000 lux.sec) and irradiated with a xenon lamp for 5 days, and the density of each of the tested samples was again measured. The density of each of the thus tested samples was read out at the point of the exposure amount of giving a R density of (minimum R density+1.0) before the storage or irradiation test, and the cyan color retentiveness (%) was evaluated on the basis of the density of the original sample before the test. The test result of the cyan color retentiveness of each sample in the high-temperature high-humidity test was represented by $D_1$ (%); and that in the light irradiation test was represented by $D_2$ (%).

(3) Color Turbidity

Each sample was exposed by gradient exposure through a red color separation filter as applied thereto and then processed by the process mentioned above. The R density and B density of the cyan color image of each sample were measured, and the B density at the point of the exposure amount giving a R density of (minimum R density+1.0) was obtained. The value obtained by subtracting the B density value at the minimum density area was taken to indicate the color turbidity, which is one criterion for evaluating the color reproducibility of each sample. The smaller the value, the smaller the yellow component in the cyan color image formed; thus the smaller the value, the higher the saturation of the cyan color image formed and the better the color reproducibility of the sample.

The results obtained are shown in Table 2 below.

TABLE 2

| | Red-sensitive Emulsion Layer | | | Photographic Properties | | Color Image Fastness | | |
|---|---|---|---|---|---|---|---|---|
| Sample No. | 3rd layer | 4th layer | 5th layer | $\Delta S_R$ | $D_R$ (%) | To heat and humidity | To light | Color Turbidity |
| 101 (comparative sample) | comparative coupler (1) | same as 3rd layer | same as 3rd layer | 0.00 (standard) | 100 (standard) | 83 | 90 | 0.06 |
| 102 (comparative sample) | comparative coupler (2) | same as 3rd layer | same as 3rd layer | −0.31 | 32 | 94 | 93 | 0.04 |
| 103 (comparative sample) | comparative coupler (3) | same as 3rd layer | same as 3rd layer | −0.34 | 30 | 89 | 89 | 0.04 |
| 104 (comparative sample) | comparative coupler (4) | same as 3rd layer | same as 3rd layer | −0.29 | 37 | 92 | 89 | 0.04 |
| 105 (comparative sample) | (IIIa)-3 | same as 3rd layer | same as 3rd layer | +0.05 | 115 | 96 | 97 | 0.03 |
| 106 (comparative sample) | IIC-7 | same as 3rd layer | same as 3rd layer | +0.04 | 107 | 98 | 99 | 0.08 |
| 107 (comparative sample) | IIIC-2 | same as 3rd layer | same as 3rd layer | +0.03 | 105 | 98 | 98 | 0.05 |
| 108 (comparative sample) | (IIIa)-3/comparative coupler (1) = 1/1 | same as 3rd layer | same as 3rd layer | +0.05 | 115 | 90 | 93 | 0.05 |
| 109 (comparative | (IIIa)-3/comparative coupler (2) = 1/1 | same as 3rd layer | same as 3rd layer | +0.04 | 113 | 95 | 95 | 0.04 |

TABLE 2-continued

| Sample No. | Red-sensitive Emulsion Layer 3rd layer | 4th layer | 5th layer | Photographic Properties $\Delta S_R$ | $D_R$ (%) | Color Image Fastness To heat and humidity | To light | Color Turbidity |
|---|---|---|---|---|---|---|---|---|
| sample) | | | | | | | | |
| 110 (comparative sample) | (IIIa)-3/comparative coupler (3) = 1/1 | same as 3rd layer | same as 3rd layer | +0.04 | 113 | 93 | 93 | 0.04 |
| 111 (comparative sample) | (IIIa)-3/comparative coupler (4) = 1/1 | same as 3rd layer | same as 3rd layer | +0.04 | 114 | 94 | 93 | 0.04 |
| 112 (comparative sample) | IIC-7/comparative coupler (1) = 1/1 | same as 3rd layer | same as 3rd layer | +0.04 | 107 | 90 | 94 | 0.06 |
| 113 (comparative sample) | IIIC-2/comparative coupler (1) = 1/1 | same as 3rd layer | same as 3rd layer | +0.03 | 105 | 90 | 94 | 0.05 |
| 114 (sample (of the invention) | (IIIa)-3/IIC-7 = 1/1 | same as 3rd layer | same as 3rd layer | +0.07 | 118 | 99 | 99 | 0.04 |
| 115 (sample (of the invention) | (IIIa)-3/IIIC-2 = 1/1 | same as 3rd layer | same as 3rd layer | +0.07 | 118 | 99 | 98 | 0.03 |
| 116 (sample (of the invention) | (IIa)-1/IIC-7 = 1/1 | same as 3rd layer | same as 3rd layer | +0.07 | 118 | 99 | 99 | 0.04 |
| 117 (sample (of the invention) | (IIa)-1/IIIC-2 = 1/1 | same as 3rd layer | same as 3rd layer | +0.06 | 117 | 99 | 98 | 0.03 |
| 118 (sample (of the invention) | (VIIIa)-6/IIC-7 = 1/1 | same as 3rd layer | same as 3rd layer | +0.08 | 119 | 99 | 99 | 0.03 |
| 119 (sample (of the invention) | (VIIIa)-6/IIIC-2 = 1/1 | same as 3rd layer | same as 3rd layer | +0.08 | 119 | 99 | 98 | 0.03 |
| 120 (sample (of the invention) | (IIIa)-3/IIC-10 = 1/1 | same as 3rd layer | same as 3rd layer | +0.06 | 117 | 99 | 99 | 0.04 |
| 121 (sample (of the invention) | (IIIa)-3/IIC-14 = 1/1 | same as 3rd layer | same as 3rd layer | +0.06 | 117 | 99 | 99 | 0.04 |
| 122 (sample (of the invention) | (IIIa)-3/IIC-21 = 1./1 | same as 3rd layer | same as 3rd layer | +0.07 | 117 | 99 | 99 | 0.04 |
| 123 (sample (of the invention) | (IIIa)-3/IIIC-4 = 1/1 | same as 3rd layer | same as 3rd layer | +0.07 | 118 | 99 | 98 | 0.03 |
| 124 (sample (of the invention) | (IIIa)-3/IIIC-6 = 1/1 | same as 3rd layer | same as 3rd layer | +0.06 | 118 | 99 | 98 | 0.03 |
| 125 (sample (of the invention) | (IIIa)-3/IIIC-14 = 1/1 | same as 3rd layer | same as 3rd layer | +0.07 | 118 | 99 | 98 | 0.03 |
| 126 (sample (of the invention) | (IIIa)-3/IIC-10/IIC-7 = 2/1/1 | (IIIa)-3/IIC-7/IIC-34 = 5/4/1 | (IIIa)-3/IIC-7/IIIC-9/IIC-40 = 10/7/2/1 | 0.10 | 117 | 99 | 99 | 0.04 |
| 127 (sample of the invention | IIC-7/IIC-10 = 1/1 | (IIIa)-3/IIC-7/IIC-40 = 10/9/1 | (IIIa)-3/IIC-7/IIIC-2 = 5/3/2 | +0.09 | 116 | 99 | 98 | 0.04 |

The proportion of the components is by mol.

From the results of Table 2 above, it is clear that the couplers of formula (I) of the present invention have a higher coupling activity and give color images having a higher color density than the similar 5-membered-6-membered condensed pyrazolopyrimidone or pyrazolotriazin-7-one couplers. In addition, it is also clear therefrom that the color images formed from the former have higher color fastness and smaller color turbidity than those from the latter.

By using a combination of a coupler of formula (I) and a coupler of formula (II) and/or (III), the coloring properties (sensitivity, color density) of the photographic materials containing them are improved much more and the color image fastness of the color images formed is also improved much more than those of the comparative samples. Such effects by the combination are surprising. With respect to the color turbidity of the color image formed, it is also noted from the results of Table 2 that the combination of the couplers does not deteriorate the excellent capacity of the single use of the coupler of formula (I) alone, or that is, the color image formed in the photographic material containing the combined couplers shows almost the same color turbidity as that formed in the material containing the coupler of formula (I) only.

From the results, it is clear that the combination of a coupler of formula (I) and a coupler of formula (II) and/or (III) is better than the single use of a coupler of formula (I) only with respect to the coloring property of the couplers and with respect to the color image fastness of the color image formed.

EXAMPLE 2

Sample Nos. 201 to 215 and Sample Nos. 216 to 230 of the present invention were prepared in the same manner as Sample No. 114 and Sample No. 115, respectively, except that Coupler (IIIa)-3 in Sample No. 114 or Sample No. 115 was replaced by the same molar amount of a coupler of formula (I) as indicated in Table 3 below.

These Sample Nos. 201 to 230 were processed in the same manner as in Example 1, and the properties of the processed samples were also evaluated in the same manner as in Example 1.

The results obtained are shown in Table 3 below.

TABLE 3

| Sample No. | Coupler substituted for (IIIa)-3 | Photographic Properties ΔS | Photographic Properties D (%) | Color Image Fastness: To heat and humidity | Color Image Fastness: To light | Color Turbidity |
|---|---|---|---|---|---|---|
| 201 | IVa-1 | +0.06 | 117 | 99 | 99 | 0.04 |
| 202 | Va-1 | +0.06 | 117 | 99 | 99 | 0.04 |
| 203 | VIa-1 | +0.07 | 118 | 99 | 99 | 0.04 |
| 204 | VIIa-1 | +0.07 | 118 | 99 | 99 | 0.04 |
| 205 | IXa-1 | +0.07 | 119 | 99 | 99 | 0.04 |
| 206 | Xa-1 | +0.07 | 118 | 99 | 99 | 0.04 |
| 207 | XIa-1 | +0.07 | 118 | 99 | 99 | 0.04 |
| 208 | XIIa-1 | +0.07 | 118 | 99 | 99 | 0.04 |
| 209 | XIIIa-1 | +0.07 | 118 | 99 | 99 | 0.04 |
| 210 | XIVa-1 | +0.07 | 118 | 99 | 99 | 0.04 |
| 211 | XVa-1 | +0.07 | 118 | 99 | 99 | 0.04 |
| 212 | XVIa-1 | +0.08 | 120 | 99 | 99 | 0.04 |
| 213 | XVIIa-1 | +0.08 | 117 | 99 | 99 | 0.04 |
| 214 | XVIIIa-1 | +0.06 | 117 | 99 | 99 | 0.04 |
| 215 | XIXa-1 | +0.06 | 118 | 99 | 99 | 0.04 |
| 216 | IVa-1 | +0.06 | 118 | 99 | 98 | 0.03 |
| 217 | Va-1 | +0.06 | 119 | 99 | 98 | 0.03 |
| 218 | VIa-1 | +0.07 | 119 | 99 | 98 | 0.03 |
| 219 | VIIa-1 | +0.07 | 119 | 99 | 98 | 0.03 |
| 220 | IXa-1 | +0.07 | 119 | 99 | 98 | 0.03 |
| 221 | Xa-1 | +0.07 | 119 | 99 | 98 | 0.03 |
| 222 | XIa-1 | +0.07 | 119 | 99 | 98 | 0.03 |
| 223 | XIIa-1 | +0.07 | 119 | 99 | 98 | 0.03 |
| 224 | XIIIa-1 | +0.07 | 119 | 99 | 98 | 0.03 |
| 225 | XIVa-1 | +0.07 | 119 | 99 | 98 | 0.03 |
| 226 | XVa-1 | +0.07 | 119 | 99 | 98 | 0.03 |
| 227 | XVIa-1 | +0.08 | 120 | 99 | 99 | 0.03 |
| 228 | XVIIa-1 | +0.07 | 120 | 99 | 99 | 0.03 |
| 229 | XVIIIa-1 | +0.06 | 118 | 99 | 98 | 0.03 |
| 230 | XIXa-1 | +0.06 | 118 | 99 | 98 | 0.03 |

Comparing the results in Table 3 with those of Example 1, especially with those of the comparative samples in Example 1, it is obvious that a combination of a coupler of formula (I) of the invention and a coupler of formula (II) and/or (III) of the invention brings about improvement of the coloring properties of the photographic samples containing them and also an improvement of the color image fastness and color turbidity of the color images formed in the materials.

EXAMPLE 3

Samples Nos. 101 to 127 prepared in Example 1 were subjected to gradient exposure with a white light in the same manner as in Example 1, and the exposed samples were then processed by the same process as in Example 1, except that the pH value of the bleaching solution was changed to 5.5 and that a steel wool was brought into contact with the bleaching solution so that the divalent iron ion concentration in the solution was adjusted to be 5% of the total iron ion concentration. Immediately after the processing, the density of each of the processed samples was measured. After the measurement, the samples were then processed with the fresh bleaching solution of Example 1, then rinsed, fixed, rinsed and stabilized in the same manner as in Example 1. The density of each of the thus processed samples was again measured. The processing time and the processing temperature for each processing step were the same as those in Example 1.

From the characteristic curves of each sample thus obtained, the density of the point of the exposure amount giving a R density of (minimum R density+1.0) on the characteristic curve of the re-processed sample, and the density of the same point on the characteristic curve of the sample not re-processed were read out. The difference ($\Delta D_1$) between the thus read-out two values was obtained.

Next, the same samples were subjected to the same gradient exposure with a white light and then processed with an automatic developing machine in accordance with the process mentioned below. Further, the other same samples were subjected to the same gradient exposure with a white light and then continuously processed with the same automatic developing machine until the total amount of the replenisher added to the bleaching tank became three times as large as the tank capacity. Again, still other same samples as subjected to the same gradient exposure with a white light were processed with the same automatic developing machine.

The density of each of the thus processed samples was measured; and the logarithmic number of the reciprocal of the exposure amount giving a R density of (minimum R density+0.2) was calculated out. The thus calculated value was taken as the sensitivity of each sample. On the basis of the sensitivity of the sample as processed before the continuous processing, the difference ($\Delta S_2$) between the same samples was obtained. The density at the point of the exposure amount of logE=1.5 to the higher exposure amount side from the point of the exposure amount giving a R density (minimum R density+0.2) was read out. Also on the basis of the sensitivity of the sample as processed before the continuous processing, the difference ($\Delta D_2$) between the same samples was obtained.

Color Development Process:

| Step | Time | Temp. (°C.) | Amount of Replenisher | Tank Capacity (lite)r |
|---|---|---|---|---|
| Color Development | 3 min 15 sec | 38 | 45 ml | 10 |
| Bleaching | 1 min 00 sec | 38 | 20 ml | 4 |
| Bleach-fixation | 3 min 15 sec | 38 | 30 ml | 8 |
| Rinsing (1) | 40 sec | 35 | counter-current line system from (2) to (1) | 4 |

-continued

| Step | Time | Temp. (°C.) | Amount of Replenisher | Tank Capacity (lite)r |
|---|---|---|---|---|
| Rinsing (2) | 1 min 00 sec | 35 | 30 ml | 4 |
| Stabilization | 40 sec | 38 | 20 ml | 4 |
| Drying | 1 min 15 sec | 55 | | |

Amount of replenisher is per meter of 35 mm-wide sample.

Compositions of the processing solutions used above are mentioned below.

| Color Developer: | Tank Solution | Replenisher |
|---|---|---|
| Diethylenetriaminepenta-acetic Acid | 1.0 g | 1.1 g |
| 1-Hydroxyethylidene-1,1-diphosphonic Acid | 3.0 g | 3.2 g |
| Sodium Sulfite | 4.0 g | 4.4 g |
| Potassium Carbonate | 30.0 g | 37.0 g |
| Potassium Bromide | 1.4 g | 0.7 g |
| Potassium Iodide | 1.5 mg | — |
| Hydroxylamine Sulfate | 2.4 g | 2.8 g |
| 4-[N-ethyl-N-β-hydroxyethyl-amino]-2-methylaniline Sulfate | 4.5 g | 5.5 g |
| Water to make | 1.0 liter | 1.0 liter |
| pH | 10.05 | 10.10 |

Bleaching Solution

Tank solution and replenisher were same.

Ammonium Ethylenediaminetetraacetato/ 120.0 g Ferric Complex Dihydrate

Disodium Ethylenediaminetetraacetate 10.0 g

Ammonium Bromide 100.0 g

Ammonium Nitrate 10.0 g

Bleaching Accelerator 0.005 mol $(CH_3)_2N—CH_2—CH_2—S—S—CH_2—CH_2—N(CH_3)_2.2HCl$ Aqueous Ammonia (27%) 15.0 ml Water to make 1.0 liter pH 5.8

| Bleach-fixing Solution: | Tank Solution | Replenisher |
|---|---|---|
| Ammonium Ethylenediamine-tetraacetato/Ferric Complex Dehydrate | 50.0 g | — |
| Disodium Ethylenediamine-tetraacetate | 5.0 g | 2.0 g |
| Sodium Sulfite | 12.0 g | 20.0 g |
| Ammonium Thiosulfite Aqueous Solution (700 g/liter) | 240.0 ml | 400.0 ml |
| Aqueous Ammonia (27%) | 6.0 ml | — |
| Water to make | 1.0 liter | 1.0 liter |
| pH | 6.5 6.55 | |

Rinsing Solution

Tank solution and replenisher were same.

A city water was passed through a mixed bed type column filled with an H-type strong acidic cation-exchange resin (Amberlite IR-120B, produced by Rhom & Haas Co.) and an OH-type strong basic anion-exchange resin (Amberlite IRA-400, produced by Rhom & Haas Co.) so that both the calcium ion concentration and the magnesium ion concentration in the water were reduced to 3 mg/liter, individually. Next, 20 mg/liter of sodium dichloroisocyanurate and 150 mg/liter of sodium sulfate were added to the resulting water, which had a pH value falling within the range of from 6.5 to 7.5. This was used as the rinsing water.

Stabilizing Solution

Tank solution and replenisher were same.

Sodium P-toluenesulfinate 0.03 g

Polyoxyethylene P-monononylphenyl Ether 0.2 g (mean polymerization degree 10)

Disodium Ethylenediaminetetraacetate 0.05 g 1,2,4-Triazole 1.3 g 1,4-Bis(1,2,4-triazol-1-ylmethyl)- 0.75 g piperazine Water to make 1.0 liter pH 8.5

The results of the tests of the processed samples are shown in Table 4 below.

TABLE 4

| Sample No. | $\Delta D_1$ | Fluctuation of Photographic Properties in Continuous Processing $\Delta S_2$ | $\Delta D_2$ |
|---|---|---|---|
| 101 (comparative sample) | 0.53 | −0.05 | 0.08 |
| 102 (comparative sample) | 0.08 | −0.07 | 0.09 |
| 103 (comparative sample) | 0.09 | −0.07 | 0.09 |
| 104 (comparative sample) | 0.08 | −0.07 | 0.09 |
| 105 (comparative sample) | 0.04 | −0.04 | 0.04 |
| 106 (comparative sample) | 0.05 | −0.04 | 0.04 |
| 107 (comparative sample) | 0.05 | −0.04 | 0.04 |
| 108 (comparative sample) | 0.28 | −0.04 | 0.06 |
| 109 (comparative sample) | 0.05 | −0.04 | 0.07 |
| 110 (comparative sample) | 0.05 | −0.04 | 0.07 |
| 111 (comparative sample) | 0.05 | −0.04 | 0.07 |
| 112 (comparative sample) | 0.06 | −0.04 | 0.04 |
| 113 (comparative sample) | 0.06 | −0.04 | 0.04 |
| 114 (sample of the invention) | 0.03 | −0.02 | 0.02 |
| 115 (sample of the invention) | 0.03 | −0.02 | 0.02 |
| 116 (sample of the invention) | 0.03 | −0.02 | 0.02 |
| 117 (sample of the invention) | 0.03 | −0.03 | 0.02 |
| 118 (sample of the invention | 0.03 | −0.02 | 0.02 |
| 119 (sample of the invention) | 0.03 | −0.02 | 0.02 |
| 120 (sample of the invention) | 0.03 | −0.03 | 0.02 |
| 121 (sample of the invention) | 0.03 | −0.03 | 0.02 |
| 122 (sample of the invention) | 0.03 | −0.02 | 0.02 |
| 123 (sample of the | 0.03 | −0.02 | 0.02 |

TABLE 4-continued

| Sample No. | $\Delta D_1$ | Fluctuation of Photographic Properties in Continuous Processing $\Delta S_2$ | $\Delta D_2$ |
|---|---|---|---|
| invention) | | | |
| 124 (sample of the invention) | 0.03 | −0.03 | 0.02 |
| 125 (sample of the invention) | 0.03 | −0.02 | 0.02 |
| 126 (sample of the invention) | 0.03 | −0.02 | 0.02 |
| 127 (sample of the invention) | 0.03 | −0.01 | 0.02 |

From the results in Table 4 above, it is clear that the Sample Nos. 114 to 127 of the present invention, each containing a coupler of formula (I) and a coupler of formula (II) or (III) in combination, were better than the Comparative Sample Nos. 101 to 113, in that formation of leucoated cyan dye in the former, when processed with a bleaching solution having a reduced oxidizing power, was smaller than that in the latter and that the fluctuation of the photographic properties (sensitivity, color density) of the former was also smaller than that of the latter. Thus, it is understood that the combined use of a coupler of formula (I) and a coupler of formula (II) and/or (III) yields a better result than the single use of a coupler of formula (I) only.

EXAMPLE 4

Samples Nos. 101, 114, 115, 126 and 127 as prepared in Example 1 were selected, and Nos. 114, 115, 126 and 127 were modified by reducing the coating amounts of each of them in such a way that the gradation of the cyan dye to be formed in the thus modified samples might be the same as that to be formed in the third to fifth red-sensitive emulsion layers of Sample No. 101.

Each of the five kinds of Sample No. 101 and the modified Sample Nos. 114, 115, 126 and 127 was formed into a lens-combined film unit in accordance with the method described in JP-B-2-32615.

Using the five kinds of the thus formed lens-combined film units, various objects were photographed under the same conditions. The exposed films were subjected to color development with an automatic developing machine (FP-560BAL Model, manufactured by Fuji Photo Film Co.) and then printed on photographic papers of Fuji Color Paper Super FA Type II with a printer processor of Fuji Minilabo-champion FA-140 Model. For the color development, Cp-43FA (trade name: a processing chemical kit manufactured by Fuji Photo Film Co., Ltd.).

The printed images were observed and checked. The results were that the color saturation of the cyan color in the images from Sample Nos. 114, 115, 126 and 127, all of which satisfied the constitution of the present invention, was improved and that the color saturation of the other blue and green colors in them was also improved. From these results, it is verified that the samples of the present invention had an improved color reproducibility.

The exposed and processed films of Sample No. 101 and the modified Sample Nos. 114, 115, 126 and 127 were tested under the same conditions as those of Example 1 to evaluate the color image fastness to high-temperature and high-humidity and to light. From the tests, the same results as those in Example 1 were obtained, which indicate that the modified Sample Nos. 114, 115, 126 and 127, all of which satisfy the constitution of the present invention, are clearly superior to the Comparative Sample No. 101.

EXAMPLE 5

The same Sample No. 101 as that described in Example 1 of JP-A-2-854 was prepared, which is herein called Sample No. 501.

Next, Sample No. 502 was prepared in the same manner as Sample No. 501, except that the cyan couplers (C-1) and (C-2) in the third and fourth red-sensitive emulsion layers, respectively, in Sample No. 501 were each replaced by the same molar amount of the preceding couplers (IIIa)-1 and IIIC-28, respectively, of the present invention.

Sample No. 503 was prepared also in the same manner as Sample No. 502, except that the cyan couplers (C-6) and (C-8) in the fifth red-sensitive emulsion layer in Sample No. 502 were each replaced by the same molar amount of the preceding couplers (VIIIa)-11 and IIIC-33, respectively, of the present invention.

These Sample Nos. 501 to 503 were subjected to gradient exposure with a white light and developed by the same process as that described in Example 1 of JP-A-2-854. The properties of the thus processed samples were evaluated in accordance with the methods described above.

As a result, it was verified that the Sample Nos: 502 and 503 of the present invention, both of which contained a coupler of formula (I) and a coupler of formula (III) in combination, were superior to the Comparative Sample No. 501, in that the sensitivities of the former samples were higher than that of the latter sample, that the color densities of the color images formed in the former samples were higher than that in the latter, that the color image fastness of the color images formed in the former samples were higher than that in the latter sample, and the color turbidity of the cyan images formed in the former samples was smaller than that in the latter sample.

As explained in detail above, there is provided, in accordance with the present invention, a silver halide color photographic material containing a coupler of formula (I) and a coupler of formula (II) and/or (III) in combination. The photographic material has a high sensitivity and an improved color reproducibility, and gives a color image having a high color density and an elevated color image fastness.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having provided on a support at least one light-sensitive silver halide emulsion layer, wherein said photographic material contains a coupler selected from the group consisting of couplers represented by formulas (IIa) to (XIXa) and at least one coupler selected from the group consisting of couplers represented by formulas (II) and (III):

(IIa)
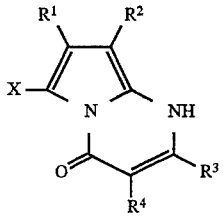
(IIIa)
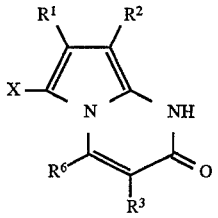
(IVa)
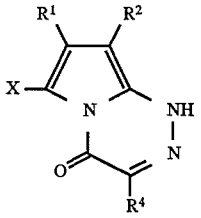
(Va)
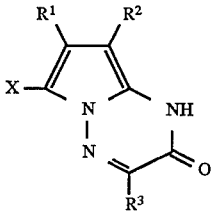
(VIa)
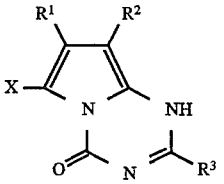
(VIIa)
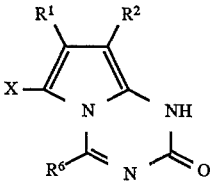
(VIIIa)
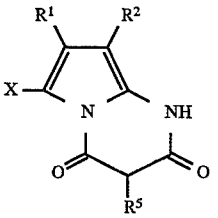
-continued
(IXa)
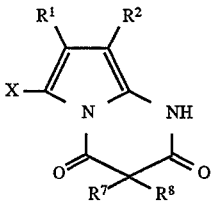
(Xa)
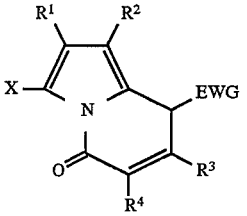
(XIa)
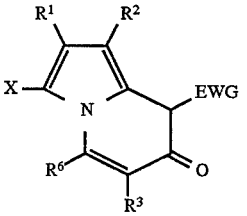
(XIIa)
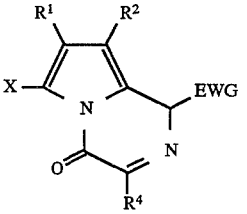
(XIIIa)
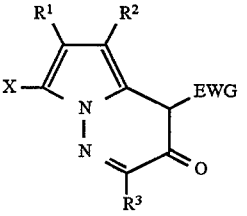
(XIVa)
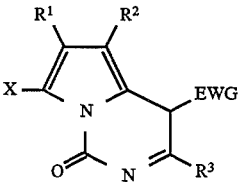
(XVa)
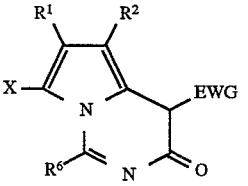

-continued (XVIIa)

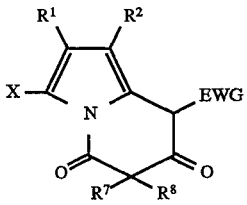

(XVIIIa)

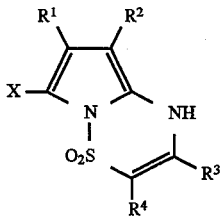

(XIXa)

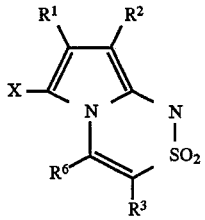

wherein $R^1$ represents a hydrogen atom or a substituent;

$R^2$ represents a substituent;

X represents a hydrogen atom or a leaving group capable of splitting off in a coupling reaction with an oxidation product of a color developing agent;

$R^3$, $R^5$, $R^6$, $R^7$ and $R^8$ are the same as or different from each other and each represents a hydrogen atom or a substituent;

$R^4$ represents a substituent;

EWG represents an electron attracting group having a Hammett's substituent constant σp value of 0.35 or more; and said coupler may be in the form of a bis- or higher-form by bonding via a divalent or a higher valent group at $R^1$, $R^2$, $R^3$, $R^4$, $R^5$, $R^6$, $R^7$ or $R^8$, or may be in the form of a polymer by bonding to a polymer chain at $R^1$, $R^2$, $R^3$, $R^4$, $R^5$, $R^6$, $R^7$ or $R^8$;

(II)

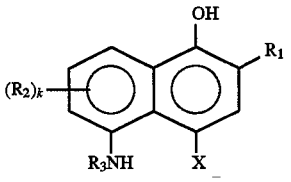

wherein $R_1$ represents $—CONR_4R_5$, $—SO_2NR_4R_5$, $—NHCOR_4$, $—NHCOOR_6$, $—NHSO_2R_6$, $—NHCONR_4R_5$ or $—NHSO_2NR_4R_5$;

$R_2$ represents a substituent;

k represents an integer of from 0 to 3, and when k is 2 or 3, the plural $R_2$ groups are the same as or different from each other or may be bonded to each other to form a ring;

$R_3$ represents a substituent;

X represents a hydrogen atom or a leaving group capable of splitting off in a coupling reaction with an oxidation product of a color developing agent;

$R_4$ and $R_5$ are the same as or different from each other and each independently represents a hydrogen atom, an alkyl group, an aryl group or a heterocyclic group, and $R_4$ and $R_5$ may be bonded to each other to form a nitrogen containing heterocyclic ring;

$R_6$ represents an alkyl group, an aryl group or a heterocyclic group;

$R_2$ and $R_3$, or $R_3$ and X may be bonded to each other to form a ring; and the coupler may be in the form of a bis or higher form by bonding via a bivalent or higher valent group at $R_1$, $R_2$, $R_3$ or X, or may be in the form of a polymer by bonding to a polymer chain at $R_1$, $R_2$, $R_3$ or X;

(III)

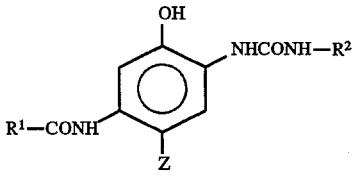

wherein $R^1$ represents an alkyl group, an aryl group or a heterocyclic group;

$R^2$ represents an aryl group; and

Z represents a hydrogen atom or a leaving group capable of splitting off in a coupling reaction with an oxidation product of a color developing agent.

2. The silver halide color photographic material as in claim 1, wherein the substituent represented by $R^1$ or $R^2$ in formulas (IIa) to (XIXa) is an aryl group, an alkyl group, a cyano group, an acyl group, a carbamoyl group, an alkoxycarbonyl group, an aryloxycarbonyl group, a formylamino group, an acylamino group, an alkoxycarbonylamino group, an aryloxycarbonylamino group, a sulfonamido group, a ureido group, a sulfamoylamino group, an alkylamino group, an arylamino group, an alkoxy group, an aryloxy group, a heterocyclic ring oxy group, an alkylthio group, an arylthio group, a heterocyclic ring thio group, a heterocyclic group, a halogen atom, a hydroxyl group, a nitro group, a sulfamoyl group, a sulfonyl group, an acyloxy group, a carbomoyloxy group, an imido group, a sulfinyl group, an oxophosphorio group, a carboxyl group, or an unsubstituted amino group, and wherein said groups may be further substituted by one or more of said substituents.

3. The silver halide color photographic material as in claim 1, wherein at least one of $R^1$ and $R^2$ in formulas (IIa) to (XIXa) is an electron attracting group having a Hammett's substituent constant σp value of 0.35 or more.

4. The silver halide color photographic material as in claim 1, wherein said substituent represented by $R^3$ to $R^8$ in formulae (IIa) to (XIXa) each is an aryl group, an alkyl group, a cyano group, an acyl group, a carbamoyl group, an alkoxycarbonyl group, an aryloxycarbonyl group, a formylamino group, an acylamino group, an alkoxycarbonylamino group, an aryloxycarbonylamino group, a sulfonamido group, a ureido group, a sulfamoylamino group, an alkylamino group, an arylamino group, an alkoxy group, an aryloxy group, a heterocyclic ring oxy group, an alkylthio group, an arylthio group, a heterocyclic ring thio group, a heterocyclic group, a halogen atom, a hydroxyl group, a nitro group, a sulfamoyl group, a sulfonyl group, an acyloxy group, a carbamoyloxy group, an imido group, a sulfinyl group, an oxophosphorio group, a carboxyl group, or an unsubstituted amino group, and wherein said groups may be further substituted by one or more of said substituents.

5. The silver halide color photographic material as in claim 1, wherein said substituent represented by $R_2$ in formula (II) is a halogen atom, a hydroxyl group, a carboxyl group, a sulfo group, an amino group, a cyano group, an alkyl group, an aryl group, a heterocyclic group, a carbonamido group, a sulfonamido group, a carbamoyl group, a sulfamoyl group, a ureido group, an acyl group, an acyloxy group, an alkoxy group, an aryloxy group, an alkylthio group, an arylthio group, an alkylsulfonyl group, an arylsulfonyl group, a sulfamoylamino group, an alkoxycarbonylamino group, a nitro group, or an imido group; provided that said substituents may be further substituted with at least one of the substituents; further provided that when k is 2 in formula (II), two $R_2$'s may form a methylenedioxy group or a trimethylene group; and still further provided that the total carbon number of $(R_2)_k$ is from 0 to 30.

6. The silver halide color photographic material as in claim 1, wherein said substituent represented by $R_3$ in formula (II) is represented by formula (II-1):

$$R_7(Y)_m— \qquad \text{(II-1)}$$

wherein Y represents —NH—, —CO— or —$SO_2$—; m represents an integer of 0 or 1; $R_7$ represents a hydrogen atom, an alkyl group having a total carbon number of from 1 to 30, an aryl group having a total carbon number of from 6 to 30, a heterocyclic group having a total carbon number of from 2 to 30,

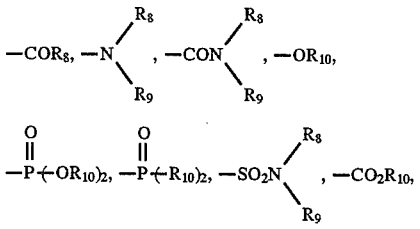

-continued

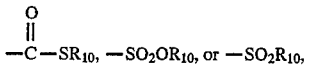

$R_8$, $R_9$ and $R_{10}$ have the same meanings as $R_4$, $R_5$ and $R_6$ in in formula (II), respectively; and $R_8$ and $R_9$ of —$NR_8R_9$ may be bonded to each other to form a nitrogen-containing hetero ring.

7. The silver halide color photographic material as in claim 1, wherein said alkyl group, aryl groups and heterocyclic group represented by $R^1$ or $R^2$ in formula (III) each is substituted with at least one substituent selected from the group consisting of a halogen atom, a cyano group, a nitro group, a carboxyl group, a sulfo group an alkyl group, an aryl group, a heterocyclic group, an alkoxy group, an aryloxy group, an alkylthio group, an arylthio group, an alkylsulfonyl group, an arylsulfonyl group, an alkoxycarbonyl group, an acyl group, a carbonamido group, a sulfonamido group, a carbamoyl group, a sulfamoyl group, an imido group, an amino group, a ureido group, an alkoxycarbonylamino group, and a sulfamoylamino group.

8. The silver halide color photographic material as in claim 1, wherein the proportion of the amount of at least one coupler selected from the group consisting of couplers represented by formulas (IIa) to (XIXa) to the total amount of the couplers represented by formulas (II) and (III) is 99.9/0.1 to 0.1/99.9 by mol.

9. The silver halide color photographic material as in claim 1, wherein the proportion of the amount of at least one coupler selected from the group consisting of couplers represented by formulas (IIa) to (XIXa) is 30 to 99.9 mol % based on the total amount of the couplers represented by formulas (IIa) to (XIXa), (II) and (III).

10. The silver halide color photographic material as in claim 1, wherein the couplers of formulas (IIa) to (XIXa), (II) and (III) are incorporated in the silver halide emulsion layer in a total amount of from $1\times10^{-3}$ to 2 mols per mol of silver halide in said layer.

11. The silver halide color photographic material as in claim 1, wherein the total amount of the couplers of formulas (IIa) to (XIXa), (II) and (III) in the photographic material is from $1\times10^{-3}$ to 3 g/$m^2$.

* * * * *